US005374507A

United States Patent [19]

Yoshioka

[11] Patent Number: 5,374,507

[45] Date of Patent: Dec. 20, 1994

[54] SILVER HALIDE COLOR PHOTOGRAPHIC LIGHT-SENSITIVE MATERIAL

[75] Inventor: Yasuhiro Yoshioka, Kanagawa, Japan

[73] Assignee: Fuji Photo Film Co., Ltd., Kanagawa, Japan

[21] Appl. No.: 87,485

[22] Filed: Jul. 8, 1993

[30] Foreign Application Priority Data

Jul. 9, 1992 [JP] Japan ..... 4-221888
Jan. 7, 1993 [JP] Japan ..... 5-016976

[51] Int. Cl.[5] ..... G03C 1/46

[52] U.S. Cl. ..... 430/505; 430/503; 430/556; 430/557; 430/510; 430/950; 430/538; 430/507; 430/517; 430/536; 430/523

[58] Field of Search ..... 430/503, 556, 557, 510, 430/950, 538, 507, 517, 536, 523, 505

[56] References Cited

U.S. PATENT DOCUMENTS

| | | | |
|---|---|---|---|
| 4,755,454 | 7/1988 | Aotsuka et al. | 430/538 |
| 5,118,599 | 6/1992 | Lau et al. | 430/556 |
| 5,143,822 | 9/1992 | Nishio | 430/510 |
| 5,151,345 | 9/1992 | Hasebe | 430/523 |
| 5,238,799 | 8/1993 | Usami et al. | 430/510 |

FOREIGN PATENT DOCUMENTS

| | | |
|---|---|---|
| 0447969 | 9/1991 | European Pat. Off. . |
| 0482552 | 4/1992 | European Pat. Off. . |

*Primary Examiner*—Thomas R. Neville
*Attorney, Agent, or Firm*—Sughrue, Mion, Zinn, Macpeak & Seas

[57] ABSTRACT

A silver halide color photographic light-sensitive material capable of providing a dye image having excellent color reproducibility, sharpness and image fastness. The light-sensitive material comprises a support and provided thereon photographic constitutional layer comprising at least one light-sensitive silver halide emulsion layer containing a yellow dye-forming coupler, at least one light-sensitive silver halide emulsion layer containing a magenta dye-forming coupler, and at least one light-sensitive silver halide emulsion layer containing a cyan dye-forming coupler , and at least one non-light-sensitive hydrophilic colloid layer, wherein the above silver halide emulsion layer containing the yellow dye-forming coupler contains at least one of the yellow dye-forming couplers represented by the following Formula (I) or (II) and at least one of the hydrophilic colloid layers is provided between the support and the silver halide emulsion layer closest thereto and contains a white pigment:

Formula (I)

Formula (II)

The terms and substituents in Formulae (I) and (II) are as defined in the specification.

14 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, and more specifically to a silver halide color photographic light-sensitive material capable of providing a dye image having excellent color reproducibility, sharpness and image fastness.

BACKGROUND OF THE INVENTION

A silver halide color photographic: light-sensitive material has the characteristic that it has a high image quality and an excellent cost performance, and it is most widely used as a means for reproducing a color image. In order to further improve this characteristic of the silver halide color photographic light-sensitive material, a large number of investigations for increasing image quality has been conducted. In order to increase the image quality in a color print material, there are required for image quality performance, an excellent color reproduction of the color print obtained after a development processing, a sharp image having no blur (a high sharpness), and a visually inconspicuous dye cloud fine particle constituting the dye (an excellent graininess). It is a very important performance characteristic to provide a dye image which is fast to light, heat and humidity and is not faded for a long time, In recent years, the fastness of the dye image has been strikingly improved and it has been possible to store a color print for a long time.

Meanwhile, in seeking to increase the image quality in a color photographing material, a large number of efforts have been made for improving sharpness and graininess, and a color negative film capable of providing a high sensitive and sharp negative image has come to be presented. Under such circumstances, it is anticipated that in the future improvement in the sharpness of a color paper will become more and more important from the viewpoint of the improvement in the quality of a color print finally obtained.

Meanwhile, in order to obtain an image having a high sharpness, a measure is required to be taken so that light for an exposure is not spread over a wide range on a print face to generate fading. There are known as the method for the prevention of this spreading, a method in which a water soluble dye is used in order to prevent irradiation generated on an emulsion layer provided on a reflection type support, a method in which a coloring layer (AH) is provided in order to prevent halation, and amethod in which reflection rate is raised in the vicinity of a surface on a reflection type support in order to prevent a blur in the support. Of these methods, there is described in JP-A-3-156439 (the term "JP-A" as used herein means an unexamined published Japanese patent application) as the method for preventing a blur, the method in which a white pigment is incorporated into a waterproof resin layer covering a reflection type support in the proportion of 14% or more. Further, there is described in JP-A-57-64235 and JP-A-62-187846, the method in which a hydrophilic colloid layer containing a white pigment is provided between a support and a silver halide emulsion layer.

However, there have still been left in these methods in which a white pigment is used, the problem that the background is yellowed during storage over a long period of time after processing, and the problem that the discoloring or fading of a dye image is accelerated. Further, also in the methods in which there is provided a coloring layer in which a water soluble dye and colloidal silver are used, the increase in the amount thereof in order to obtain a higher sharpness causes a residual color on the background after processing and generates discoloring and fading on the background or dye image due to aging, and thus still necessitates an improvement therein.

The color image-forming method most generally used in a silver halide color photographic light-sensitive material is the method in which an oxidized aromatic primary amine series color developing agent is reacted with a coupler using exposed silver halide as an oxidizing agent to form indophenol, indoaniline, indamine, azomethine, phenoxazine, phenazine, and dyes equivalent thereto. In such a system, the method in which a color image is reproduced by a subtractive color process is used and generally, the amounts of the three color dyes formed of yellow, magenta and cyan are changed to form the color image.

Of them, a pivaloyl type yellow coupler and a benzoyl type yellow coupler have most generally been used as a yellow coupler. The former has the defect that color developing performance is low while the fastness of a dye image formed is excellent, and it is so limited that it can not meet the requirements for rapid processing and low replenishing during processing, which is strongly required in recent years. Further, it has not yet reached a sufficiently satisfactory level in terms of the hue of a dye formed. Meanwhile, the latter has the serious problem that while it has a high color developing performance, it has a further worse hue of the dye formed and a very low fastness of the dye image. In the coupler for a color print, a serious consideration is placed on the hue and fastness of the dye formed, and therefore the pivaloyl type yellow coupler is generally used. However, the pivaloyl type yellow coupler also has not yet reached a sufficiently satisfactory level in terms of hue, and thus a further improvement is desired.

In order to improve the color reproduction performance of the color print, attention has been given to the pivaloylacetanilide type coupler having an alkoxy group at the 6-position of an anilide ring. While this coupler is certainly improved to some extent in terms of the color reproduction performance, a problem still remains in terms of the fastness of a dye image.

The problem common to the pivaloyl type couplers is the insufficient image fastness under the condition of a high humidity. Further, it has a problem as well in terms of a light fastness after it is left under a high humidity. As the color print is stored in an environment in which light, heat and humidity are changed, the evaluation of an actual fastness is a difficult subject and it is required to be checked under various conditions.

Further, in recent years, there are proposed for improvement in color reproduction performance and a color development performance, the acylacetoamide type yellow coupler having a 3- to 5-membered cyclic structure, described in European Patent EP 0,447,969A1, the malondianilide type yellow coupler having a cyclic structure, described in European Patent EP 0,482,552A1, and the acylacetoanilide type yellow coupler having a dioxane structure, described in U.S. Pat. No. 5,118,599.

SUMMARY OF THE INVENTION

A first object of the present invention is to provide a silver halide color photographic light-sensitive material capable of providing a sharp dye image having excellent sharpness.

A second object of the present invention is to provide a silver halide color photographic light-sensitive material capable of providing a dye image formed by color development processing and having a good hue and excellent color reproduction performance.

A third object of the present invention is to provide a silver halide color photographic light-sensitive material capable of providing a formed dye image which is fast and less susceptible to discoloring or fading even under various storage conditions.

The above and other objects of the present invention have been achieved by the following silver halide color photographic light-sensitive materials.

In a first aspect of the present invention, there is provided a silver halide color photographic light-sensitive material comprising a support and provided thereon photographic constitutional layers comprising at least one light-sensitive silver halide emulsion layer containing a yellow dye-forming coupler, at least one light-sensitive silver halide emulsion layer containing a magenta dye-forming coupler, and at least one light-sensitive silver halide emulsion layer containing a cyan dye-forming coupler, and at least one non-light-sensitive hydrophilic colloid layer, wherein the above silver halide emulsion layer containing the yellow dye-forming coupler contains at least one yellow dye-forming coupler represented by the following Formula (I) or (II) and at least one hydrophilic colloid layer is provided between the support and the silver halide emulsion layer closest thereto and contains a white pigment:

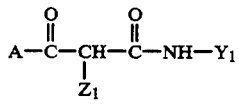

(I)

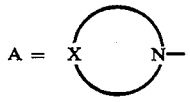

wherein X represents an organic group necessary to form a nitrogen-containing heterocyclic group together with a nitrogen atom; $Y_1$ represents an aromatic group or heterocyclic group; and $Z_1$ represents a group splitting off when the coupler represented by the above formula reacts with an oxidation product of a developing agent;

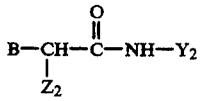

(II)

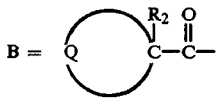

wherein $R_2$ represents a monovalent group other than a hydrogen atom; Q represents a group of non-metal atoms necessary to form a 3- to 5-membered hydrocarbon ring or a 3- to 6-membered heterocyclic group having at least one hetero atom selected from N, O, S and P in the ring together with a carbon atom; provided that $R_2$ may be combined with Q to form a polycyclic ring which is greater than a bicyclic ring;

In a second aspect of the present invention, there is provided a silver halide color photographic light-sensitive material comprising a reflection type support covered with a waterproof resin layer and provided thereon photographic constitutional layers comprising at least one light-sensitive silver halide emulsion layer containing a yellow dye-forming coupler, at least one light-sensitive silver halide emulsion layer containing a magenta dye-forming coupler, and at least one light-sensitive silver halide emulsion layer containing a cyan dye-forming coupler, and at least ore non-light-sensitive hydrophilic colloid layer, wherein the above silver halide emulsion layer containing the yellow dye-forming coupler contains at least one yellow dye-forming coupler represented by the above Formula (I) or (II), and the above waterproof resin layer is provided on the emulsion layer side of the support and contains a white pigment in a density of 14 weight % or more;

In a third aspect of the present invention, the silver halide color photographic light-sensitive material described in the above first aspect or second aspect, is one wherein at least one layer of the above light-sensitive emulsion layers and non-light-sensitive emulsion layer is a coloring layer capable of being decolored during color development processing; and In the fourth aspect of the present invention, the silver halide color photographic light-sensitive material described in the above second aspect, is one wherein a density of the white pigment contained in the waterproof resin layer is 17 weight % or more.

By paying attention to the dye-forming couplers and the compositions of the hydrophilic colloid layer, it has been discovered that the above objects can be solved by using the yellow coupler of the present invention, and coating a white pigment-containing hydrophilic colloid layer on a support preferably in a high density, or incorporating a white pigment into a waterproof resin layer laminated on the support in a high density. Further, a coloring layer can be provided.

DETAILED DESCRIPTION OF THE INVENTION

The yellow coupler represented by Formula (I) will be described below in detail.

The nitrogen-containing heterocyclic group represented by A is a saturated or unsaturated, monocyclic condensed heterocyclic group having a carbon number of 1 or more, preferably 1 to 20, and particularly preferably 2 to 12, which may be either substituted or unsubstituted. In addition to the nitrogen atom, an oxygen atom, sulfur atom, or a phosphorous atom may be contained in the ring. Each one or more of these hereto atoms may be present inthe ring. The number of the ring is a 3-membered or more ring, preferably a 3- to 12-membered particularly preferably a 5- to 6-membered ring.

There can be enumerated as specific examples of the nitrogen-containing heterocyclic group represented by A, pyrrolidino, piperizino, morpholino, 1-imidazolidinyl, 1-pyrazolyl, 1-piperazinyl, 1-indolinyl, 1,2,3,4-tetrahydroquinoxaline-1-yl, 1-pyrrolinyl, pyrazolidine-1-yl, 2,3-dihydro-1-indazoyl, isoindoline-2-yl, 1-indolyl, 1-pyrrolyl, benzothiazine-4-yl, 4-thiazinyl, benzodiazine-1-yl, aziridine-1-yl, benzoxadine-4-yl, 2,3,4,5-tetrahydroquinolyl, and phenoxadine-10-yl.

When $Y_1$ represents an aromatic group in Formula (I), it is a saturated or unsaturated, substituted or unsubstituted aromatic group having a carbon number of 6 or more, preferably 6 to 10. It is particularly preferably phenyl or naphthyl.

When $Y_1$ represents a heterocyclic group in Formula (I), it is a saturated or unsaturated, or substituted or unsubstituted heterocyclic group having a carbon number of 1 or more, preferably 1 to 10, and particularly preferably 2 to 5. A nitrogen atom, a sulfur atom, or an oxygen atom is an example of a preferred hetero atom. The number of the ring is preferably a 5- to 6-membered ring, but may be different from this. The heterocyclic group may be either monocyclic or a condensed ring. When $Y_1$ represents a heterocyclic group, there can specifically be enumerated, for example, 2-pyridyl, 4-pyrimidinyl, 5-pyrazolyl, 8-quinolyl, 2-furyl, and 2-pyrrolyl.

When the group represented by A and the group represented by $Y_1$ each have a substituent, there can be enumerated as the substituent, a halogen atom (for example, a fluorine atom and a chlorine atom), an alkoxycarbonyl group (having a carbon number of 2 to 30, preferably 2 to 20, for example, methoxycarbonyl, dodecyloxycarbonyl and hexadecyloxycarbonyl), an acylamino group (having a carbon number of 2 to 30, preferably 2 to 20, for example, acetoamido, tetradecaneamido, 2-(2,4-di-t-amylphenoxy)butaneamido, and benzamido), a sulfonamido group (having a carbon, number of 1 to 30, preferably 1 to 20, for example, methanesulfonamido, dodecanesulfonamido, hexadecanesulfonamido, and benzenesutfonamido), a carbamoyl group (having a carbon number of 2 to 30, preferably 2 to 20, for example, N-butylcarbamoyl and N,N-diethylcarbamoyl), a sulfamoyl group (having a carbon number of ! to 30, preferably 1 to 20, for example, N-butylsulfamoyl, N,N-diethylsufamoyl, N-dodecylsulfamoyt, N-hexadecylsulfamoyl, and N-3-(2,4-di-t-amylphenoxy) -butylsulfamoyl), an alkoxy group (having a carbon number of 1 to 30, preferably 1 to 20, for example, methoxy and dodecyloxy) , an N-acylsulfamoyl group (having a carbon number of 2 to 30, preferably 2 to 20, for example, N-propanoylsulfamoyl and N-tetradecanoylsulfamoyl), a sulfonyl group (having a carbon number of 1 to 30, preferably 1 to 20, for example, methanesulfonyl, octanesulfonyl, and dodecanesulfonyl) , an atkoxycarbonylamino group (having a carbon number of 1 to 30, preferably 1 to 20, for example, methoxycarbonylamino and tetradecyloxycarbonylamino) , a cyano group, a nitro group, a carboxyl group, an aryloxy group (having a carbon number of 6 to 20, preferably 6 to 10, for example, phenoxy and 4-chlorophenoxy), an alkylthio group (having a carbon number of 1 to 30, preferably 1 to 20, for example, methylthio and dodecylthio), a ureido group (having a carbon number of 1 to 30, preferably 1 to 20, for example, phenylureido), an aryl group (the same as those defined for the aromatic group represented by $Y_1$), a heterocyclic group (the same as those defined for the heterocyclic group represented by $Y_1$), a sulfo group, an alkyl group (a linear, branched or cyclic, saturated or unsaturated and substituted or unsubstituted alkyl group having a carbon number of 1 to 30, preferably 1 to 20, for example, methyl, ethyl, isopropyl, cyclopropyl, trifluoromethyl, cyclopentyl, dodecyl, and 2-hexyloctyl), an acyl group (the carbon number of 1 to 30, preferably 2 to 20, for example, acetyl and benzoyl), an arylthio group (having a carbon number of 6 ,to 20, preferably 6 to 10, for example, phenylthio), a sulfamoylamino group (having a carbon number of 0 to 30, preferably 0 to 20, for example, N-butylsulfamoylamino and N-dodecylsulfamoylamino), an N-acylcarbamoyl group (having a carbon number of 2 to 30, preferably 2 to 20, for example, N-dodecanoylcarbamoyl), an N-sulfonylcarbamoyl group (having a carbon number of 1 to 30, preferably 2 to 20, for example, N-hexadecanesulfonylcarbamoyl, N-benzenesulfonylcarbamoyl, and N-(2-octyloxy-5-t-octylbenzenesulfonyl)carbamoyl), an N-sulfamoylcarbamoyl group (having a carbon number of 1 to 30, preferably 1 to 20, for example, N-(ethylsulfamoyl)carbamoyl, and N-[3-(2,4-di-t-amylphenoxy)propylsulfamoyl]carbamoyl), an N-sulfonylsulfamoyl group (having a carbon number of 0 to 30, preferably 1 to 20, for example, N-dodecanesulfonylsulfamoyl and N-benzenesulfonylsulfamoyl), an N-carbamoylsulfamoyl group (having a carbon number of 1 to 30, preferably 1 to 20 , for example, N-(ethylcarbamoyl)sulfamoyl, and N-[3-(2,4-di-t-amylphenoxy)-propylcarbamoyl]sulfamoyl), an N-(N-sulfonylcarbamoyl) sulfamoyl group (having a carbon number of 1 to 30, preferably 1 to 20, for example, N-(dodecanesulfonylcarbamoyl)sulfamoyl, and N- (2-octyloxy-5-t-octylbenezenesulfonylcarbamoyl)sulfamoyl), a 3-sulfonylureido group (having a carbon number of 1 to 30, preferably 1 to 20, for example, 3-hexadecanesulfonylureido, and 3-benzenesulfonylureido) , a 3acylureido group (having a carbon number of 2 to 30, preferably 2 to 20, for example, 3-acetylureido, and 3-benzoylureido), a 3-acylsulfamido group (having a carbon number of 1 to 30, preferably 1 to 20, for example, 3-propionylsulfamido, and 3- (2,4-dichiorobenzoyl)sulfamido), a 3-sulfonylsulfamido group (having a carbon number of 0 to 30, preferably I to 20, for example, 3-methanesulfonylsulfamido, and 3-(2-methoxyethoxy-5-t-octylbenzenesulfonyl)sulfamido), a hydroxyl group, an acyloxy group (having a carbon number of 1 to 30, preferably 1 to 20, for example, propanoyloxy, and tetradecanoyloxy), a sulfonyloxy group (having a carbon number of 0 to 30, preferably 0 to 20, for example, dodecanesulfonyloxy, and 2-octyloxy-5-t-octylbenzenesulfonyloxy), and an aryloxycarbonyl group (having a carbon number of 7 to 20, preferably 7 to 10, for example, phenoxycarbonyl).

When the group represented by A has a substituent, there can be enumerated as preferred examples of the substituent, among those enumerated above, a halogen atom, an alkoxy group, an acylamino group, a carbamoyl group, an alkyl group, a sulfonamido group, and a nitro group. The unsubstituted group is a preferred example as well.

When the group represented by $Y_1$ has a substituent, there can be enumerated as preferred examples of the substituent, a halogen atom, an alkoxycarbonyl group, a sulfamoyl group, a carbamoyl group, a sulfonyl group, a sulfonamido group, an acylamino group, an alkoxy group, an aryloxy group, an N-acylcarbamoyl group, an N-sulfonylcarbamoyl group, an N-sulfamoylcarbamoyl group, an N-sulfonylsulfamoyl group, an N-acylsulfamoyl group, an N-carbamoylsulfamoyl group, and an N-(N-sulfonylcarbamoyl) sulfamoyl group, which are enumerated above as a substituent for $Y_1$.

The group represented by $Z_1$ in Formula (I) may be anyone of the coupling splitting groups (a group capable of splitting off upon a coupling reaction with an oxidation product of an aromatic primary amine developing agent) which have so far been known. There can be enumerated as a preferred $Z_1$, a nitrogen-containing heterocyclic group bonded to a coupling site via a nitrogen atom, an aromatic oxy group, an aromatic thio group, a heterocyclic oxy group, a heterocyclic thio group, an acyloxy group, a carbamoyloxy group, an alkylthio group, and a halogen atom. These coupling splitting groups may be any of a photographically useful group or a precursor thereof (for example, a development inhibitor, a development accelerator, a desilvering accelerator, a fogging agent, a dye, a hardener, a coupler, a developing agent oxidation product scavenger, a fluorescent dye, a developing agent, or an electron transfer agent), and a non-photographically useful group.

When $Z_1$ represents a nitrogen-containing heterocyclic group, it can be a monocyclic or condensed, substituted or unsubstituted heterocyclic group. There can be enumerated as examples thereof, succinimide, maleinimide, phthalimide, diglycolimide, pyrrolino, pyrazolyl, imidazolyl, 1,2,4-triazole-1-yl (or 4-yl), 1-tetrazolyl, indolyl, benzopyrazolyl, benzimidazolyl, benzotriazolyl, imidazolidine-2,4-dione-3-yl (or 1-yl), oxazolidine-2,4-dione-3-yl, thiazolidine-2,4-dione-3-yl, imidzoline-2-one-1-yl, oxazoline-2-one-3-yl, thiazoline-2-one-3-yl, benzooxazoline-2-one-3-yl, 1,2,4-triazolidine-3,5-dione-4-yl, 2-pyridone-1-yl, morpholine-3,5-dione-4-yl, 1,2,3-triazole-1-yl, and 2-imidazoline-5-one.

When these heterocyclic groups represented by $Z_1$ have substituents, the substituent enumerated as the substituents which the above group represented by A may have can be enumerated as the substituents for the heterocyclic group represented by $Z_1$.

When $Z_1$ represents a nitrogen-containing heterocyclic group, it is preferably 1-pyrazolyl, imidazolyl, 1,2,3-triazole-1-yl, benzotriazolyl, 1,2,4-triazole-1-yl, oxazolidine-2,4-dione-3-yl, 1,2,4-triazolidine-3,5-dione-4-yl, or imidazolidine-2,4-dione-3-yl. The case in which these groups have substituents is included.

When $Z_1$ represents an aromatic oxy group, it is preferably a substituted or unsubstituted phenoxy group. When it has a substituent, the substituents enumerated as the substituent the above group represented by $Y_1$ may have can be enumerated as the substituents therefor. The preferred substituent for the phenoxy group is the case in which at least one substituent is an electron attractive substituent. Examples of an electron attractive substituent include, for example, a sulfonyl group, an alkoxycarbonyl group, a sulfamoyl group, a halogen atom, a carboxyl group, a carbamoyl group, an acyl group, or a nitro group.

When $Z_1$ represents an aromatic thio group, it is preferably a substituted or unsubstituted phenylthio group. When it has a substituent, the substituents enumerated as the substituents the above group represented by $Y_1$ may have can be enumerated as the substituents therefor. The preferred substituent for the phenylthio group is the case in which at least one of the substituents is an alkyl group, an alkoxy group, a sulfonyl group, an alkoxycarbonyl group, a sulfamoyl group, a halogen atom, a carbamoyl group, or a nitro group.

When $Z_1$ represents a heterocyclic oxy group, the portion representing the heterocyclic group has the same meaning as the above heterocyclic group represented by $Y_1$.

When $Z_1$ represents a heterocyclic thio group, a 5- to 6-membered unsaturated heterocyclic thio group is the preferred example. There can be enumerated, for example, tetrazolylthio, 1,3,4-thiadiazolylthio, 1,3,4-oxadiazolylthio, 1,3,4-triazolylthio, benzimidazolylthio, benzothiazolylthio, or 2-pyridylthio. When these $Z_1$ groups have substituents, the substituents enumerated as the substituents the above heterocyclic group represented by $Y_1$ may have can be enumerated as the substituents therefor. A particularly preferred substituent for these $Z_1$ groups is an aromatic group, an alkyl group, an alkylthio group, an acylamino group, an alkoxycarbonyl group, or an aryloxycarbonyl group.

When $Z_1$ represents an acyloxy group, it can be an aromatic acyloxy group (having a carbon number of 7 to 11, preferably benzoyloxy), or an aliphatic acyloxy group (having a carbon number of 2 to 20, preferably 2 to 10). It may have a substituent. The substituents enumerated as the substituents the above aromatic group represented by $Y_1$ may have can be enumerated as a specific example of the substituent. The preferred substituent is the case in which at least one substituent is a halogen atom, a nitro group, an aryl group, an alkyl group, or an alkoxy group.

When $Z_1$ represents a carbamoyloxy group, it is an aliphatic group having a carbon number of 1 to 30, preferably 1 to 20, an aromatic group, a heterocyclic group, or an unsubstituted carbamoyloxy group. There can be enumerated, for example, N,N-diethylcarbamoyloxy, N-phenylcarbamoyl-morpholinocarbonyloxy, 1-imidazolytcarbonyloxy, and N,N-dimethylcarbamoyloxy. In the above case, specific examples of the alkyl group, aromatic group and heterocyclic group are the same as those defined for $Y_1$ in the above explanation.

When $Z_1$ represents an alkylthio group, it is an alkylthio group having a carbon number of 1 to 30, preferably 1 to 20. Specific examples of the alkyl group are the same as those defined for $Y_1$ in the above explanation.

There can be enumerated as a preferred group represented by $Z_1$ in Formula (I), a 5- to 6-membered nitrogen-containing heterocyclic group (bonded to a coupling site via a nitrogen atom), an aromatic oxy group, a 5- to 6-membered heterocyclic oxy group, or a 5- to 6-membered heterocyclic thio group.

A preferred group represented by $Y_1$ in Formula (I) is an aromatic group. Particularly preferred is a phenyl group having at least one substituent at an ortho position. When $Y_1$ is an aromatic group, the substituents on $Y_1$ can be any of those enumerated above as a substituent for $Y_1$.

When the group represented by $Y_1$ in Formula (I) is a phenyl group having at least one substituent at an ortho position, particularly preferred as the substituent present at the ortho position is a halogen atom, an alkoxy group, an alkyl group, or an aryloxy group, which are enumerated above as a substituent for $Y_1$.

Of the yellow couplers represented by Formula (I), a particularly preferred yellow coupler is represented by the following Formula (III):

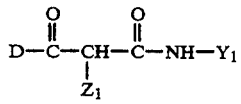

(III)

-continued

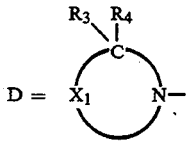

In Formula (III), $Y_1$ and $Z_1$ have the same meaning as explained in Formula (I); and $X_1$ represents an organic group necessary to form a nitrogen-containing heterocyclic group together with —C($R_3R_4$)—N—, in which $R_3$ and $R_4$ each represent a hydrogen atom or a substituent.

In Formula (III), the preferred tenses and specific examples of $Y_1$ and $Z_1$ are the same as explained in Formula (I).

Specific examples of the heterocyclic group and substituents thereof represented by D in Formula (III) are the same as those described in the explanation of A in Formula (I). Further, the preferred range thereof is the same as that described for A. Particularly preferred is the case in which the nitrogen-containing heterocyclic group is a benzene condensed ring.

When $R_3$ or $R_4$ in Formula (III) is a substituent, the examples of the substituents are the same as the examples of the substituents enumerated when the group represented by A in Formula (I) has a substituent.

Of the couplers represented by Formula (III), further more preferred coupler is represented by the following Formula (IV):

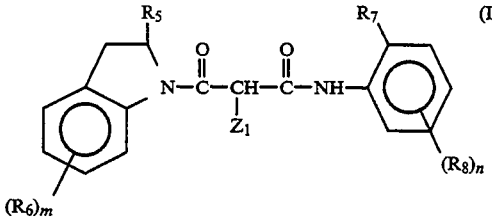

(IV)

wherein $R_5$ represents a hydrogen atom or a substituent; $R_6$, $R_7$ and $R_8$ each represent a substituent; $Z_1$ has the same meaning as explained in Formula (I); m and n each are the integers of 0 to 4; and when m and n each represent an integer of two or more, the $R_6$ groups and $R_8$ groups each may be the same or different and may be combined with each other to form a ring.

When $R_5$ and $R_6$ represent a substituent in Formula (IV), examples of the substituents are the same as the examples of the substituents enumerated when the group represented by A has a substituent. There can be enumerated as the preferred example of $R_5$, a halogen atom, an alkyl group, and an aryl group, and as the preferred example of $R_6$, a halogen atom, an alkoxy group, an acylamino group, a carbamoyl group, an alkyl group, a sulfonamido group, a cyano group, and a nitro group, which are enumerated above as a substituent for A. m is preferably an integer of 0 to 2, particularly preferably 0 or 1.

The same substituents as those enumerated when the group represented by $Y_1$ in Formula (I) has a substituent can be enumerated as examples of the substituents represented by $R_7$ and $R_8$. $R_7$ is preferably a halogen atom, an alkoxy group, an alkyl group, or an aryloxy group, which are enumerated above as a substituent for $Y_1$. There can be enumerated as a preferred example of $R_8$, the same ones as those enumerated as the preferred example of the substituent when the group represented by $Y_1$ in Formula (I) has a substituent. n is preferably an integer of 0 to 2, more preferably 1 or 2.

The couplers represented by Formulas (I), (III) and (IV) may be combined with each other at $X_1$, $Y_1$ and $Z_1$ via a divalent or more group to form a dimer or a polymer higher than that. In this case, the carbon number may fall out of the range shown for each of the above substituent.

Specific examples of the coupler represented by Formula (I) will be shown below, but the present invention is not limited thereto.

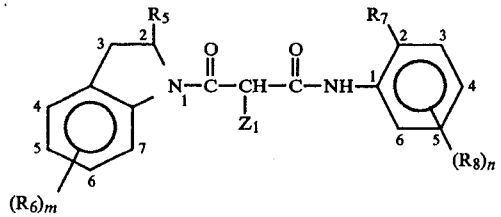

| No. | $R_5$ | m | $R_6$ | $R_7$ | n | $R_8$ | $Z_1$ |
|---|---|---|---|---|---|---|---|
| (1) | H | 0 | — | $-OCH_3$ | 1 | $-5-SO_2NHCO\overset{C_7H_{15}}{\overset{\vert}{C}}HC_9H_{19}$ | 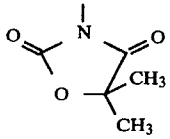 |
| (2) | " | " | — | $-OC_{18}H_{37}(n)$ | 1 | $-5-SO_2NHCO\overset{C_2H_5}{\overset{\vert}{C}}HC_4H_9$ | " |
| (3) | " | " | — | $-OC_{12}H_{25}(n)$ | 1 | $-5-SO_2NHCON(C_3H_7)_2$ | " |
| (4) | " | " | — | $-O-CH_2\overset{C_6H_{13}(n)}{\overset{\vert}{C}}H-C_8H_{17}(n)$ | 1 | $-5-SO_2NHCO\overset{C_2H_5}{\overset{\vert}{C}}HC_4H_9$ | " |
| (5) | H | 0 | — | $-O-\overset{CH_3}{\overset{\vert}{C}}HCOOC_{12}H_{25}(n)$ | 1 | $-5-SO_2NHCOC_2H_5$ | 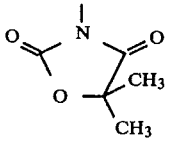 |
| (6) | " | " | — | $-OCH_2\overset{CH(CH_3)CH_2C(CH_3)_3}{\overset{\vert}{C}}H\underset{(CH_2)_2CH(CH_3)CH_2C(CH_3)_3}{\underset{\vert}{}}$ | 1 | $-5-SO_2NHCOC_2H_5$ | " |
| (7) | " | " | — | $-OCH_2COOCH_2\overset{C_{10}H_{21}}{\overset{\vert}{C}}HC_8H_{17}$ | 1 | $-5-SO_2NHCOCH_3$ | " |

-continued
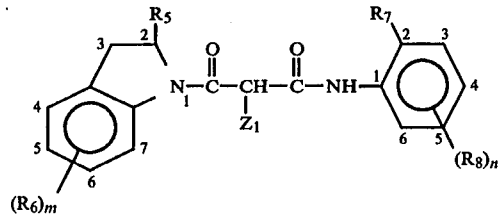
| No. | $R_5$ | m | $R_6$ | $R_7$ | n | $R_8$ | $Z_1$ |
|---|---|---|---|---|---|---|---|
| (8) | " | " | — | 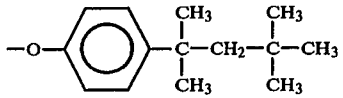 | 1 | $-5-SO_2NHCO\underset{\vert}{C}(C_2H_5)CH_4H_9$ | " |
| (9) | " | " | — | 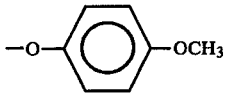 | 1 | $-5-SO_2NHCO\underset{\vert}{C}H(C_7H_{15})-C_9H_{19}$ | " |
| (10) | " | " | — | 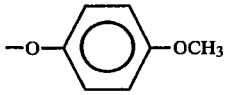 | 1 | $-5-CONHSO_2C_{12}H_{25}$ | " |
| (11) | H | 0 | — | 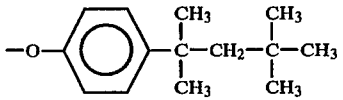 | 1 | $-4-SO_2NHCOC_9H_{19}$ | 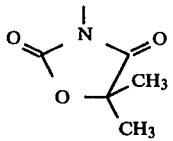 |
| (12) | " | " | — | " | 2 | $-4-Cl-5-CONHSO_2C_{16}H_{33}(n)$ | " |
| (13) | " | " | — | " | 2 | $-3-Cl-5-CONHCOC_{11}H_{23}$ | " |
| (14) | " | " | — | $-OCH_3$ | 2 | $-3-Cl-5-CONHSO_2C_{12}H_{25}(n)$ | " |
| (15) | " | " | — | $-OC_{16}H_{33}(n)$ | 1 | 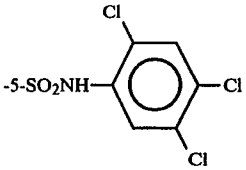 | " |

-continued
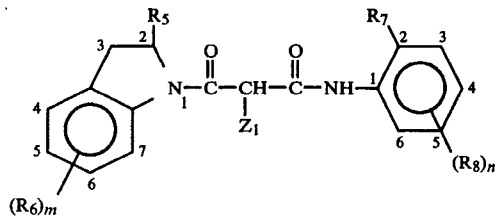
| No. | $R_5$ | m | $R_6$ | $R_7$ | n | $R_8$ | $Z_1$ |
|---|---|---|---|---|---|---|---|
| (16) | " | " | — | $-OCH_2CH(C_6H_{13})C_8H_{17}$ | 1 | 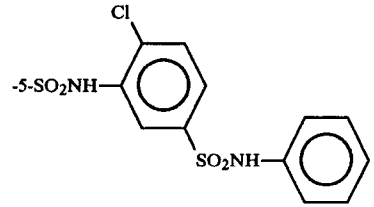 | " |
| (17) | H | 0 | — | $-OCH(CH_3)_2$ | 1 | 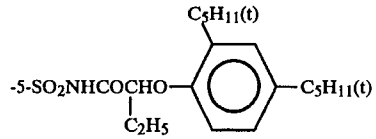 | 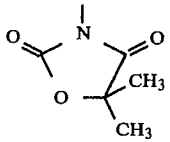 |
| (18) | " | " | — | $-OC_{18}H_{37}(n)$ | 1 | 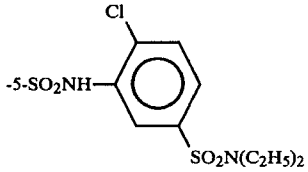 | " |
| (19) | " | " | — | 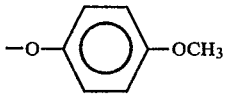 | 1 | 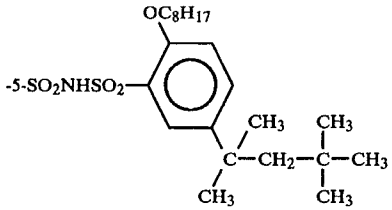 | " |

-continued
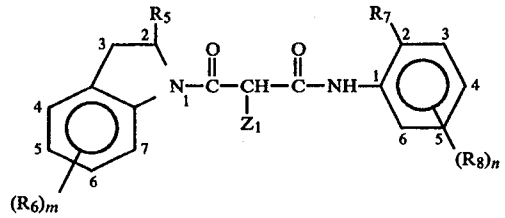
| No. | $R_5$ | m | $R_6$ | $R_7$ | n | $R_8$ | $Z_1$ |
|---|---|---|---|---|---|---|---|
| (20) | " | " | — | $-OC_2H_5$ | 1 | " | 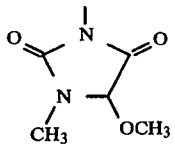 |
| (21) | " | " | — | $-OC_{18}H_{37}(n)$ | 2 | -4-Cl-5-$CONHSO_2C_{12}H_{25}$ | 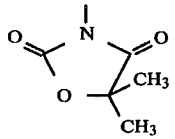 |
| (22) | H | 0 | — | $-OC_{18}H_{37}(n)$ | 1 | 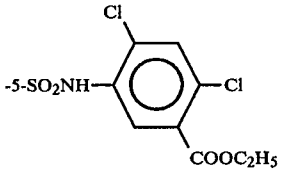 | 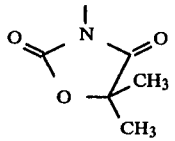 |
| (23) | " | " | — | 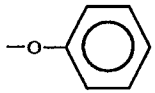 | 1 | 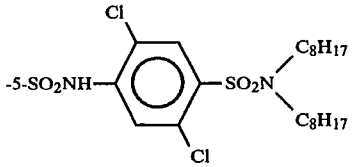 | " |

-continued
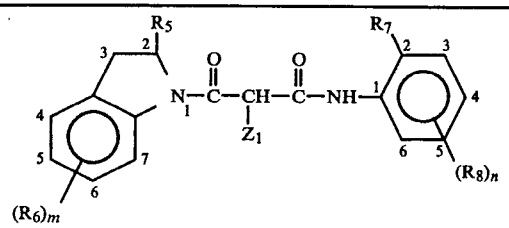
| No. | $R_5$ | m | $R_6$ | $R_7$ | n | $R_8$ | $Z_1$ |
|---|---|---|---|---|---|---|---|
| (24) | " | " | — | $-OCH(CH_3)_2$ | 1 | 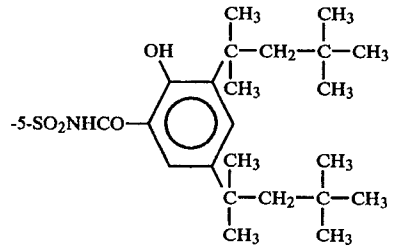 | " |
| (25) | $CH_3$ | " | — | $-OC_2H_5$ | 1 | $-5-SO_2NHCOCH(C_7H_{15})C_9H_{19}$ | " |
| (26) | H | " | — | $-OC_{18}H_{37}(n)$ | 1 | 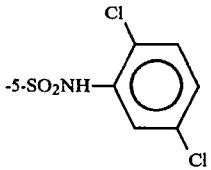 | 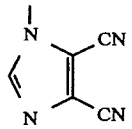 |
| (27) | " | " | — | 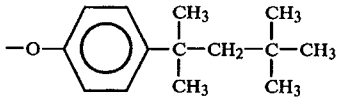 | 1 | 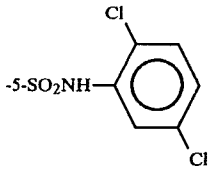 | 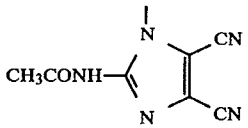 |
| (28) | H | 0 | — | $-OC_{16}H_{33}(n)$ | 1 | $-5-SO_2NHCOC_2H_5$ | 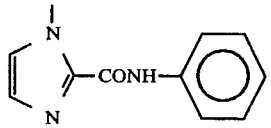 |

-continued
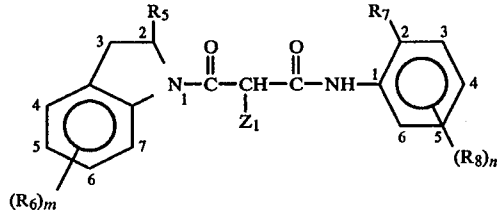
| No. | $R_5$ | m | $R_6$ | $R_7$ | n | $R_8$ | $Z_1$ |
|---|---|---|---|---|---|---|---|
| (29) | " | 0 | — | —Cl | 1 | -5-CONHSO$_2$—C$_{16}$H$_{33}$(n) | 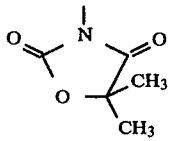 |
| (30) | " | 0 | — | " | 1 | -5-NHCOCH(CH$_3$)CH$_2$SO$_2$C$_{12}$H$_{25}$ | 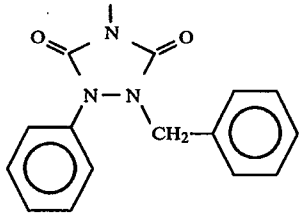 |
| (31) | " | 0 | — | —Cl | 1 | 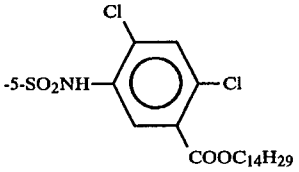 | 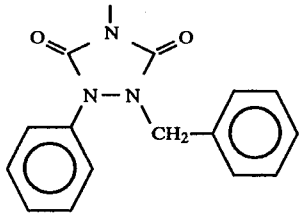 |

-continued
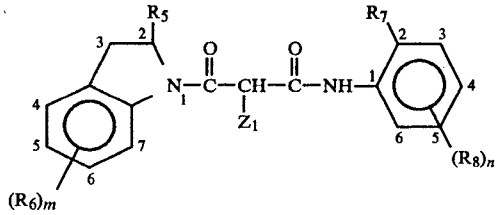
| No. | $R_5$ | m | $R_6$ | $R_7$ | n | $R_8$ | $Z_1$ |
|---|---|---|---|---|---|---|---|
| (32) | " | 0 | — | " | 2 | -4-Cl-5-$COOC_{12}H_{25}$ | 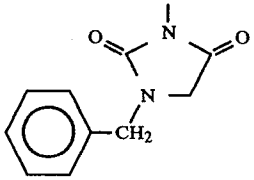 |
| (33) | H | 0 | — | —Cl | 2 | 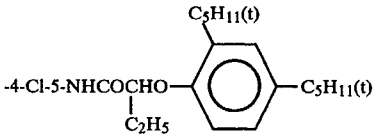 | 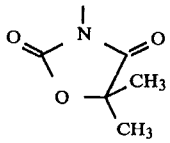 |
| (34) | " | 0 | — | " | 1 | -5-$SO_2NHC_{12}H_{25}$ | " |
| (35) | " | 0 | — | " | 1 | -5-$SO_2NHSO_2C_{16}H_{33}$(n) | 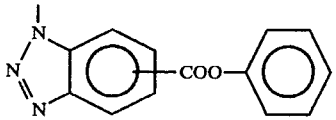 |
| (36) | " | 1 | 5-$NO_2$ | " | 1 | 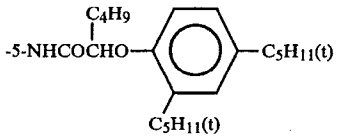 | 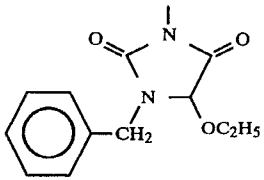 |
| (37) | " | 2 | 5,7-Br | " | 1 | -5-$NHSO_2C_{16}H_{33}$(n) | " |

-continued
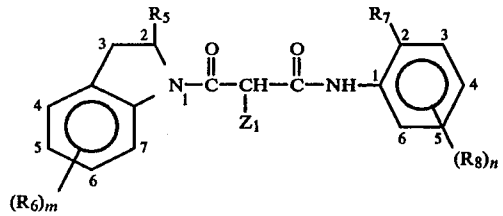
| No. | $R_5$ | m | $R_6$ | $R_7$ | n | $R_8$ | $Z_1$ |
|---|---|---|---|---|---|---|---|
| (38) | " | 0 | — | $-C_{18}H_{37}(n)$ | 1 | 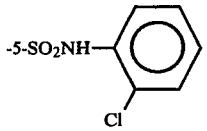 | 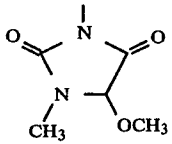 |
| (39) | " | 0 | — | " | 1 | " | 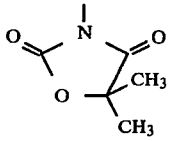 |
| (40) | H | 0 | — | $-OCH_2CH(C_8H_{17})-C_{10}H_{21}$ | 1 | 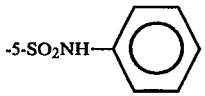 | 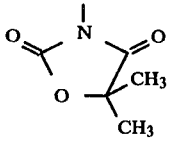 |
| (41) | H | 1 | 5-Cl | —Cl | 1 | $-5-NHSO_2C_{16}H_{33}$ | 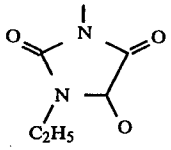 |

-continued
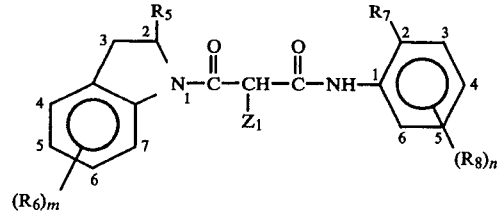
| No. | $R_5$ | m | $R_6$ | $R_7$ | n | $R_8$ | $Z_1$ |
|---|---|---|---|---|---|---|---|
| (42) | 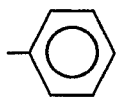 | 1 | 5-$NO_2$ | —$OC_{14}H_{29}$ | 1 | 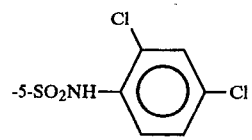 | 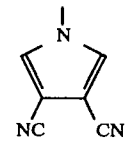 |
| (43) | H | 1 | 5-Br | —Cl | 1 | -5-$COOCH(C_4H_9)$—$COOC_{12}H_{25}$ | 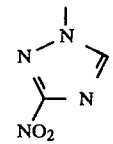 |
| (44) | H | 1 | " | " | 1 | " | 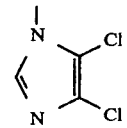 |
| (45) | H | 1 | 5-Cl | —Cl | 1 | -5-$NHSO_2C_{12}H_{25}$ | 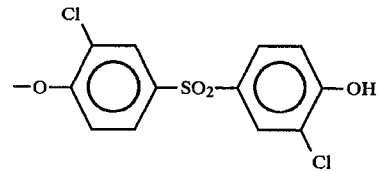 |

-continued
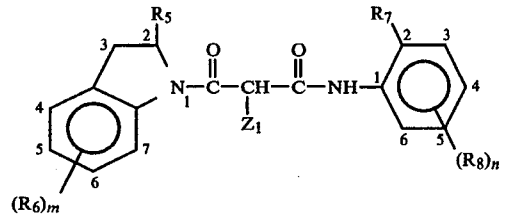
| No. | $R_5$ | m | $R_6$ | $R_7$ | n | $R_8$ | $Z_1$ |
|---|---|---|---|---|---|---|---|
| (46) | " | 1 | 5-$NO_2$ | " | 1 | -5-$NHSO_2C_{12}H_{25}$ | 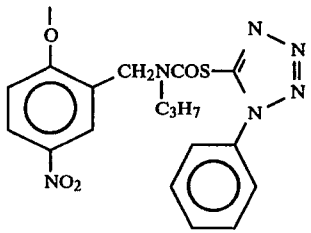 |
| (47) | " | 0 | — | " | 1 | 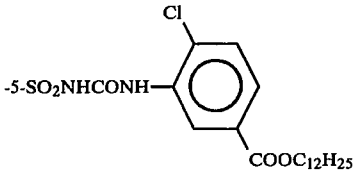 | 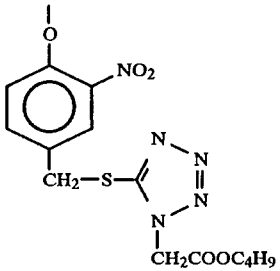 |
| (48) | " | 1 | 5-$OCH_3$ | " | 2 | -4-Cl-5-$COOC_{12}H_{25}$ | 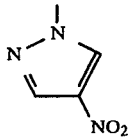 |

-continued
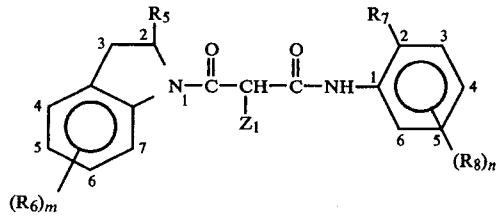
| No. | $R_5$ | m | $R_6$ | $R_7$ | n | $R_8$ | $Z_1$ |
|---|---|---|---|---|---|---|---|
| (49) | H | 1 | 5-$NO_2$ | $-CF_3$ | 1 | 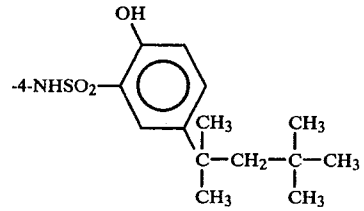 | 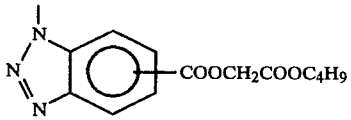 |
| (50) | " | 0 | — | $-OC_2H_5$ | 1 | -5-$SO_2C_{12}H_{25}$ | 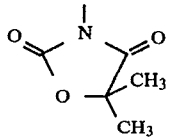 |
| (51) | " | 0 | — | $-Cl$ | 1 | 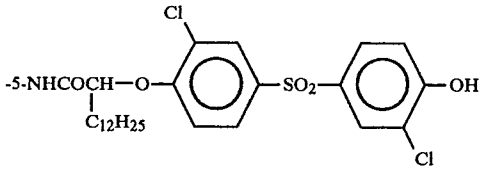 | " |
| (52) | $C_2H_5$ | 0 | — | " | 1 | 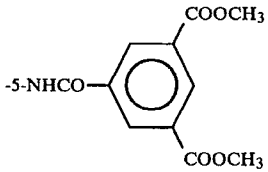 | 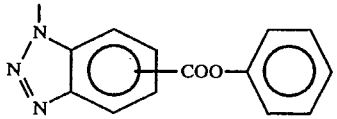 |

-continued
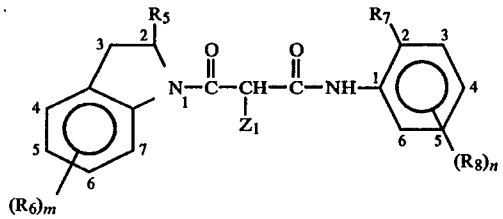
| No. | $R_5$ | m | $R_6$ | $R_7$ | n | $R_8$ | $Z_1$ |
|---|---|---|---|---|---|---|---|
| (53) | H | 0 | — | " | 1 | 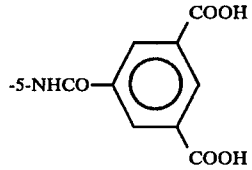 | 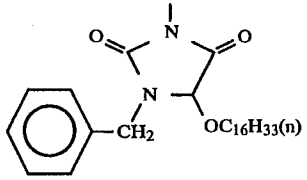 |
| (54) | H | 0 | — | —Cl | 1 | $-5-SO_2NHCOC_{11}H_{23}$ | 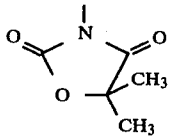 |
| (55) | H | 0 | — | 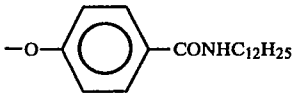 | 1 | 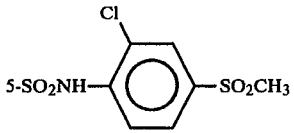 | " |
| (56) | H | 1 | Br | 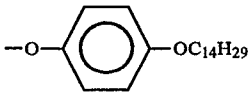 | 1 | 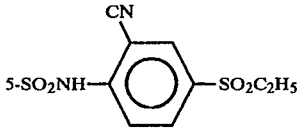 | " |
| (57) | H | 0 | — | 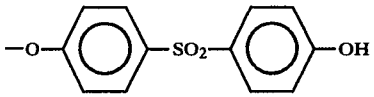 | 1 | 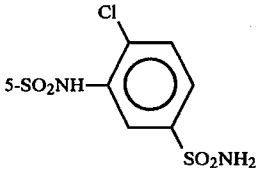 | " |

-continued
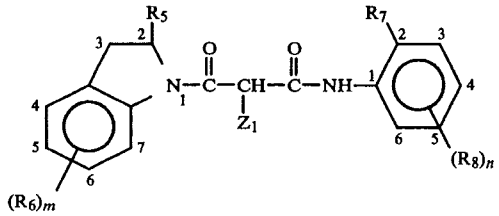
| No. | $R_5$ | m | $R_6$ | $R_7$ | n | $R_8$ | $Z_1$ |
|---|---|---|---|---|---|---|---|
| (58) | H | 0 | — | 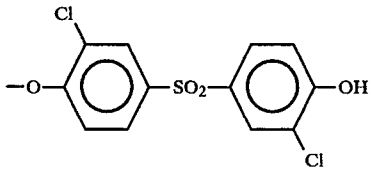 | 1 | 5-$SO_2NHC_{14}H_{29}$ | 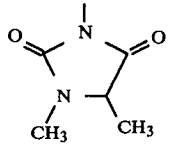 |
| (59) | H | 0 | — | 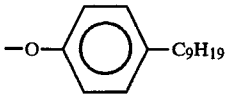 | 1 | 5-$SO_2NHCONHC_{12}H_{25}$ | 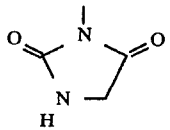 |
| (60) | " | " | — | 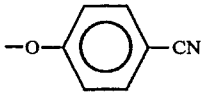 | 1 | 5-$NHSO_2C_{16}H_{33}$(n) | 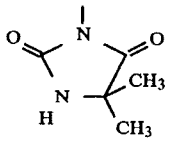 |
| (61) | " | " | — | 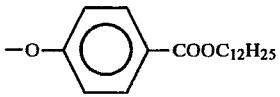 | 1 | 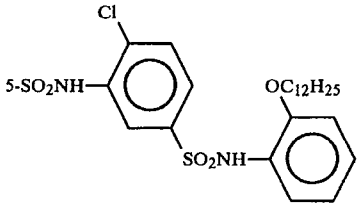 | 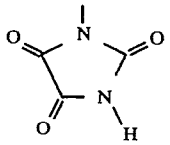 |

-continued
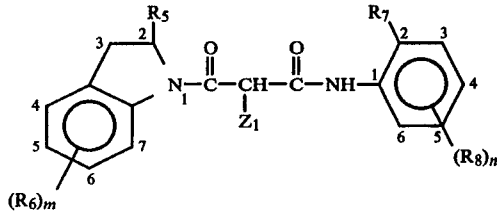
| No. | $R_5$ | m | $R_6$ | $R_7$ | n | $R_8$ | $Z_1$ |
|---|---|---|---|---|---|---|---|
| (62) | " | " | — | 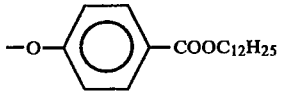 | 1 | 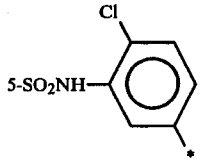 *$NHSO_2C_{12}H_{25}$ | 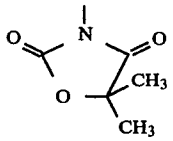 |
| (63) | " | 1 | 5-$NO_2$ | " | 1 | " | 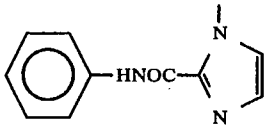 |
| (64) | H | 1 | 5-$NHSO_2CH_3$ | 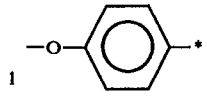 1 *—$SO_2HNC_{12}H_{25}$ | 1 | 5-$SO_2NH_2$ | 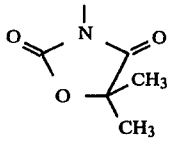 |
| (65) | " | 0 | — | 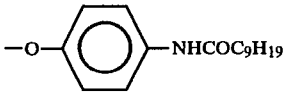 | 2 | 4-Cl-5-$CONH(CH_2)_3$* 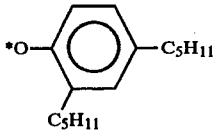 | " |

-continued
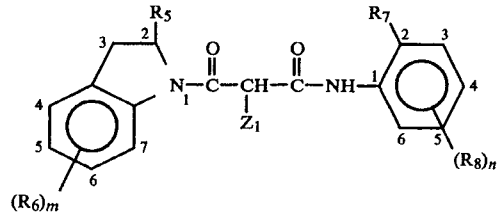
| No. | $R_5$ | m | $R_6$ | $R_7$ | n | $R_8$ | $Z_1$ |
|---|---|---|---|---|---|---|---|
| (66) | $-CH_3$ | 1 | 5-Br | 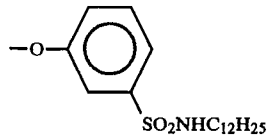 | 1 | 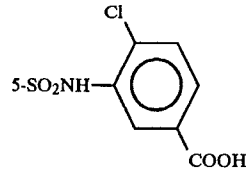 | 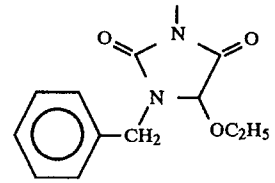 |
| (67) | H | 0 | — | 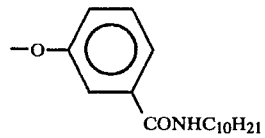 | 1 | 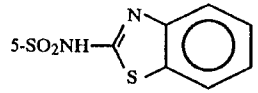 | 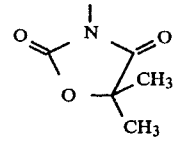 |
| (68) | " | 1 | 5-Br | $-OC_{12}H_{25}$ | 1 | 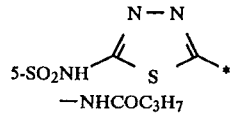 | " |
| (69) | H | 0 | — | 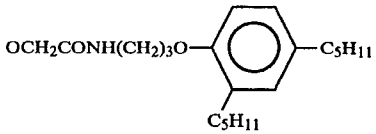 | 1 | 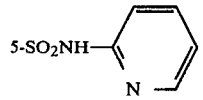 | 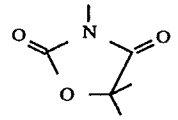 |

-continued
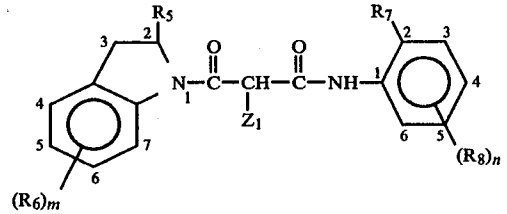
| No. | $R_5$ | m | $R_6$ | $R_7$ | n | $R_8$ | $Z_1$ |
|---|---|---|---|---|---|---|---|
| (70) | " | 0 | — | 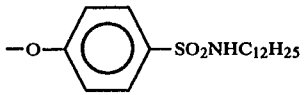 | 1 | 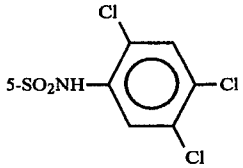 | 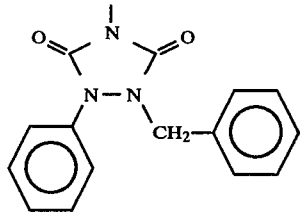 |

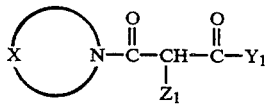
| No. | 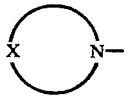 | $Y_1$ | $Z_1$ |
|---|---|---|---|
| (71) | 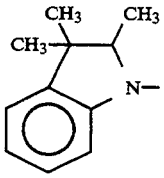 | 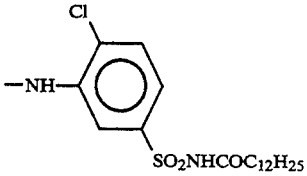 | 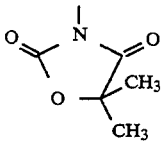 |
| (72) | 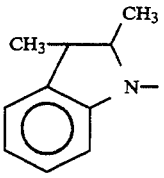 | 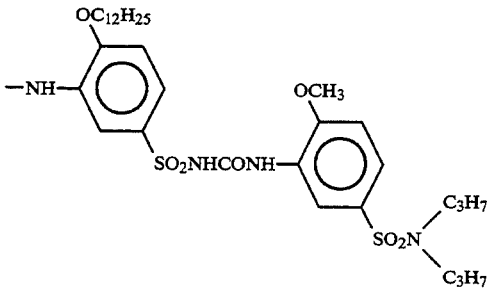 | " |
| (73) | 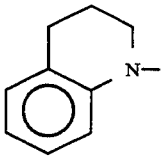 | 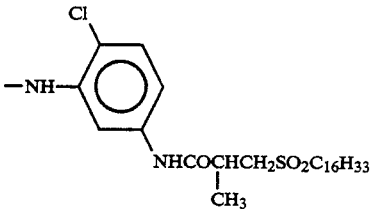 | 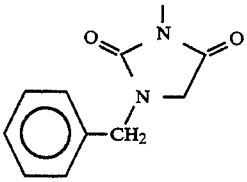 |
| (74) | 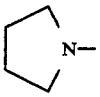 | 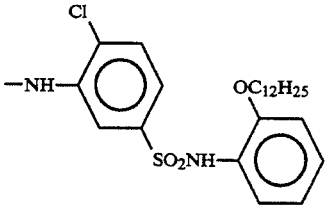 | 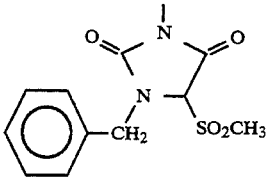 |
| (75) | 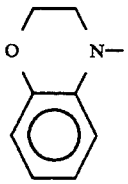 | 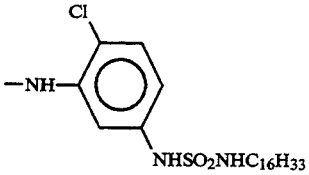 | 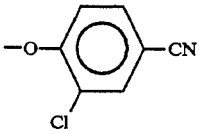 |
| (76) | 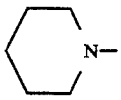 | 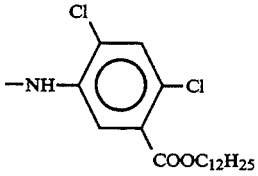 | 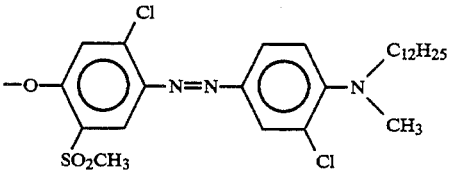 |

-continued
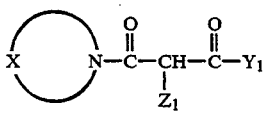
| No. | 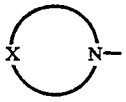 | $Y_1$ | $Z_1$ |
|---|---|---|---|
| (77) | 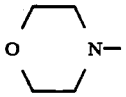 | 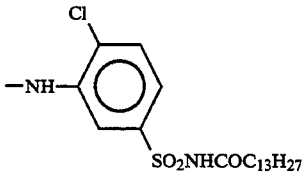 | 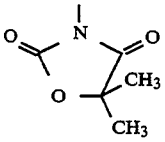 |
| (78) | 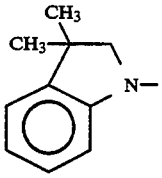 | 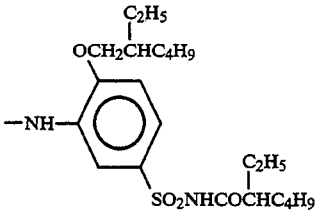 | $SCH_2COOH$ |
| (79) | 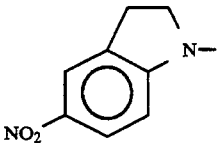 | 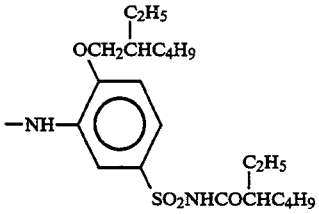 | 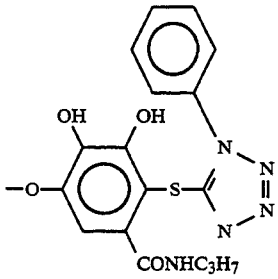 |
| (80) | " | " | 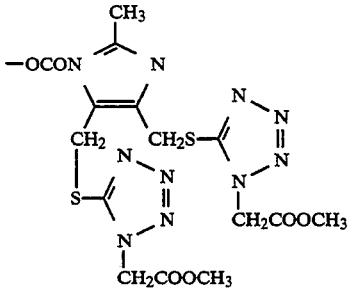 |
| (81) | 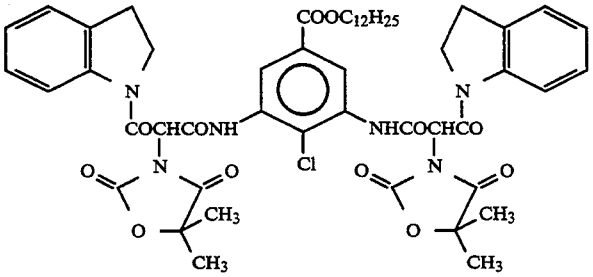 | | |

-continued

| No. | 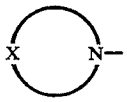 | $Y_1$ | $Z_1$ |
|---|---|---|---|
| (82) | 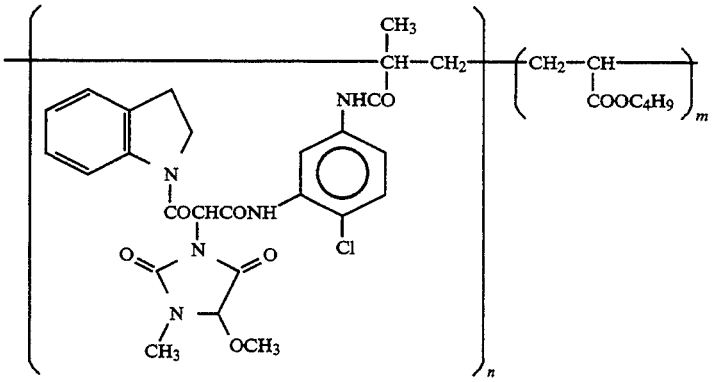 | | |

n:m = 50:50 (weight ratio)
Number average molecular weight: 25,000

The compounds of the present invention can be synthesized by conventional methods generally known or methods equivalent thereto.

They can be synthesized via, for example, the following synthesis route:

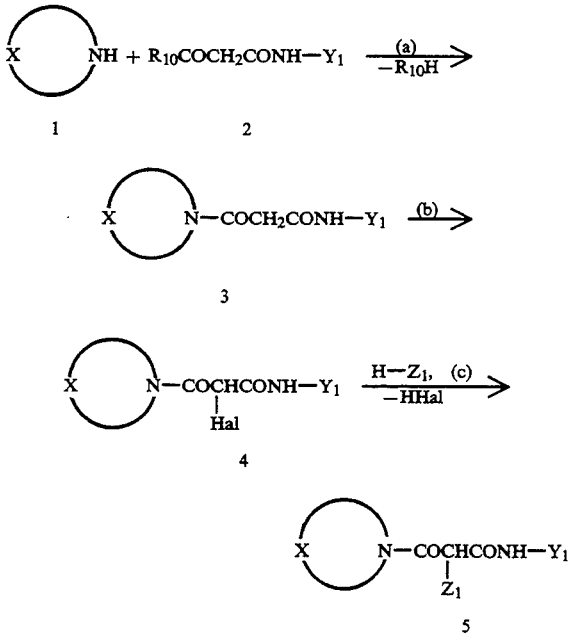

(Compound of Formula (I))

wherein X, $Y_1$ and $Z_1$ have the same meaning as explained in Formula (I); $R_{10}$ represents a halogen atom (for example, a chlorine atom), —OH, an alkoxy group (for example, methoxy and ethoxy), or a phenoxy group (for example, phenoxy and 4-nitrophenoxy); and Hal represents halogen.

According to the reaction condition in step (a), the reaction is carried out with a dehydration condensing agent (for example, N,N-dicyclohexylcarbodiimide and N,N-diisopropylcarbodiimide) when $R_{10}$ is OH. When $R_{10}$ is a halogen atom, the reaction is carried out under the presence of a dehydrohalogenation agent. There are used as the dehydrohalogenation agent, an organic base (for example, triethylamine, diisopropylethylamine, pyridine, guanidine, and potassium butoxide), or an inorganic base (for example, sodium hydroxide, potassium hydroxide, sodium hydride, potassium carbonate).

In the reaction of the compound 3 to the compound 4, a halogenating agent is used in step (b). It is, for example, bromine, chlorine, N-bromosuccinimide, and N-chlorosuccinimide.

In the reaction of the compound 4 to the final compound, the dehydrohalogenation agent is generally used in step (c). The above organic base or inorganic base can be enumerated as an example thereof.

In the respective reactions, a reaction solvent is generally used. There can be enumerated, for example, a chlorine series solvent (for example, dichloromethylene), an aromatic series solvent (for example, benzene, chlorobenzene, and toluene), an amide series solvent (for example, N,N-dimethylforamide, N-N-dimethylacetoamide, and N-methylpyrrolidone), a nitrile series solvent (for example, acetonitrile and propionitrile), an ether series solvent (for example, tetrahydrofuran and ethylene glycol diethyl ether), a sulfone series solvent (for example, dimethylsulfone and sulfolane), and a hydrocarbon series solvent (for example, dichlorohexane and normal-hexane).

The compounds can be synthesized as well by a process other than the synthesis route shown above. They can be synthesized as well, for example, by the method described in *J. Org. Chem.*, Vol. 29, 2932 (1964). The compound 5 is further subjected to a conversion of a functional group in some cases to derive it to the final compound. The change of those synthesis routes or the addition of a reaction can arbitrarily be selected.

A specific synthesis process will be described below and the other exemplified compounds can be synthesized as well in a similar manner.

*Synthesis Example* 1: Synthesis of Exemplified Compound (54)

Compound (54) was synthesized according to the following synthesis process:

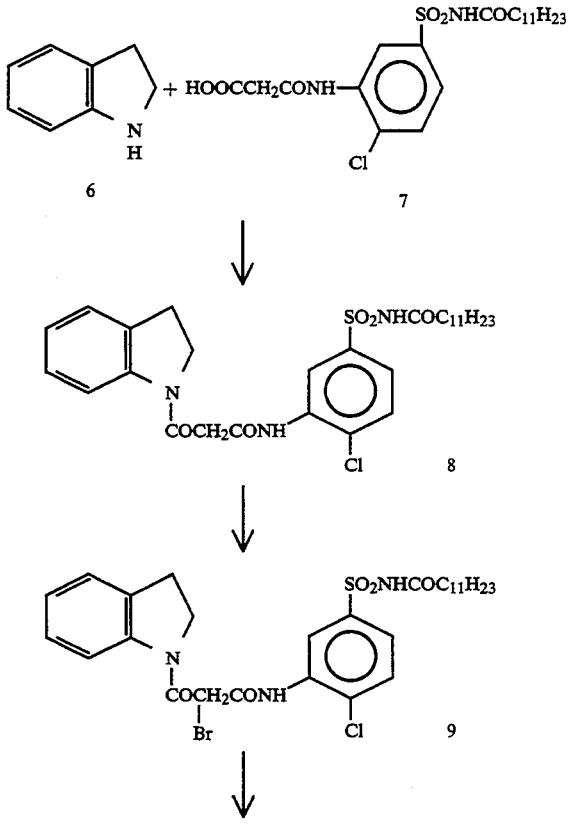

Compound (54)

Compound 6 (3.5 g) and compound 7 (14 g) were dissolved in N,N-dimethylformamide (100 ml) and acetonitrilel (100 ml). An acetonitrile solution (40 ml) in which N,N'-dicyclohexycarbodiimide (6 g) was dissolved was added dropwise to this solution at room temperature. After reaction for 2 hours, N,N'-dicyclohexylurea deposited was filtered off. The filtrate was poured into water (500 ml) and the solution was extracted with ethyl acetate (500 ml). An oil layer was collected with a separating funnel and washed with water, followed by drying the oil layer on sodium sulfate. The solvent was distilled off under a reduced pressure and hexane was added to the residue to crystalize it. Compound 8 (7.2 g) was obtained.

Compound 8 (16 g) was mixed in dichloromethane (150 ml) and a dichloromethane solution (10 ml) containing bromine (4.8 g) was added dropwise thereto while cooling with ice (5° to 10° C.). After continuing the reaction for 10 minutes, the solution was transferred in a separating funnel and washed with water. The oil layer (the solution containing compound 9) was separated and used for the next process as it was.

Added to N,N-dimethylforamide (160 ml) were 5,5-dimethyl-2,4-dioxo-1,3-oxazolidine (8.1 g) and triethylamine (8.8 ml). The dichloromethane solution of compound 9 which was obtained above, was added dropwise to this solution at room temperature. After continuing the reaction for 1 hour, ethyl acetate (500 ml) was added and transferred in a separating funnel to wash with water. The solution was neutralized with diluted hydrochloric acid and then washed once again with water, followed by separating an oil phase. The solvent was distilled off under a reduced pressure and the residue was separated and refined by column chromatography. Silica gel was used as a column packing material and ethyl acetate/hexane (1/1 volume) was used as an eluting solvent. The fraction containing the desired compound (54) was collected and the solvent was distilled off under a reduced pressure, whereby a waxlike exemplified compound (54) (15.2 g)÷ was obtained.

*Synthesis Example* 2: Synthesis of exemplified Compound (2)

Compound (2) was synthesized in the same manner as that in the above Synthesis Example 1, except that compound 7 was replaced with the same moles of the following compound 10:

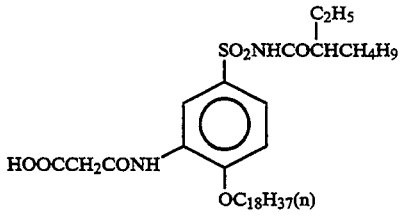

The final product was refined by column chromatography, whereby a waxlike compound (2) (8.3 g) was obtained.

Next, the yellow coupler represented by Formula (II) will be described in detail.

In Formula (II), $Y_2$ and $Z_2$ have the same meaning, respectively, as $Y_1$ and $Z_1$ of Formula (I).

Of the yellow couplers represented by Formula (II), a preferred coupler is represented by the following Formula (V):

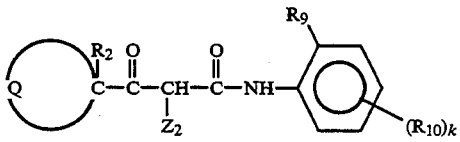

(V)

In Formula (V), $R_2$ represents a monovalent substituent excluding a hydrogen atom; Q represents a group of non-metal atoms necessary to form a 3- to 5-membered hydrocarbon ring or a 3- to 6-membered heterocyclic group containing at least one hereto atom selected from N, S, O and P in the ring together with carbon; $R_9$ represents a hydrogen atom, a halogen atom (such as, a fluorine atom, a chlorine atom, a bromine atom, and an iodine atom; hereinafter, the same definition of halogen will apply throughout the explanations in Formula (V)), an alkoxy group, an aryloxy group, an alkyl group, or an amino group; $R_{10}$ represents a substituent which is substituted on a benzene ring; $Z_2$ represents a hydrogen atom or a capable of splitting off upon a coupling reaction with an oxidation product of an aromatic primary amine developing agent (hereinafter referred to as a splitting group); k represents an integer of 0 to 4, provided that when k is plural, the plurality of $R_{10}$ groups may be the same or different; and $R_2$ may be combined with Q to form a polycyclic ring greater than a bicyclic ring.

There are given as examples of $R_{10}$, a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a ureido group, a sulfamoylamino group, an alkoxycarbonylamino group, an aryloxysulfonyl group, an acyloxy group, a nitro group, a heterocyclic group, a cyano group, an acyl group, an acyloxy group, an alkylsulfonyloxy group, and an arylsulfonyloxy group. There are given as examples of the splitting group, a heterocyclic group bonded to a coupling active site via a nitrogen atom, an aryloxy group, an arylthio group, an acyloxy group, an alkylsulfonyloxy group, an arytsulfonyloxy group, a heterocyclic oxy group, a heterocyclic thio group, and a halogen atom.

The substituents preferably used in Formula (V) will be explained below.

In Formula (V), $R_2$ is preferably a halogen atom, a cyano group, or a monovalent group having a carbon number of 1 to 30 (for example, an alkyl group, an alkoxy group, and an alkylthio group), or a monovalent group having a carbon number of 6 to 30 (for example, an aryl group, an aryloxy group, and an arylthio group), each being allowed to be substituted. There are given as the substituent therefor, for example, a halogen atom, an alkyl group, an alkoxy group, a nitro group, an amino group, a carbonamido group, a sulfonamido, and an acyl group.

In Formula (V), Q represents preferably a group of non-metal atoms necessary to form a 3- to 5-membered hydrocarbon ring having a carbon number of 3 to 30, or a 3- to 6-membered heterocyclic group having a carbon number of 2 to 30 and containing at least one hetero atom selected from N, S,O and P in the ring together with carbon, each being allowed to be substituted. The ring formed by Q together with carbon may contain an unsaturated bond in the ring. There are given as the example of the ring formed by Q together with carbon, a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thietane ring, a thiolane ring, a pyrrolidine ring, a tetrahydropyran ring, a 1,3-dioxane ring, a 1,4-dioxane ring, a tetrahydrothiopyran ring, an oxathiane ring, and a morpholine ring. There are given as examples of the substituent on these rings, a halogen atom, a hydroxyl group, an alkyl group, an aryl group, an acyl group, an alkoxy group, an aryloxy group, a cyano group, an alkoxycarbonyl group, an alkylthio group, and an arylthio group. The ring formed by Q together with carbon is preferably a 5-membered heterocyclic ring containing an oxygen atom as a hereto atom in the ring together with carbon.

Q may be combined with $R_2$ to form a polycycloalkyl group higher than a bicycloalkyl group together with the carbon to which Q is bonded. There are given as examples of such groups bicyclo(2,1,0)pentane-1-yl, bicyclo(2,2,0)hexane-1-yl, bicyclo(3,1,0)hexane-1-yl, bicyclo(3,2,0)heptane-1-yl, bicyclo(3,3,0)octane-1-yl, bicyclo(4,1,0)heptane-1-yl, bicyclo(4,2,0)octane-1-yl, bicyclo(4,3,0)nonane-1-yl, bicyclo(5,1,0)octane-1-yl, bicyclo(5,2,0)nonane-1-yl, bicyclo(1,1,1)pentane-1-carbonyl, bicyclo(2,1,1)hexane-1-carbonyl, bicyclo-(2,2,1)heptane-1-carbonyl, bicyclo(2,2,2)octane-1-carbonyl, tricyclo(3,1,1,$0^{3,6}$)heptane-6-carbonyl, tricyclo(3,3,0,$0^{3,7}$)octane-1-carbonyl, and tricyclo-(3,3,1,$0^{3,7}$)nonane-3-carbonyl. These groups may be substituted. The substituents enumerated in the above explanation of Q are examples of the substituent therefor. The substituting position is preferably a position other than a $\beta$-position to a carbonyl group.

Of the acyl groups represented by B in Formula (II), more preferred in the present invention are 1-alkylcyclopropane-1-carbonyl, bicyclo(2,1,0)-pentane-1-carbonyl, bicyclo(3,1,0)hexane-1-carbonyl, bicyclo(4,1,0-)heptane-1-carbonyl, bicyclo(2,2,0)hexane-1carbonyl, bicyclo(1,1,1)pentane-1-carbonyl, bicyclo-(2,1,1)hexane-1-carbonyl, tricyclo(3,1,1,$0^{3,6}$)heptane-6-carbonyl.

Among them, 1-alkylcyclopropane-1-carbonyl is most preferred. An alkyl group having a carbon number of 2 to 18 is preferred as the alkyl group present at the 1-position in 1-alkylcyclopropane-1-carbonyl and more preferred is an alkyl group which is not branched at an $\alpha$-position and has a carbon number of 2 to 12.

In Formula (V), $R_9$ represents preferably a halogen atom, or an alkoxy group having a carbon number of 1 to 30, an aryloxy group having-a carbon number of 6 to 30, an alkyl group having a carbon number of 1 to 30, or an amino group having a carbon number of 0 to 30, each being allowed to be substituted. There are given as the substituent therefor, for example, a halogen atom, an alkyl group, an alkoxy group, and an aryloxy group.

In Formula (V), $R_{10}$ represents preferably a halogen atom, or an alkyl group having a carbon number of 1 to 30, an aryl group having a carbon number of 6 to 30, an alkoxy group having a carbon number of 1 to 30, an alkoxycarbonyl group having a carbon number of 2 to 30, an aryloxycarbonyl group having a carbon number of 7 to 30, a carbonamido group having a carbon number of 1 to 30, a sulfonamido group having a carbon number of 1 to 30, a carbamoyl group having a carbon number of 1 to 30, a sulfamoyl group having a carbon number of 0 to 30, an alkylsulfonyl group having a carbon number of 1 to 30, an arylsulfonyl group having a carbon number of 6 to 30, a ureido group having a carbon number of 1 to 30, a sulfamoylamino group having a carbon number of 0 to 30, an alkoxycarbonylamino group having a carbon number of 2 to 30, a heterocyclic group having a carbon number of 1 to 30, an acyl group having a carbon number of 1 to 30, an alkylsulfonyloxy group having a carbon number of 1 to 30, or an arylsulfonyloxy group having a carbon number of 6 to 30, each being allowed to be substituted. There are given as the substituent therefor, for example, a halogen atom, an alkyl group, an aryl group, a heterocyclic group, an alkoxy group, an aryloxy group, a heterocyclic oxy group, an alkylthio group, an arylthio group, a heterocyclic thio group, an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, a ureido group, a cyano group, a nitro group, an acyloxy group, an alkoxycarbonyl group, an aryloxycarbonyl group, an alkylsulfonyloxy group, and an arylsulfonyloxy group.

In Formula (V), k is preferably an integer of 1 or 2 and the substituting position of $R_{10}$ is preferably a meta position or para position to an acylacetoamido group.

In Formula (V), $Z_2$ is preferably a heterococyclic group bonded to a coupling active site via a nitrogen atom, or an aryloxy group.

When $Z_2$ represents a heterocyclic group, $Z_2$ is preferably a group selected from imidazolidine-2,4-dione-3-yl, oxazolidine-2,4-dione-3-yl, 1,2,4-triazolidine-3,5-dione-4-yl, succinimido, 1-pyrazolyl, and 1-imidazolyl, each being allowed to be substituted.

When $Z_2$ represents an aryloxy group, $Z_2$ is preferably an aryloxy group substituted with at least one electron attractive group (for example, a halogen atom , a cyano group, a nitro group, a trifluoromethyl group, an acyl group, an alkylsulfonyl group, an arylsulfonyl group, an alkoxycarbonyl group, a carbamoyl group, and a sulfamoyl group).

$Z_2$ is particularly, preferably one of the above 5-membered heterocyclic groups.

The couplers represented by Formula (V) may form a polymer of a dimer or higher, in which they are combined with each other at the substituent $R_2$, $R_9$, $R_{10}$, Q, or $Z_2$ via a bond or two or more groups. In this case, the carbon numbers shown for the above respective substituents may fall out of the regulated range.

Specific examples of the yellow coupler represented by Formula (V) will be shown below.

Y-1

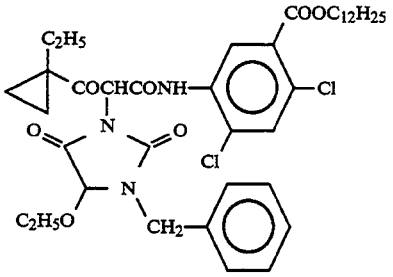

Y-2

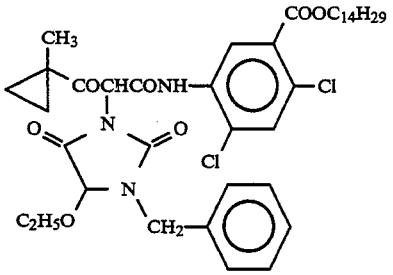

Y-3

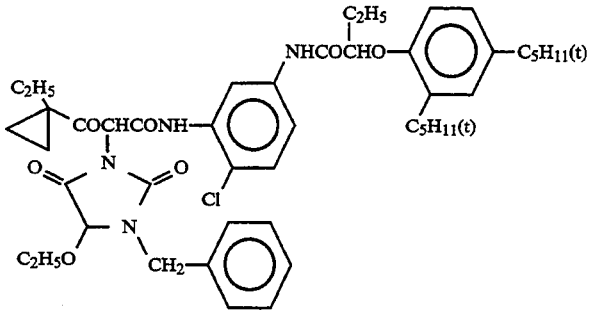

Y-4

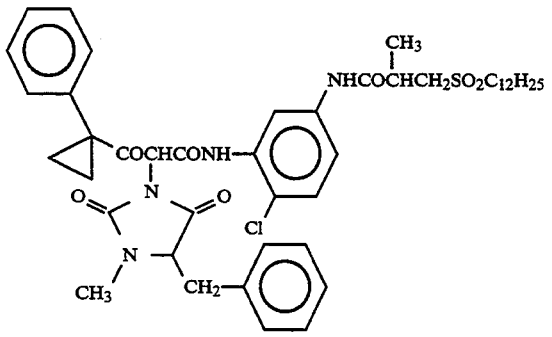

-continued
Y-5
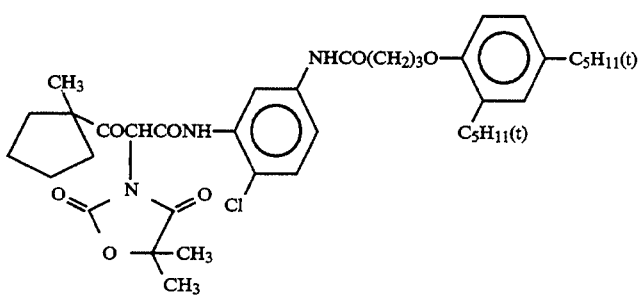
Y-6
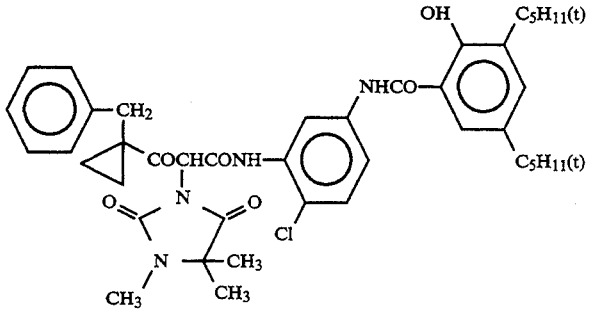
Y-7
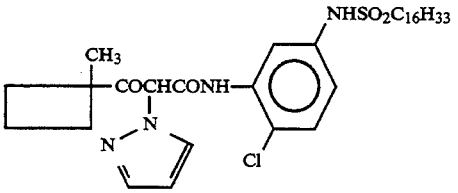
Y-8
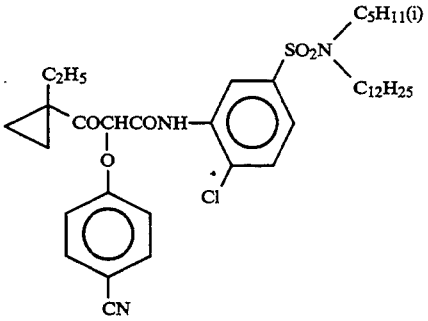
Y-9
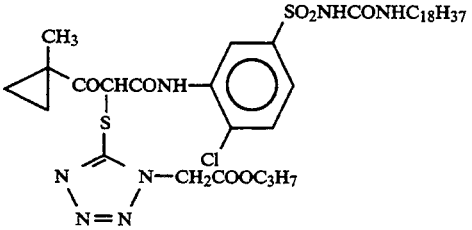

-continued
Y-10
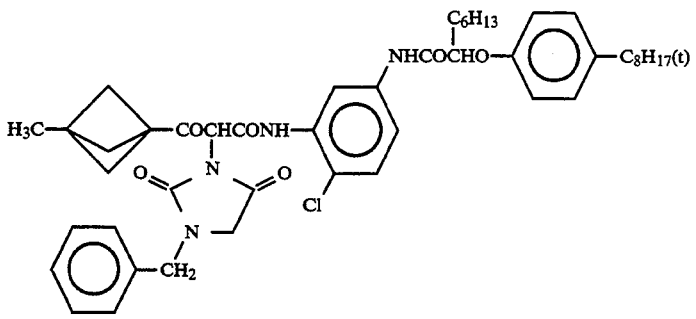
Y-11
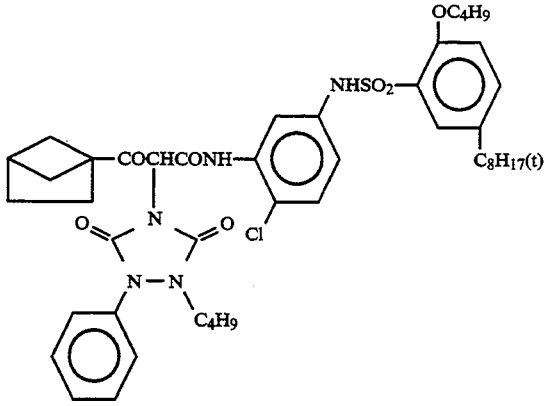
Y-12
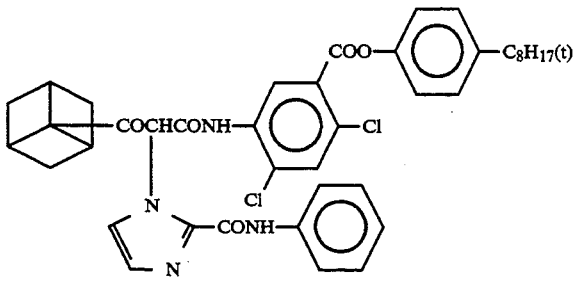
Y-13
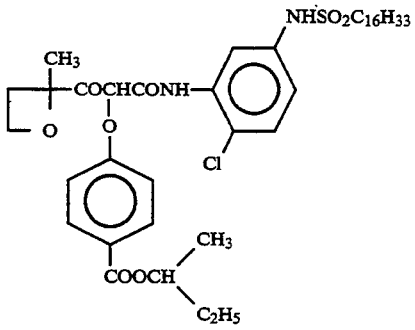
Y-14
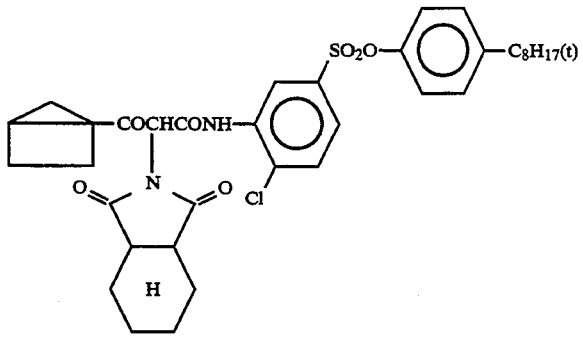

-continued
Y-15
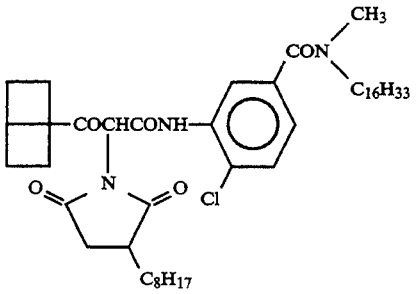
Y-16
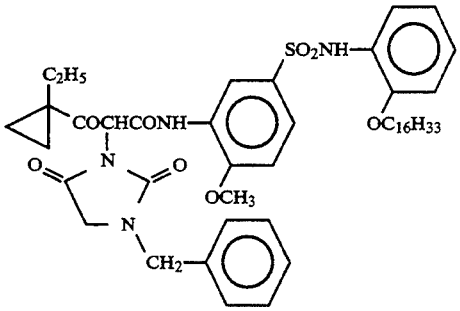
Y-17
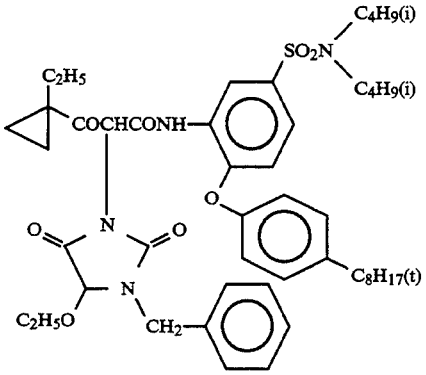
Y-18
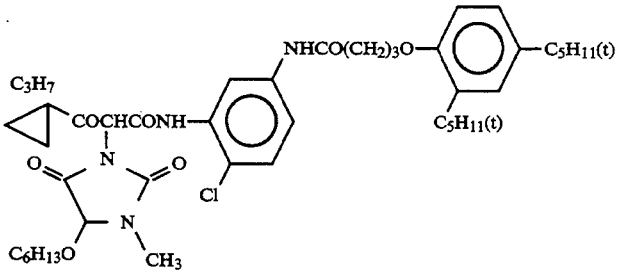
Y-19
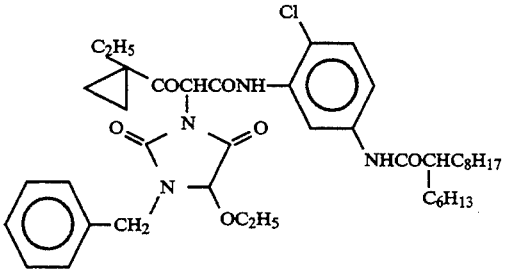

-continued
Y-20
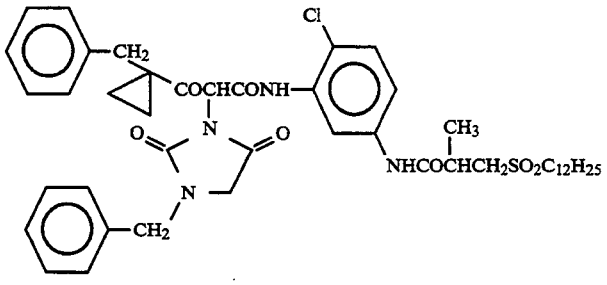
Y-21
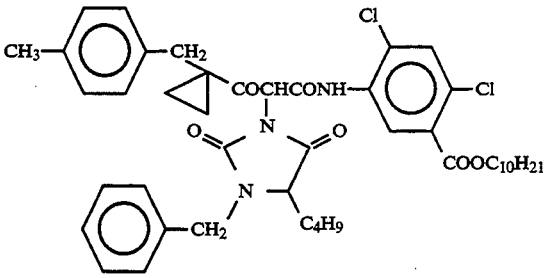
Y-22
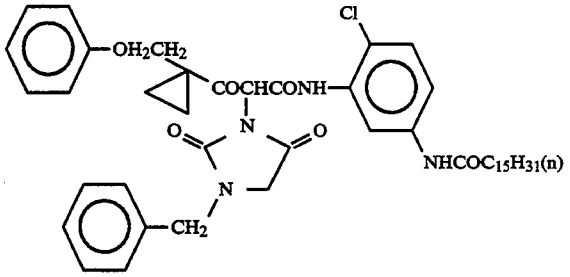
Y-23
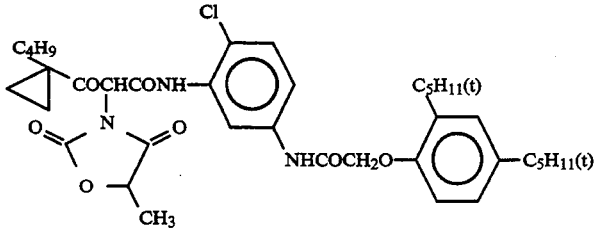
Y-24
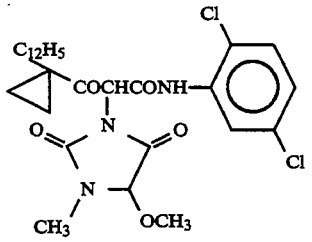
Y-25
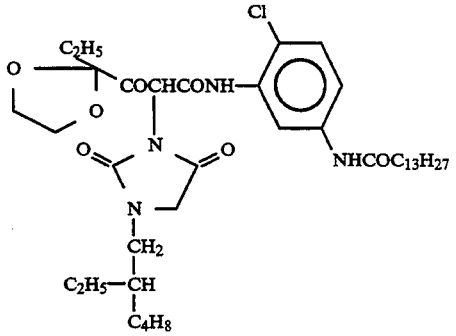

-continued

Y-26

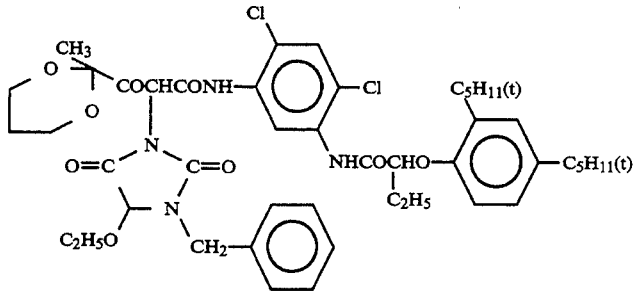

Y-27

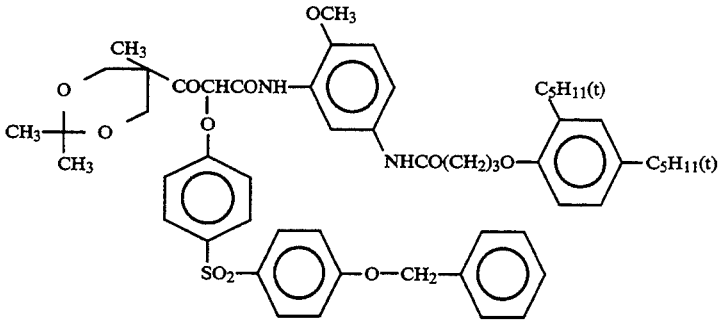

Examples of the acylacetoamido type yellow coupler of the present invention other than the above ones and synthesis method of these yellow couplers are described in Published European Patent Application (EP) 447,969A, and JP-A-3-144063 and JP-A-3-265538. A synthesis example of a yellow coupler of the present invention will be shown below. *Synthesis Example: Synthesis of the exemplified coupler Y-3*

Tetrahydrofuran (40 ml) was added to 60% sodium hydride (16 g) in a nitrogen current and stirring was applied, followed by adding diethyl carbonate (47.3 g). Further, 1-ethylcyclopropane-1-ylmethyl ketone (22.4 g) was added dropwise over a period of 2 hours while heating under refluxing, and stirring was applied for more 2 hours. After cooling the reaction solution, it was poured into dilute hydrochloric acid containing ice and extracted with ethyl acetate. The ethyl acetate solution was concentrated with an evaporator and then distilled under a reduced pressure with an aspirator. The component distilled out at 124° to 130° C. was collected to obtain 2-(1-ethylcyclopropane-1-yl) ethyl acetate (24.0 g).

A mixture of this compound (22.0 g) and N-(3-amino-4-chlorophenyl)-2-(2,4-d-t-pentylphenoxy) butaneamide (35.4 g) was stirred at 150° C. for 3 hours. During that time, ethanol prepared was distilled off. The excess of 2-(1-ethylcyclopropane-1-yl) ethyl acetate was distilled off from the reaction solution under a reduced pressure, whereby there was obtained oily N-{2-chloro-5-[2-(2,4-di-t-pentylphenoxy)butaneamide]phenyl}-2-(1-ethylcyclopropane-1-yl) acetoamide (47.0 g).

This compound (43.7 g) was dissolved in methylene chloride (200 ml) and sulfuryl chloride (10.1 g) was added dropwise for about 30 minutes while stirring under cooling with ice. Methylene chloride was distilled off from the reaction solution under a reduced pressure, and 1-benzyl-5-ethoxyhydantoin (38.7 g) and N,N-dimethylformamide (150 ml) were added to the residue to dissolve it. Then, triethylamine (15.2 g) was added dropwise for about 1 hour at room temperature while stirring. After stirring for 3 more hours, the solution was left standing for one night.

Ethyl acetate (300 ml) and water (500 ml) were added to the reaction solution for an extraction, and the extract was washed with a sodium hydroxide aqueous solution, diluted hydrochloric acid, and then a sodium bicarbonate aqueous solution. After drying the ethyl acetate solution on sodium sulfate, it was concentrated with an evaporator and crystallized from an isopropanol/n-hexane=1/10 volume) mixed solution. The deposited crystal was filtrated and dried, whereby the desered exemplified yellow coupler compound (Y-3) (52.6 g) was obtained. The structure of this compound was confirmed with a mass spectrum, a $^1$HNMR spectrum and an elemental analysis. This compound had a melting point of 129° to 131° C.

Where the yellow coupler of the present invention is applied to a silver halide color photographic light-sensitive material, at least one layer containing the coupler of the present invention may be provided on a support. The layer containing the coupler of the present invention may be any layer as long as it is a hydrophilic colloid layer provided on the support. It is preferably incorporated into a blue-sensitive silver halide emulsion layer.

The preferred amount of the yellow coupler represented by Formula (I) or (II) in a silver halide color photographic light-sensitive material falls is from about 0.01 to about 10 mmol/m$^2$, more preferably about 0.05 to about 5 mmol/m$^2$, and most preferably about 0.1 to about 2 mmol/m$^2$. The coupler represented by Formula (I) or (II) is naturally allowed to be used in combination of two or more kinds. In this case, there may be combined either couplers represented by the same formula or couplers each represented by a different formula. It is also possible to use the couplers represented by formula (I) or (II) in combination with couplers other than a coupler represented by Formula (I) or (II). In this case, the ratio of the coupler of the present invention is preferably 30 mol % or more. In any case, the preferred amount of the coupler of the present invention represented by Formula (i) or (II) is as described above. The preferred amount of silver halide emulsion present in the silver halide emulsion layer in which the coupler of the present invention is used is from about 0.5 to about 50 times, more preferably about 1 to about 20 times, and most preferably about 2 to about 10 times the amount of the coupler in terms of mole.

In the present invention, any one of the various conventionally known methods can be utilized as the method for adding the above coupler to a hydrophilic colloid layer. Usually, it can be added according to an oil-in-water dispersion method conventionally known as an oil protect method. That is, it is the method in which the coupler is dissolved in a high boiling organic solvent such as phosphoric acid ester and phthalic acid ester and a low boiling auxiliary solvent, and then is dispersed in a gelatin aqueous solution containing a surface active agent. Or water or a gelatin aqueous solution is added to a coupler solution containing a surface active agent to prepare an oil-in-water dispersion accompanied with a phase conversion. If an alkali soluble coupler is employed, the dispersion method known as the Fisher dispersion method can be used as well. In order to remove a low boiling organic solvent from the dispersion thus prepared, a method such as distillation, noodle washing, or ultrafiltration can be preferably used as well.

There can be preferably used as the dispersing medium for the coupler, a high boiling organic solvent having a dielectric constant (25° C.) of about 2 to about 20 and a refraction index of about 1.4 to about 1.7 and/or a water insoluble high molecular weight compound described in the seventh to fifteenth columns of U.S. Pat. No. 4,857,449 and at the twelfth to thirty pages of International Patent Publication WO88/00723. In the present invention, the weight ratio of the dispersing medium to the coupler is preferably about 0.1 to about 10, more preferably about 0.3 to about 3.

In the first aspect of the present invention, where a hydrophilic colloid layer containing a white pigment is provided on a support, the coated amount of the White pigment is preferably 2 $g/m^2$ or more, more preferably 4 $g/m^2$ or more, and further preferably 8 $g/m^2$ or more. The upper bound thereof is not specifically limited, but preferably is 40 $g/m^2$.

Where the white pigment contains various surface treatment agents or dispersion stabilizers for the purpose of improving the dispersing performance thereof, the weight thereof is included in the weight of the white pigment described in the present invention.

The ratio of the white pigment to a hydrophilic binder in the hydrophilic colloid layer containing the white pigment can arbitrarily be selected within a range satisfying the above condition. The amount of the white pigment is 10 weight % or more, preferably 20 weight % or more, further preferably 40 weight % or more, and most preferably 70 weight % or more, based on the weight of the hydrophilic binder. The upper bound thereof is not specifically limited, but is preferably 99 weight % or less.

The thickness of the hydrophilic colloid layer containing the white pigment can be determined by the above content and coated amount, and it preferably is from about 0.5 to about 10 μm, more preferably about 2 to about 5 μm.

There can be enumerated as the white pigment used in the first aspect of the present invention, titanium dioxide, barium sulfate, lithopon, alumina white, calcium carbonate, silica white, antimony trioxide, titanium phosphate, zinc oxide, white lead, and gypsum. Among these pigments, the use of titanium dioxide is particularly effective. Titanium dioxide may be either of a rutile type or an anatase type and may be manufactured by either a sulfate process or a chloride process.

The grain size of the white pigment used in the hydrophilic colloid layer is about 0.1 to about 1.0 μm, preferably about 0.2 to about 0.3 μm in terms of an average grain size.

In the present invention, gelatin can be preferably used as a hydrophilic colloid (a binder) constituting the hydrophilic colloid layer containing the white pigment, and can be used as a hydrophilic colloid in a silver halide emulsion layer and in a non-light-sensitive intermediate layer.

Other hydrophilic colloids can be used as well in place of gelatin in an arbitrary proportion according to necessity. There can be enumerated as examples of other hydrophilic colloids, various synthetic polymers including a gelatin derivative, a graft polymer of gelatin with other polymers, protein such as albumin and casein, a cellulose derivative (for example, hydroxyethyl cellulose, carboxymethyl cellulose and cellulose sulfate), sugars such as sodium alginate and a starch derivative, polyvinyl alcohol, a partially acetalized product of polyvinyl alcohol, poly(N-vinylpyrrolidone), polyacrylic acid, polymethacrylic acid, polyacrylamide, polyvinylimidazole, and polyvinylpyrazole.

In the present invention, various materials used for a photographic light-sensitive material can be added to the white pigment-containing hydrophilic colloid layer in addition to the white pigment and binder. They are, for example, a surface active agent as a coating aid, a hardener, a dye, and an anti-fogging agent. Further, a high boiling organic solvent dispersed as a fine oil drop can be allowed as well to be incorporated. When the dispersion of the high boiling organic solvent is added, various oil soluble materials (such as a fluorescent whitening agent), which are dissolved wherein, can be incorporated.

The light-sensitive material of the first aspect of the present invention comprises a support and provided thereon at least one light-sensitive emulsion layer which contain a yellow dye-forming coupler, at least one light-sensitive layer which contains a magenta dye-forming coupler, at least one light-sensitive layer which contains a cyan dye-forming coupler, a non-light-sensitive layer such as an anti-color mixing layer and a protective layer, and a hydrophilic colloid layer containing a white pigment.

In the present invention, the hydrophilic colloid layer containing the white pigment is provided between the support and light-sensitive emulsion layer.

There can be enumerated as the support provided thereon with the hydrophilic colloid layer containing the white pigment, paper consisting of a natural pulp and a synthetic pulp, a baryta paper, a resin-coated paper covered with polyolefin such as polyethylene or polyester, a synthetic high molecular film of polyethylene, polypropylene, polystyrene, polycarbonate, hard polyvinyl chloride, and polyethylene terephthalate, and a natural high molecular weight film of cellulose diacetate, cellulose triacetate and nitrocellulose.

In the present invention, there may be used an embodiment in which a white pigment is incorporated only into a hydrophilic colloid layer containing the white pigment and a white pigment is not incorporated into a resin constituting a support, for example, a resin coated on a paper substrate or a resin film which is a support itself, or there may be used the embodiment in which the white pigment is incorporated into the hydrophilic colloid layer containing the white pigment and the white pigment is incorporated as well into a resin constituting the above support.

A light-sensitive emulsion layer may be provided directly on the hydrophilic colloid layer containing the white pigment, or it may be provided thereon via a plurality of non-light-sensitive hydrophilic colloid layers. Where these non-light-sensitive hydrophilic colloid layers are provided, the sum of the thickness of the non-light-sensitive hydrophilic colloid layers is preferably 5 μm or less, more preferably 2 μm or less. Various photographically useful materials can be incorporated into these non-light-sensitive hydrophilic colloid layers according to necessity. They are, for example, a surface active agent as a coating aid, a hardener, a dye, and an anti-fogging agent. Further, colloidal silver, a dye dispersed in the form of a solid matter, or a dye mordanted on a cationic polymer is preferably incorporated to constitute a coloring layer that can be decolored during color development processing. Or, a high boiling organic solvent dispersed in the form of a fine oil drop can be incorporated as well. Photographically useful materials such as an oil soluble anti-color mixing agent, a fluorescent whitening agent and a UV absorber can be dissolved in this solvent and incorporated.

In an other aspect of the present invention, it is required to use a support in which the density (weight %) of the white pigment contained in a waterproof resin layer coated on the side of a support (such as a paper substrate) on which a silver halide emulsion layer is provided is higher than 14 weight %. The density of the white pigment is preferably 15 weight % or more, more preferably 17 weight % or more and most preferably 20 weight % or more. The upper limit of the filling rate is not specifically limited, but it is preferably 90 weight % or less in order to form a uniform layer.

The density described in the present invention is the ratio of the weight of the white pigment to the sum of the weights of the white pigment and hydrophilic binder contained in the hydrophilic colloid layer. Where the white pigment contains various surface treatment agents or dispersion stabilizers for the purpose of improving the dispersing performance thereof, the weight thereof is included in the weight of the white pigment described in the present invention.

There can be enumerated as the white pigment used in the second aspect of the present invention, the same white pigments as used in the first aspect, namely titanium dioxide, barium sulfate, lithopon, alumina white, calcium carbonate, silica white, antimony trioxide, titanium phosphate, zinc oxide, white lead, and gypsum. Among these pigments, the use of titanium dioxide is particularly effective. Titanium dioxide may be either of a rutile type or an anatase type and may be manufactured by either a sulfate process or a chloride process.

The pigments such as titanium dioxide are used in the first and second aspects of the present invention preferably after the surfaces of the fine grains thereof are subjected to a surface treatment with di- to tetrahydric alcohols, for example, 2,4-dihydroxy-2-methylpentane and trimethylolethane described in JP-A-58-17151, together with or independently from an inorganic oxide such as silica and aluminum oxide. In such a case, the weight of the white pigment is calculated with the value including these surface treatment materials.

The waterproof resin layer containing a white pigment fine particle such as titanium dioxide is used in a thickness of about 3 to about 200 μm, preferably about 5 to about 80 μm.

The waterproof resin layer containing the white pigment fine particle such as titanium dioxide according to the present invention may be laminated with a plurality of waterproof resin layers such as, for example, a layer having a different density of the white pigment, a layer containing a different white pigment and a layer containing no white pigment. In such a case, the waterproof resin layer containing the white pigment fine particle such as titanium dioxide according to the present invention is preferably provided on the side farther from the support.

In the present invention, the variation coefficient of the occupying area ratio (%) of the fine particles of the pigment is preferably about 0.20 or less, more preferably about 0.15 or less, and particularly preferably about 0.10 or less.

The dispersibility of a white pigment fine particle such as titanium dioxide in the waterproof resin layer can be evaluated from the occupying area ratio (%) and variation coefficient thereof, wherein the occupying area ratio is obtained by blowing off the resin to a thickness of about 0.1 μm, preferably not much more than 0.05 μm on the resin surface with an spattering method by a glow discharge and observing the fine particles of the exposed pigment with an electron microscope. The ion spattering method is described in detail in "Surface Treatment Technique Utilizing a Plasma" written by Y. Murayama and K. Kashiwagi, *Machinery Research*, vol. 33, No. 6 (1981).

In order to control the variation coefficient of the occupying area ratio of the white pigment fine particle to 0.20 or less, the white pigment is suitably kneaded sufficiently in the presence of a surface active agent and preferably is the pigment fine particle the surface of which is treated with di- to tetrahydric alcohol as described above.

The occupying area ratio (%) per a regulated unit area of the white pigment can most typically be obtained by dividing an observed area into the unit areas of 6 μm×6 μm contacting to each other and measuring the occupying area ratio (%) Ri of the pigment fine particles projected on the unit area. The variation coefficient of the occupying area ratio can be obtained in terms of the ratio s/Rm of the standard deviation s of Ri to the average value Rm of Ri. The number (n) of the subject unit areas is preferably 6 or more.

There can be used as the base substrate for the above waterproof resin-covered support in the present invention, a base paper obtained from a natural pulp, a synthetic pulp or a mixture thereof, a polyester film of polyethylene terephthalate and polybutylene terephthalate, and a plastic film of cellulose triacetate, polystyrene and polyolefin.

The above base paper used in the present invention is selected from the materials generally used for photographic printing paper. That is, there is used the base paper for which a natural pulp selected from a coniferous tree and a broad-leafed tree as a main raw material is used and to which there are added according to necessity, a filler such as clay, talc, calcium carbonate and a filler such as a urea resin, a sizing agent such as rosin, an alkylketene dimer, a higher fatty acid, paraffin wax and alkenyl succinate, a paper strengthening agent such as ployacrylamide, and a fixing agent such as alum sulfate and a cationic polymer. In particular, preferred is a base paper for which there is used a neutral paper with a pH of about 5 or more in which a reactive sizing agent such as alkylketene dimer and alkenyl succinate is used. The PH of the base paper can be judged by measuring with a pH meter in which flat GST-5313 F manufactured by Toa Denpa Industry Co., Ltd., is used as an electrode, whether or not the base paper used for a base substrate for support according to the present invention is the neutral paper. The neutral paper shows a pH value of 5 or more, preferably 5 to 9.

Further, there may be used a base paper in which a synthetic pulp is used in place of the above natural pulp, or a base paper in which a pulp obtained by mixing a natural pulp and a synthetic pulp in an arbitrary ratio is used.

This pulp surface can be subjected to a surface sizing treatment with a film-forming polymer such as gelatin, starch, carboxymethyl cellulose, polyacrylamide, and a modified product of polyvinyl alcohol. There can be enumerated as the polyvinyl alcohol-modified product in this case, a carboxyl group-modified product, a silanol-modified product, and a copolymer with acrylamide.

Where the surface sizing treatment is carried out with a film-forming polymer, the coated amount of the film-forming polymer is adjusted to about 0.1 to about 5.0 $g/m^2$, preferably about 0.5 to about 2.0 $g/m^2$. Further, in this case, an anti-electrification agent, a fluorescent whitening agent, a pigment, and a deformer can be added to the film-forming agent according to necessity.

A pulp slurry containing the above pulp, and according to necessity, a filler, a sizing agent, a paper strengthening agent, and a fixing agent is subjected to paper making with a paper machine, drying and rolling up, whereby a base paper is prepared. The above surface sizing treatment is carried out either before or after this drying and a calendering treatment is carried out after the drying until the rolling up. Where the surface sizing treatment is carried out after the drying, this calendering treatment can be carried out either before or after the surface sizing treatment.

The waterproof resin layer itself described in the present invention may constitute a support as is the case with a vinyl chloride resin.

The waterproof resin layer used in the present invention can be a resin having a water absorption coefficient (weight %) of about 0.5 or less, preferably about 0.1 or less at 25° C., for example, polyalkylene (for example, polyethylene, polypropylene and a copolymers thereof), polystyrene, polyacrylate and copolymers thereof, other vinyl polymers and copolymers thereof, and polyester and copolymers thereof. A polyalkylene resin is preferred, such as, for example, a low density polyethylene, a high density polyethylene, polypropylene, or a blended product thereof. A fluorescent whitening agent, an anti-oxidation agent, an anti-electrification agent, and a peeling agent are added to the waterproof resin layer according to necessity.

There can be used to form the resin layer an unsaturated organic compound having one or more polymerizable carbon—carbon double bonds in one molecule, for example, a methacrylic acid ester compound, as described in JP-A-57-27257, JP-A-57-49946 and JP-A-61-262738, or tri- or tetra-acrylic acid ester represented by the general formula in JP-A-61-262738. In these cases, after titanium dioxide or the other white pigment is dispersed in these unsaturated organic compounds and the dispersion is coated on a base substrate, an electron beam is irradiated thereon for curing, whereby the white pigment-containing waterproof resin layer can be formed. Other resins can be mixed as well in this resin layer.

As a method for coating the waterproof resin layer according to the present invention, there can be used the lamination methods described in "New Laminate Processing Manual" edited by Processing Technique Research Association, for example, dry lamination and non-solvent type lamination. A coating method also can be selected from the methods of a gravure roll type, a wire bar type, a doctor blade type, a reverse roll type, a dipping type, an air knife type, a calender type, a kiss type, a squeeze type, a fountain type, and a coating type.

A support is preferably subjected to a corona discharge treatment, a glow discharge treatment or a flame treatment and then is coated with the hydrophilic colloid layers of a silver halide photographic material.

The basis weight of the support is preferably about 30 to about 350 $g/m^2$, more preferably about 50 about 200 $g/m^2$.

In providing the hydrophilic colloid layer containing a white pigment on a support, which is another embodiment of the present invention, the coated amount of the white pigment is set at 2 $g/m^2$ or more.

The coloring layer capable of being decolored during a color development processing used in the present invention either may contact directly an emulsion layer or may be provided so that it contacts the emulsion layer via an intermediate layer containing gelatin and an anti-color mixing agent such as hydroquinone. This coloring layer is provided preferably below (a support side) the emulsion layer coloring to the same kind of an elementary color as that of the colored color thereof. It is possible either to independently provide all of the coloring layers corresponding to the respective elementary colors or to arbitrarily select only a part thereof to provide it. Further, it is possible as well to provide the coloring layer colored so that it corresponds to a plurality of the elementary color regions. In the optical reflection density in the coloring layer, the optical density in the wavelength in which the optical density is the highest in the visible ray region of 400 to 700 nm in terms of the wavelength of rays is about 0.2 to about 3.0, more preferably about 0.5 to about 2.5, and particularly preferably about 0.8 to about 2.0.

Conventionally known methods can be employed to form the coloring layer which can be decolored. They are, for example, the method in which a dye in the form of a fine powder is dispersed in the form of a solid, the method in which an anionic dye is mordanted to a cationic polymer, the method in which a dye is adsorbed on a fine particle of silver halide to fix in a layer, and the method in which colloidal silver is used. The method in which a dye in the form of a fine powder is dispersed in the form of a solid is described, for example, at pages 4 to 13 of JP-A-2-308244, the method in which there is incorporated a fine powder dye which is substantially insoluble in water at least at a pH of about 6 or lower and substantially soluble in water at least at a pH of about 8 or higher. Further, the method in which an anionic dye is mordanted to a cationic polymer is described at pages 18 to 26 of JP-A-2-84637. The method for preparing colloidal silver as a photoabsorbing agent is shown in U.S. Pat. No. 2,688,601 and 3,459,563. Of these methods, preferred are the method in which a fine powder dye is dispersed in the form of a solid and the method in which colloidal silver is used.

Where the fine powder dye is used, the compound represented by Formula (Sa) can be used for the dye:

$$E-(X_2)_y \quad \text{(Sa)}$$

wherein E represents a compound having a chromophore; $X_2$ represents a dissociative proton bonded to E directly or via a divalent linkage group, or a group having the dissociative proton; and y represents the integer of 1 to 7.

The compound represented by Formula (Sa) will be explained below in detail.

The compound represented by E having the chromophore can be selected from a large number of known dye compounds. There can be enumerated as such compounds, an oxonol dye, a merocyanine dye, a cyanine dye, an allylidene dye, an azomethine dye, a triphenylmethane dye, an azo dye, an anthraquinone dye, and an indoaniline dye.

The dissociative proton or group having the dissociative proton represented by $X_2$ has the characteristics that it is non-dissociative in the condition in which the compound represented by Formula (Sa) is incorporated into the silver halide photographic light-sensitive material of the present invention to make the compound of Formula (Sa) substantially insoluble in water and that it is dissociated in the process of subjecting the material to a color development processing to make the compound of Formula (Sa) substantially soluble in water. There can be enumerated as examples of these groups, a carboxylic acid group, a sulfonamido group, an arylsulfamoyl group, a sulfonylcarbamoyl group, a carbonylsulfamoyl group, and an enol group of an oxonol dye.

Of the compounds represented by formula (Sa), more preferred are the compounds represented by the following Formulas (Sb), (Sc), (Sd) and (Se):

$$A_1=L_1\left(L_2=L_3\right)_m-Q_1 \quad \text{Formula (Sb)}$$

$$A_1=L_1\left(L_2=L_3\right)_n A_2 \quad \text{Formula (Sc)}$$

$$A_1\left(L_1-L_2\right)_p B_1 \quad \text{Formula (Sd)}$$

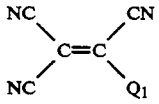
Formula (Se)

wherein $A_1$ and $A_2$ each represent an acidic nucleus; $B_1$ represents a base nucleus; $Q_1$ represents an aryl group or a heterocyclic group; $L_1$, $L_2$ and $L_3$ each represent a methine group; m represents 0, 1 or 2; n and p each represent 0, 1, 2 or 3; provided that the compounds represented by Formulas (Sa) to (Se) each have at least one group selected from the group consisting of a carboxylic acid group, a sulfonamido group, an arylsulfamoyl group, a sulfonylcarbamoyl group, a carbonylsulfamoyl group, and an enol group of an oxonol dye in one molecule, and they do not have water soluble groups (for example, a sulfonic acid group and phosphoric acid group) other than the above groups.

The acidic nucleus represented by $A_1$ or $A_2$ is preferably a cyclic ketomethylene compound or a compound having a methylene group interposed between electron attractive groups. There can be enumerated as the cyclic ketomethylene compound, 2-pyrazoline-5-one, rhodanine, hydantoin, thiohydantoin, 2,4-oxazolidinedione, isooxazolone, barbituric acid, thiobarbituric acid, indandione, dioxopyrazolo-pyridine, hydroxypridone, pyrazolidinedione, and 2,5-dihydrofuran. They each may have a substituent.

The compound having the methylene group interposed between electron attractive groups can be represented by $Z_3CH_2Z_4$, wherein $Z_3$ and $Z_4$ each represent CN, $SO_2R_{11}$, $COR_{11}$, $COOR_{12}$, $CONHR_{12}$, and $SO_2NHR_{12}$; $R_{11}$ represents an alkyl group, an aryl group, or a heterocyclic group; $R_{12}$ represents a hydrogen atom or the group represented by $R_{11}$; and they each may have a substituent.

There can be enumerated as an example of the base nucleus represented by $B_1$, pyridine, quinoline, indolenine, oxazole, imidazole, thiazole, benzoxazole, benzimidazole, benzothiazole, oxazoline, naphthoxazole, and pyrrole. They each may have a substituent.

The phenyl group and naphthyl group can be enumerated as example of the aryl group represented by $Q_1$ and each may have a substituent. Among them, there can be enumerated as an example of the heterocyclic group represented by $Q_1$, pyrrole, indole, furan, thiophene, imidazole, pyrazole, indolizine, quinoline; carbazole, phenothiadine, phenooxazine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, coumarin, and coumarone. They each may have a substituent.

The methine groups represented by $L_1$, $L_2$ and $L_3$ may have substituents, and the substituents themselves may be combined to form a 5- to 6-membered ring.

The substituents the above respective groups may have are not specifically limited unless they are the groups which allow the compounds of Formulas (Sa) to (Se) to substantially be dissolved in water of pH 5 to 7. There can be enumerated, for example, a carboxylic acid group, a sulfonamido group having a carbon number of 1 to 10 (for example, methanesulfonamido, benzenesulfonamido, butanesulfonamido, and n-octanesulfonamido), a sulfamoyl group having a carbon number of 0 to 10 (for example, unsubstituted sulfamoyl, methylsulfamoyl, phenylsulfamoyl, and butylsulfamoyl), a sulfonylcarbamoyl group having a carbon number of 2 to 10 (for example, methanesulfonylcarbamoyl, propanesulfonylcarbamoyl, and benzenesulfonylcarbamoyl), an acylsulfamoyl group having a carbon number of 1 to 10 (for example, acetylsulfamoyl, propionylsulfamoyl, pivalolysulfamoyl, and benzoylsulfamoyl), an alkyl group having a carbon number of 1 to 8 (for example, methyl, ethyl, isopropyl, butyl, hexyl, 2-hydroxyethyl, 4-carboxybutyl, 2-methoxyethyl, benzyl, phenethyl, 4-carboxybenzyl, and 2-diethylaminoethyl), an alkoxy group having a carbon number of 1 to 8 (for example, methoxy, ethoxy, and butoxy), a halogen atom (for example, a fluorine atom, a chlorihne atom, and a bromine atom), an amino group having a carbon number of 0 to 10 (for example , unsubstituted amino-, dimethylamino, diethylamino, and carboxyethylamino), an ester group having a carbon number of 2 to 10 (for example, methoxycarbonyl), an amido group having a carbon number of 1 to 10 (for example, acetylamino and banzamido), a carbamoyl group having a carbon number of 1 to 10 (for example, unsubstituted carbamoyl, methylcarbamoyl, and ethylcarbamoyl), an aryl group having a carbon number of 6 to 10 (for example, phenyl, naphthyl, 4-carboxyphenyl, 3-carboxyphenyl, 3,5-dicarboxyphenyl, 4-methanesulfonamidophenyl, and 4-butanesulfonamidophenyl), an acyl group having a carbon number of 1 to 10 (for example, acetyl, benzoyl, and propanoyl), a sulfonyl group having a carbon number of 1 to 10 (for example, methanesulfonyl and benzenesufonyl), a ureido group having a carbon number of 1 to 10 (for example, ureido and methylureido), a urethane group having a carbon number of 2 to 10 (for example, methoxycarbonylamino and ethoxycarbonylamino), a cyano group, a hydroxy group, a nitro group, and a heterocyclic group (for example, a 5-carboxybenzoxazole ring, a pyridine ring, a sulfolane ring, and a furan ring).

Compounds represented by Formulas (Sa) to (Se) which can be used in the present invention will be shown below, but the present invention is not limited thereto.

(Sa-1)

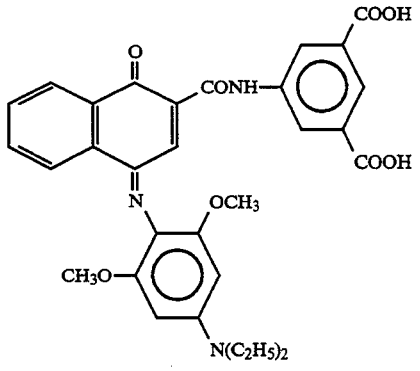

(Sa-2)

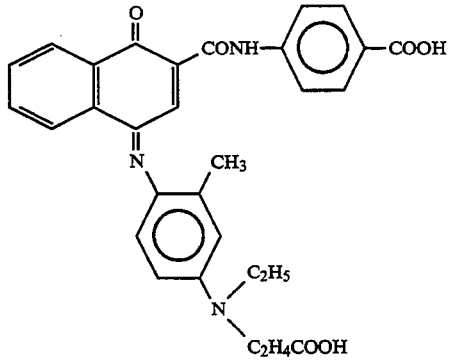

(Sa-3)

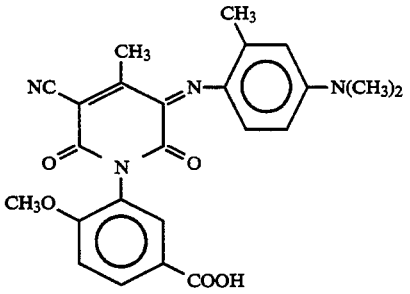

(Sa-4)

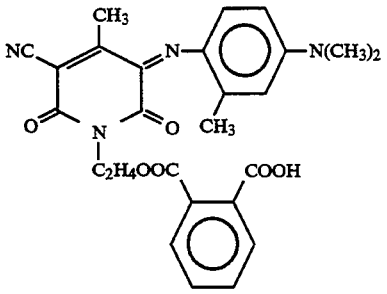

-continued
(Sb-1)
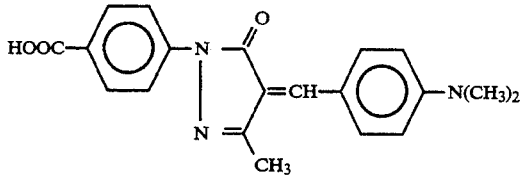
(Sb-2)
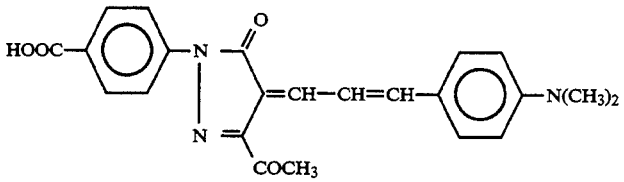
(Sb-3)
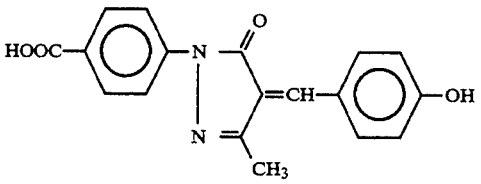
(Sb-4)
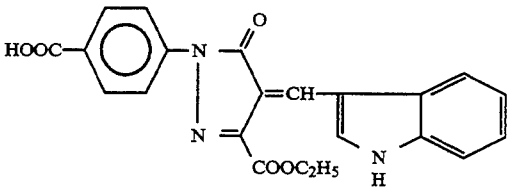
(Sb-5)
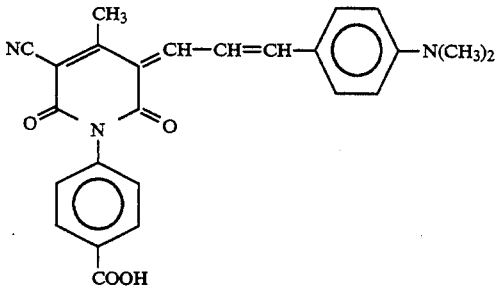
(Sb-6)
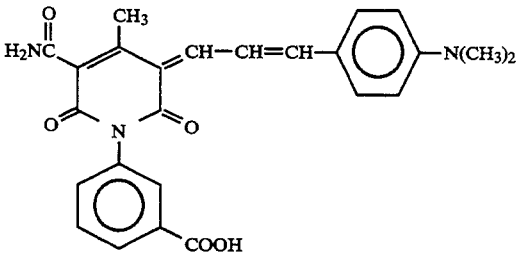
(Sb-7)
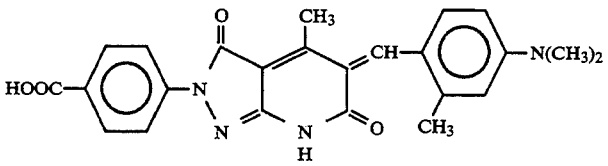

-continued
(Sb-8)
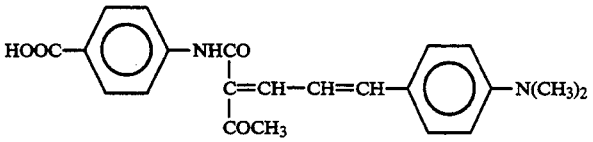
(Sb-9)
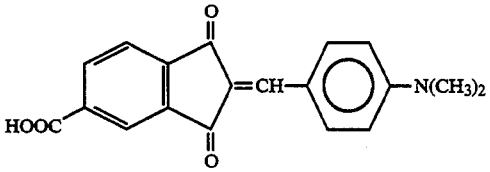
(Sb-10)
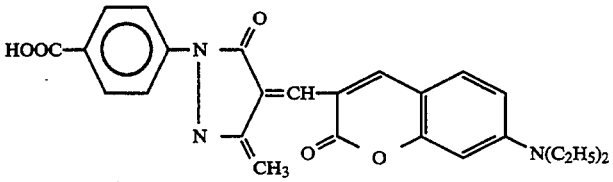
(Sb-11)
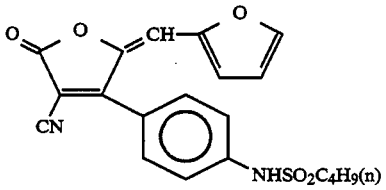
(Sb-12)
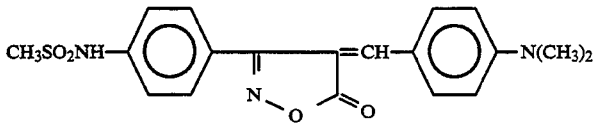
(Sb-13)
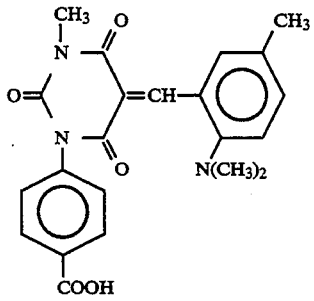
(Sb-14)
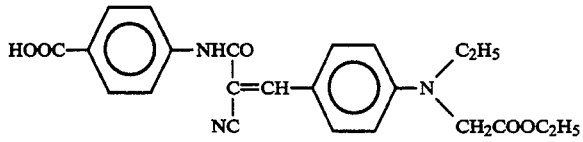
(Sc-1)
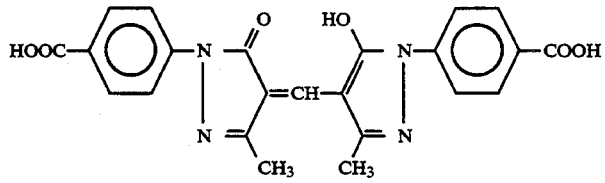

-continued
(Sc-2)
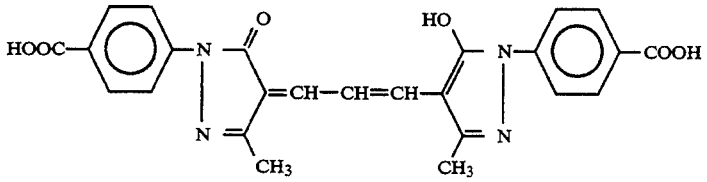
(Sc-3)
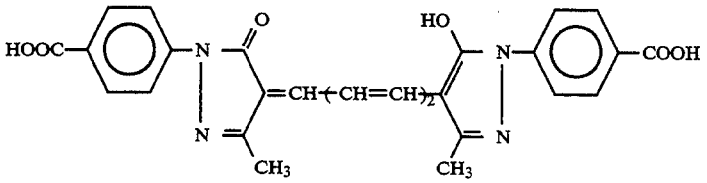
(Sc-4)
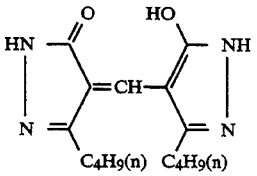
(Sc-5)
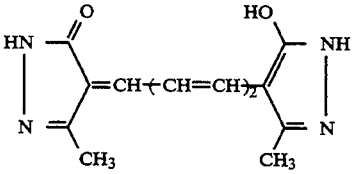
(Sc-6)
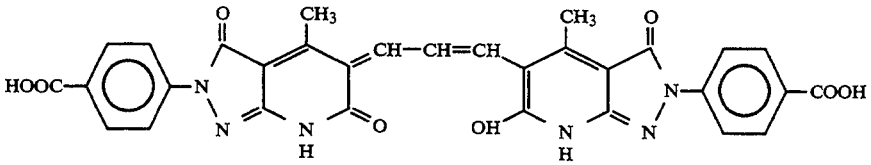
(Sc-7)
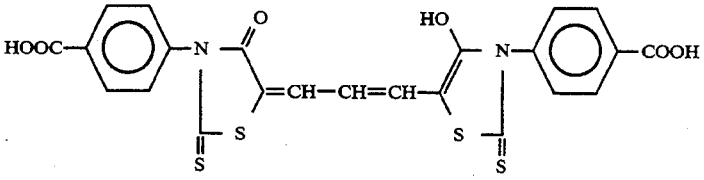
(Sc-8)
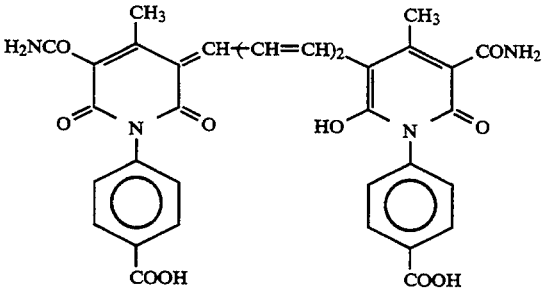
(Sc-9)
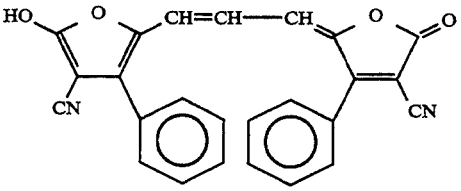

-continued
(Sc-10)
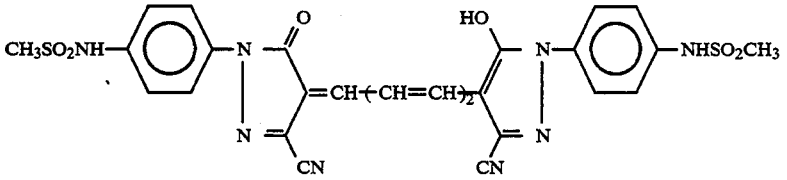
(Sc-11)
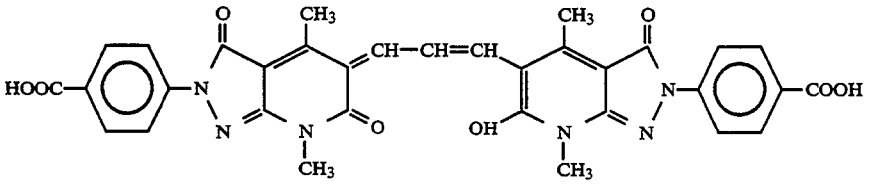
(Sd-1)
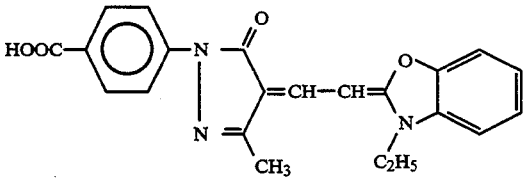
(Sd-2)
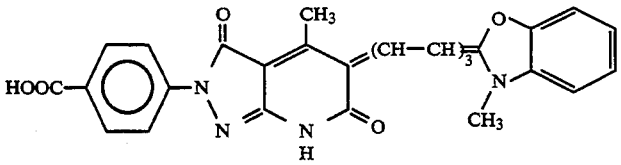
(Sd-3)
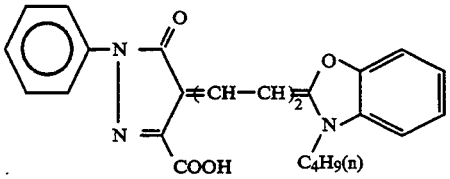
(Sd-4)
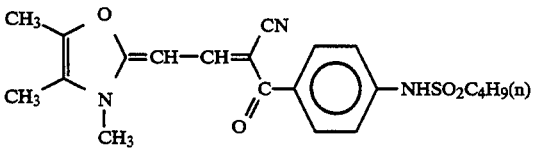
(Sd-5)
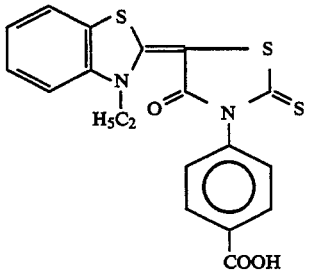

-continued (Sd-6)

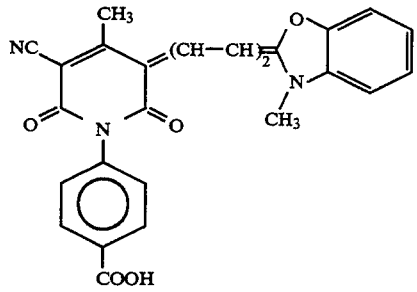

(Se-1)

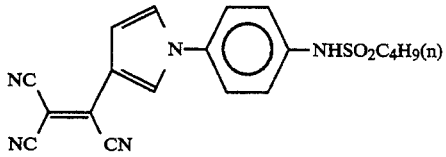

(Se-2)

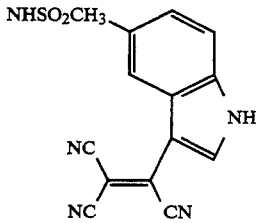

(Se-3)

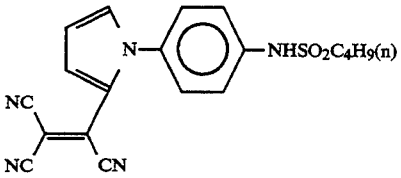

In the method in which colloidal silver is used to form a coloring layer which can be disclosed, the colloidal silver is that shich is usually used for a photographic light-sensitive material. After the preparation thereof, colloidal silver used in the present invention is preferably desalted so sufficiently that the electroconductivity thereof becomes 1800 μS/cm or less. The amount of colloidal silver in the colloidal silver-containing layer is preferably about 0.01 to about 0.5 g, particularly preferably about 0.05 to about 0.2 g per $m^2$ as silver.

At least one yellow color developing silver halide emulsion layer, at least one magenta color developing silver halide emulsion layer and at least one cyan color developing silver halide emulsion layer can be provided on a support to thereby constitute the color light-sensitive material of the present invention. In a general color photographic paper, the color coupler which forms a dye having the relationship of a complementary color with rays to which a silver halide emulsion is sensitive can be incorporated to carry out a color reproduction by a subtractive color process. In the general color photographic paper, the silver halide emulsion grains are spectrally sensitized with blue-sensitive, green-sensitive and red-sensitive spectral sensitizing dyes, respectively, in the order of the above color developing layers, and the respective emulsions can be coated on the support in the above order to constitute the color photographic paper. However, the order may be different from this. That is, a light-sensitive emulsion layer containing a silver halide grains with the largest average grain size is preferably provided uppermost in some cases from the viewpoint of rapid processing, and in some cases the lowest layer is preferably a magenta color developing light-sensitive emulsion layer from the viewpoint of storage performance under the irradiation of rays.

There may be taken the constitution in which the light-sensitive layers and the hues of developed colors do not have the above correspondence, and at least one infrared-sensitive emulsion layer can be used as well.

There are given as silver halide grains which can be used in the present invention, silver chloride, silver bromide, silver (iodo)bromochloride, and silver bromoiodide. In particular, in the present invention, silver halide comprising silver bromochloride or silver chloride containing substantially no silver iodide can be preferably used in order to expedite development processing time, wherein the term "containing substantially no silver iodide" means that the silver iodide content is 1 mol % or less, preferably 0.2 mol % or less. Meanwhile, high silver chloride grains containing silver iodide of 0.01 to 3 mol % on an emulsion surface as described in JP-A-3-84545 are preferably used in some cases for the purposes of increasing sensitivity at a high illuminance, raising spectral sensitization sensitivity and improving storage stability of a light-sensitive material. The halogen composition of the emulsion may be different or equivalent by grain. The use of an emulsion containing grains each having the same composition can readily homogenize the quality of each of the grains.

With respect to the halogen composition distribution in the inside of the silver halide emulsion grain, there can suitably be selected and used grains of a so-called homogeneous type structure in which the composition is the same at any part of the silver halide grain, the grains of a so-called laminating type structure in which a core present in the inside of the silver halide grain and the shell (one layer or plural layers) surrounding it have different halogen compositions, or grains of the structure in which there are present the portions having different halogen compositions in the inside or on the surface of the grain in the form of a non-layer (the structure in which the portions of the different compositions are conjugated at the edge, corner or surface of the grain where they are present on the surface of the grain). The use of either of the latter two rather than the grains of the homogeneous type structure is advantageous for obtaining high sensitivity and is preferred as well from the viewpoint of pressure resistance performance. Where the silver halide grains have the above structures, the boundary at the portions having the different halogen compositions may have a distinct boundary or an indistinct boundary in which a mixed crystal is formed according to the composition difference, or the structure in which a continuous structural change is allowed to positively be provided.

A so-called high silver chloride emulsion having a high silver chloride content is preferably used for a light-sensitive material suitable for rapid processing as is the case in the present invention. In the present invention, the silver chloride content in the high silver chloride emulsion is preferably 90 mole % or more, more preferably 95 mole % or more.

In such a high silver chloride emulsion, preferred is an emulsion having the structure in which a silver bromide localizing phase is present in the form of a layer or non-layer as mentioned above in the inside of a silver halide grain and/or on the surface thereof. The halogen composition in the above localizing phase is preferably at least about 10 mole %, more preferably more than about 20 mole % and up to 100 mol % in terms of silver bromide content.

The silver bromide content in the silver bromide localizing phase can be analyzed with an X-ray diffraction process (described in, for example, "New Experimental Chemistry Course 6, Structural Analysis" edited by Japan Chemistry Association, Maruzen). These localizing phases can be present in a grain inside or at the edge, corner or on the plane of a grain surface. A localizing phase epitaxially grown at the corner portion of the grain can be enumerated as one preferred example.

It is effective as well to further increase the silver chloride content in a silver halide emulsion for the purpose of reducing the replenishing amount of a development processing solution. In such a case, an emulsion of almost pure silver chloride having a silver chloride content of about 98 to 100 mol % can be preferably used.

The sliver halide grain contained in the silver halide emulsion used in the present invention has preferably an average grain size (the grain size is defined by the diameter of a circle having the same area as that of the projected area of the grain and a number average is calculated therefrom) of about 0.1 to about 2 μm.

In the size distribution of these grains, preferred is a so-called monodispersion in which a variation coefficient (obtained by dividing the standard deviation in the grain size distribution with an average grain size) is about 20% or less, preferably about 15% or less, and more preferably about 10% or less. In this case, two or more of the above monodispersed emulsions are preferably used for the same layer in a blend or simultaneously coated in different layers for the purpose of obtaining a broad latitude.

There can be used as the silver halide grains present in a photographic emulsion, grains having a regular crystal form such as cube, octahedron and tetradecahedron, grains having an irregular crystal form such as sphere and plate, or a composite form thereof. Further, the emulsion may consist of a mixture of grains having various crystal forms. In the present invention, of these emulsions, preferred is one containing grains having a regular crystal form present in an amount of about 50 by weight % or more, preferably about 70 by weight % or more, and more preferably about 90 by weight % or more.

In addition thereto, preferably used as well is an emulsion in which tabular grains having an average aspect ratio (circle area-corresponding diameter/-thickness) of 5 or more, preferably 8 or more are present in an amount which exceeds 50% of all of the grains.

The emulsion used in the present invention can be synthesized by the methods described in *Chemie et Phisique Photographique*, written by P. Glafkides (published by Paul Montel Co., Ltd., 1967), *Photographic Emulsion Chemistry*, written by G. F. Duffin (published by Focal Press Co., Ltd., 1966), and *Making and Coating Photographic Emulsion*, written by V. L. Zelikman, (published by Focal Press Co., Ltd., 1964). That is, there may be used any of an acid method, a neutral method and an ammonia method. Any of a single jet method, a double jet method and a combination thereof may be used as the method for allowing a water soluble silver salt to react with a water soluble halide. There can be used as well a method in which the grains are formed under the presence of excessive silver ions (a so-called reverse mixing method). There can be used as one form of the double jet method, a method in which the pAg of the solution in which the sliver halide grains are formed is maintained constant, a so-called controlled double jet method. There can be obtained with this method, a silver halide emulsion having a regular crystal form and an almost uniform grain size.

A different kind of a metal ion or a complex ion thereof is preferably incorporated into the localizing phase or substrate of the silver halide grains according to the present invention. The preferred metal is selected from a metal ion or metal complex belonging to the VIII group and IIb group of the Periodic Table, a lead ion, and a thallium ion. There can be used for the localized phase, mainly an ion or complex ion thereof selected from iridium, rhodium and iron, and for the (substrate), mainly a metal ion or complex ion thereof selected from osmium, iridium, rhodium, platinum, ruthenium, palladium, cobalt, nickel, and iron in combination thereof. Metal ions the kinds and concentrations of which are different in the localized phase and substrate can be used. A plurality of these metals may be used. In particular, the iron and iridium compounds are allowed to be present preferably in the silver bromide localized phase.

These metal ion-providing compounds are incorporated into the localized phase and/or other grain portions (substrate) by means of adding them to a gelatin aqueous solution which contains a dispersant, a halide aqueous solution, a silver salt aqueous solution or other aqueous solutions employed in the formation of the silver halide grains, or adding them to a silver halide fine grain in advance and dissolving this fine grain into one of the above solutions.

The metal ions used in the present invention can be incorporated into the emulsion grains before grain formation, during grain formation or immediately after the grain formation. This can be changed according to what position of the grain the metal ion is incorporated into.

The silver halide emulsion used in the present invention is usually subjected to a chemical sensitization and a spectral sensitization.

There can be used singly or in combination as the chemical sensitization, a chemical sensitization in which a chalcogen sensitizer is used (to be specific, there can be enumerated a sulfur sensitization such as achieved by the addition of an unstable sulfur compound, a selenium sensitization with a selenium compound, and a tellurium sensitization with a tellurium compound), a noble metal sensitization such as a gold sensitization, and a reduction sensitization. Those described in the right lower column at page 18 to the right upper column at page 22 of JP-A-62-215272 are preferably used as the compound for the chemical sensitization.

The emulsion used in the present invention is a so-called surface latent image type emulsion in which an latent image is formed primarily on a grain surface.

Various compounds or .precursors thereof can be added to the silver halide emulsion used in the present invention for the purposes of preventing fog or stabilizing photographic performances during production of the silver halide photographic material and during storage or photographic processing. Those described at pages 39 to 72 of above JP-A-62-215272 are preferably used as specific examples of these compounds. Further, preferably used as well is a 5-arylamino-1,2,3,4-thiatriazole compound (the aryl residue has at least one electron attractive group) described in EP 0,447,647.

Spectral sensitization is carried out for the purpose of providing the emulsions contained in the respective layers of the light-sensitive material of the present invention with spectral sensitivities in the prescribed wavelength regions.

In the light-sensitive material of the present invention, there can be enumerated as spectral sensitizing dye used for the spectral sensitizations in the blue, green and red regions, the compounds described in, for example, *Heterocyclic Compounds—Cyanine Dyes and Related Compounds*, written by F. M. Harmer (published by John Wiley & Sons, New York, London, 1964). Those described in the right upper column at page 22 to page 38 of the above JP-A-62-215272 are preferably used as the specific examples of a spectral sensitizing compound and a spectral sensitizing method. In particular, the spectral sensitizing dyes described in JP-A-3-i23340 are preferred very much as the red-sensitive spectral sensitizing dye for silver halide emulsion grains having a high silver chloride content from the viewpoint of stability, strength of adsorption and temperature dependency during exposure.

Where spectral sensitization in an infrared region is carried out in the light-sensitive material of the present invention, preferably used are the sensitizing dyes described in the left upper column at page 12 to the left lower column at page 21 of JP-A-3-15049, in the left lower column at page 4 to the left lower column at page 15 of JP-3-20730, on the 21st line at page 4 to the 54th line at page 6 of EP 0,420,011, on the 12th line at page 4 to the 33rd line at page 10 of EP 0,420,012, and in EP 0,443,466 and U.S. Pat. No. 4,975,362.

In order to incorporate these spectral sensitizing dyes into a silver halide emulsion, they may be dispersed directly in the emulsion, or may be dissolved in a single solvent or mixed solvent such as water, methanol, ethanol, propanol, methyl cellosolve, and 2,2,3,3-tetrafluoropropanol to add to the emulsion. Also, as described in JP-B-44-23389 (the term "JP-B" as used herein means an examined Japanese patent publication), JP-B-44-27555 and JP-B-57-22089, they may be dissolved in water in the presence of an acid or a base, and as described in U.S. Pat. Nos. 3,822,135 and 4,006,025, an aqueous solution or colloid dispersion which is prepared in the presence of a surface active agent may be added to the emulsion. Further, after dissolving in a solvent which is substantially immiscible with water, such as phenoxyethanol, the solution may be dispersed in water or a hydrophilic colloid to add to the emulsion. As described in JP-A-53-102733 and JP-A-58-105141 a dispersion, which is prepared by dispersing the dyes directly in a hydrophilic colloid, may be added to the emulsion.

The timing of adding the spectral sensitizing dyes to the emulsion may be at any step in preparing the emulsion, which has so far been known as effective. That is, it can be selected from any of before grain formation of the silver halide emulsion, during grain formation, from immediately after grain formation to before proceeding to a washing step, before chemical sensitization, during chemical sensitization, from immediately after chemical sensitization to the solidification of the emulsion by cooling, and in the preparation of a coating solution. Most usually, it is carried out at the period of from after the completion of the chemical sensitization to before coating. However, as described in U.S. Pat. Nos. 3,628,969 and 4,225,666, the spectral sensitizing dyes can be added at the same period as the chemical sensitization to carry out the spectral sensitization simultaneously with the chemical sensitization. Also, as described in JP-A-58-113928, spectral sensitization can be carried out prior to chemical sensitization. The spectral sensitizing dyes can be added before completing the preparation of the silver halide grains to start the spectral sensitization. Further, as taught in U.S. Pat. No. 4,225,666, a divided spectral sensitizing dye can be added as well; that is, a part thereof is added prior to chemical sensitization and the rest is added after chemical sensitization. The addition of the spectral sensitizing dyes may be at any period during the formation of the silver halide grains as well as the method taught in U.S. Pat. No. 4,183,756. Among them, particularly preferred is the addition of the spectral sensitizing dyes before a washing step for the emulsion or before chemical sensitization.

The addition amount of these spectral sensitizing dyes which can be added extends over a wide range according to the occasion. The amount preferably is from $0.5\times10^{-6}$ to $1.0\times10^{-2}$ mole, more preferably $1.0\times10^{-6}$ to $5.0\times10^{-3}$ mole per mole of silver halide.

In the present invention, where a sensitizing dye having a spectral sensitization sensitivity particularly in a red region to an infrared region is used, the compounds described in the right lower column at page 13 to the right lower column at page 22 of JP-A-2-157749 are preferably used in combination. The use of these compounds can specifically increase the storing performance, stability during processing and supersensitization effect of a light-sensitive material. Above all, the compounds of Formulas (IV), (V) and (VI) in the above patent are particularly preferably used in combination. These compounds are used in the amount of $0.5\times10^{-5}$ to $5.0\times10^{-2}$ mole, preferably $5.0\times10^{-5}$ to $5.0\times10^{-3}$ mole per mole of silver halide, and advantageously, the amount thereof is 0.1 to 10000 times, preferably 0.5 to 5000 times the moles of the spectral sensitizing dye.

Gelatin is advantageously used as the binder or protective colloid which can be used for the light-sensitive material according to the present invention, and the other hydrophilic colloids can be used as well singly or together with gelatin. Low calcium gelatin having a calcium content of 800 ppm or less, more preferably 200 ppm or less is preferably used. Further, anti-mold agents described in JP-A-63-271247 are preferably added in order to prevent various molds and fungi which grow in a hydrophilic colloid layer to deteriorate an image.

The light-sensitive material according to the present invention may be exposed with either a visible ray or an infrared ray. The manner of exposing may be either a low illuminance exposure or a high illuminance exposure. There can be given as the preferred exposing manner for high illuminance exposure, a laser scanning exposing system in which an exposing time per a pixel is shorter than $10^{-4}$ second, further preferably shorter than $10^{-6}$ second.

In exposure, a band stop filter such as described in U.S. Pat. No. 4,880,726 is preferably used, whereby a light mixture is removed to notably improve color reproduction.

An exposed light-sensitive material can be subjected to a conventional color development processing comprising generally a developing step, a densilvering step, a water-washing step and/or a stabilizing step. In case of the color light-sensitive material of the present invention, it is preferably subjected to a bleach-fixing processing after color development for the purpose of rapid processing. In particular, where the above high silver chloride emulsion is used, the pH of the bleach-fixing solution is preferably 6.5 or less, more preferably about 6 or less for the purpose of accelerating desilvering.

Those described in the following patent publications, particularly European Patent EP 0,355,660A2 (JP-A-2-139544) are preferably used as the silver halide emulsions, other materials (the additives) and photographic constitutional layers (a layer arrangement) each applied to the light-sensitive material according to the present invention, and the processing methods and additives for processing, which are applied for processing this light-sensitive material:

| Photographic elements | JP-A-62-215272 | JP-A-2-33144 | EP 0355660A2 |
|---|---|---|---|
| Silver halide emulsion | p. 10, right upper column, line 6 to p. 12, left lower column, line 5, and p. 12, right lower column, line 4 from bottom to p. 13, left upper column, line 17. | p. 28, right upper column, line 16 to p. 29, right lower column, line 11, and p. 30, lines 2 to 5. | p. 45, line 53 to p. 47, line 3, and p. 47, line 20 to 22. |
| Silver halide solvent | p. 12, left lower column, line 6 to 14, and p. 13, left upper column, line 3 from bottom to p. 18, left lower column, last line. | — | — |
| Chemical sensitizer | p. 12, left lower column, line 3 from bottom to right lower column, line 5 from bottom, and p. 18, right lower column, line 1 to p. 22, right upper column, line 9 from bottom. | p. 29, right lower column, line 12 to last line. | p. 47, lines 4 to 9. |
| Spectral sensitizer (spectral sensitizing method) | p. 22, right upper column, line 8 from bottom to p. 38, last line. | p. 30, left upper column, lines 1 to 13. | p. 47, lines 10 to 15. |
| Emulsion stabilizer | p. 39, left upper column, line 1 to p. 72, right upper column, last line. | p. 30, left upper column, line 14 to right upper column, line 1. | p. 47, lines 16 to 19. |
| Development accelerator | p. 72, left lower column, line 1 to p. 91, right upper column, line 3. | — | — |
| Color coupler (cyan, magenta and yellow couplers) | p. 91, right upper column, line 4 to p. 121, left upper column, line 6, | p. 3, right upper column, line 14 to p. 18, left upper column, last line, and p. 30, right upper column, line 6 to p. 35 right lower column, line 11. | p. 4, lines 15 to 27, p. 5, line 30 to p. 28, last line, and p. 47, line 23 to p. 63, line 50. |
| Color forming accelerator | p. 121, left upper column, line 7 to p. 125, right upper column, line 1. | — | — |
| UV absorber | p. 125, right upper column, line 2 to p. 127, left lower column, last line. | p. 37, right lower column, line 14 to p. 38, left upper column, line 11. | p. 65, lines 22 to 31. |
| Anti-fading agent (an image stabilizer) | p. 127, right lower column, line 1 to p. 137, left lower column, line 8. | p. 36, right upper column, line 12 to p. 37, left upper column, line 19. | p. 4, line 30 to p. 5, line 23, p. 29, line 1 to p. 45, line 25, p. 45, line 33 to 40, and p. 65, lines 2 to 21. |

-continued

| Photographic elements | JP-A-62-215272 | JP-A-2-33144 | EP 0355660A2 |
|---|---|---|---|
| High boiling and/or low boiling organic solvent | p. 137, left lower column, line 9 to p. 144, right upper, last line. | p. 35, right lower column, line 14 to p. 36, left upper, line 4. | p. 64, lines 1 to 51. |
| Method for dispersing photographic additives | p. 144, left lower column, line 1 to p. 146, right upper column, line 7. | p. 27, right lower column, line 10 to p. 28, left upper, last line, and p. 35, right lower column, line 12 to p. 36, right upper column, line 7. | p. 63, line 51 to p. 64, line 56. |
| Hardener | p. 146, right upper column, line 8 to p. 155, left lower column, line 4. | — | — |
| Precursor of a developing agent | p. 155, left lower column, line 5 to right lower column, line 2. | — | — |
| Development inhibitor-releasing compound | p. 155, right lower column, lines 3 to 9. | — | — |
| Support | p. 155, right lower column, line 19 to p. 156, left upper column, line 14, | p. 38, right upper column, line 18 to p. 39, left upper column, line 3. | p. 66, line 29 to p. 67 line 13. |
| Light-sensitive layer structure | p. 156, left upper column, line 15 to right lower column, line 14. | p. 28, right upper column, line 1 to 15. | p. 45, lines 41 to 52. |
| Dye | p. 156, right lower column, line 15 to p. 184, right lower column, last line. | p. 38, left upper column, line 12 to right upper column, line 7. | p. 66, lines 18 to 22. |
| Anti-color mixing agent | p. 185, left upper column, line 1 to p. 188, right lower column, line 3. | p. 36, right upper column, line 8 to 11. | p. 64, line 57 to p. 65 line 1. |
| Gradation controller | p. 188, right lower column, line 4 to 8. | — | — |
| Anti-stain agent | p. 188, right lower column, line 9 to p. 193, right lower column, line 10. | p. 37, left upper column, last line to right lower column, line 13. | p. 65, line 32 to p. 66, line 17. |
| Surface active agent | p. 201, left lower column, line 1 to p. 210, right upper column, last line | p. 18, right upper column, line 1 to p. 24, right lower column, last line, and p. 27, left lower column, line 10 from bottom to right lower column, line 9. | — |
| Fluorinated compound (anti-electrification agent, coating aid, lubricant and anti-adhesion agent) | p. 210, left lower column, line 1 to p. 222, left lower column, line 5. | p. 25, left upper column, line 1 to p. 27, right lower column, line 9. | |
| Binder (hydrophilic colloid) | p. 222, left lower column, line 6 to p. 225, left upper column, last line | p. 38, right upper column, line 8 to 18. | p. 66, lines 23 to 28. |
| Thickener | p. 225, right upper column, line 1 to p. 227, right upper column, line 2. | — | — |
| Anti-electrification agent | p. 227, right upper column, line 3 to p. 230, left upper column, line 1. | — | — |
| Polymer latex | p. 230, left upper column, line 2 to p. 239, last line | — | — |
| Matting agent | p. 240, left upper column, line 1 to right upper column, last line. | — | — |
| Photographic processing method (processing steps and additives) | p. 3, right upper column, line 7 to p. 10, right upper column, line 5. | p. 39, left upper column, line 4 to p. 42, left upper column, last line. | p. 67, line 14 to p. 69, line 28. |

Remarks:
1. There is included in the cited items of JP-A-62-215272, the subject matter amended according to the Amendment of March 16, 1987.
2. Of the above color couplers, also preferably used are the so-called short wave type yellow couplers described in JP-A-63-231451, JP-A-63-123047, JP-A-63-241547, JP-A-1-173499, JP-A-1-213648, and JP-A-1-250944.

The cyan, magenta and yellow couplers are preferably impregnated in a loadable latex polymer (for example, as described in U.S. Pat. No. 4,203,716) or dissolved together with a water insoluble and organic solvent soluble polymer in the presence or absence of an organic high boiling solvent such as described in the above tables to emulsify and disperse them in a hydrophilic colloid aqueous solution.

There can be enumerated as a water insoluble and organic solvent soluble polymer which can be preferably used, the homopolymers or copolymers described in the 7th to 15th columns of U.S. Pat. No. 4,857,449 and at pages 12 to 30 of International Patent Publication W088/00723. A methacrylate series or acrylamide series polymer, particularly an acrylamide series polymer is preferably used in terms of the stabilization of a dye image.

In the light-sensitive material according to the present invention, the color image preservability-improving compounds described in European Patent EP 0,277,589A2 are preferably used together with a coupler. In particular, they are used preferably in combination with a pyrazoloazole type coupler and a pyrrolotriazole type coupler.

That is, further preferably used simultaneously or singly for preventing side effects of, for example, the generation of stain due to the reaction of a color developing agent or the oxidation product thereof which remains in a layer during storage after processing with a coupler are compounds which chemically combine with an aromatic amine type developing agent remaining after a color development processing to form a chemically inactive and substantially colorless compound, and/or the compounds which chemically combine with the oxidation product of an aromatic amine type developing agent remaining after the color .development processing to form a chemically inactive and substantially colorless compound.

Preferably used as a cyan coupler in addition to the diphenylimidazole series cyan couplers described in JP-A-2-33144 are the 3-hydroxypyridine series cyan couplers described in European Patent EP 0,333,185A2 (of them, particularly preferred are the couplers prepared by providing the tetra-equivalent coupler (42) exemplified as a specific example with a chlorine splitting group to convert it to a divalent coupler, and the couplers (6) and (9)), and the cyclic active methylene series cyan couplers (of them, particularly preferred are the couplers 3, 8 and 34 which are exemplified as specific examples), the pyrrolopyrazole type cyan couplers described in European Patent EP 0,456,226A1, the pyrroloimidazole type cyan couplers described in European Patent EP 0,484,909, and the pyrrolotriazole type cyan couplers described in European Patents EP 0,488,248 and EP 0,491,197A1. Of them, the pyrrolotriazole type cyan couplers are particularly preferably used.

There can be used as the magenta coupler used in the present invention, the 5-pyrazolone series magenta couplers and pyrazoloazole series magenta couplers described in the publicly known literature shown in the above tables.- Of them, preferably used in terms of hue, image stability and color development are the pyrazolotriazole couplers in which a secondary or tertiary alkyl group is connected directly to the 2-, 3- or 6-position in the pyrazolotriazole ring, described in JP-A-61-65245, the pyrazoloazole couplers containing a sulfonamido group in the molecule, described in JP-A-61-65246, the pyrazoloazole couplers having an alkoxyphenylsulfonamido ballast group, described in JP-A-61-147254, and the pyrazoloazole couplers having an alkoxy group or aryloxy group at the 6-position, described in European Patents 226,849A and 294,785A.

The yellow couplers described in the publicly known literatures abstracted in the above tables are available as the coupler which can be used in combination with the yellow coupler of the present invention. Of them, the pivaloyl type yellow coupler is preferred and more preferred is the pivaloyl acetanilide type coupler having an alkoxy group, an aryloxy group, an alkyl group, or a fluorine atom at the ortho position of an anilide ring.

In addition to the methods described in the above tables, preferred as a processing method for the color light-sensitive material of the present invention are the processing materials and processing methods described on the 1st line of the right lower column at page 26 to the 9th line of the right upper column at page 34 of JP-A-2-207250, and on the 17th line of the left upper column at page 5 to the 20th line of the right lower column at page 18 of JP-A-4-97355.

The present invention will be explained below with reference to the examples, but is not limited thereto.

EXAMPLE 1

A paper support laminated on the both sides thereof with polyethylene, which was subjected to a corona discharge treatment, was provided with a gelatin subbing layer containing sodium dodecylbenzenesulfonate, and further was coated with the various photographic constitutional layers, whereby a multilayered color photographic paper (Sample 101) having the following layer constitution was prepared. The coating solutions were prepared in the following manner.

Preparation of the first layer coating solution

A yellow coupler ($ExY^{-1}$) (130.0 g), a dye image stabilizer (Cpd-1) (32.0 g), a dye image stabilizer (Cpd-2) (24.0 g), and a dye image stabilizer (Cpd-3) (8.0 g) were dissolve in a solvent (Solv-1) (40 g), a solvent (Solv-2) (20 g) and ethyl acetate (180.0 ml), and this solution was emulsified and dispersed in a 10% gelatin aqueous solution (1000 g) containing a 10% sodium dodecylbenzenesulfonate aqueous solution (60 ml) and citric acid (10 g), to thereby prepare an emulsified Dispersion A.

Meanwhile, there was prepared a silver bromochloride Emulsion A (cube, 3:7 mixture (Ag mole ratio) of a large size emulsion A with an average grain size of 0.88 μm and a small size emulsion A with an average grain size of 0.70 μm, wherein the variation coefficients in the grain size distributions were 0.08 and 0.10, respectively, and both size emulsions comprised grains in which silver bromide 0.3 mol % was localized on a part of the grain surface and the rest was silver chloride). Blue-sensitive sensitizing dyes A and B shown below were added to Emulsion A in the amounts of $2.0\times10^{-4}$ mole per mole of silver to the large size emulsion A and $2.5\times10^{-4}$ mole per mole of silver to the small size emulsion A, respectively. Then, Emulsion A was subjected to a chemical sensitization by adding a sulfur sensitizer and a gold sensitizer. The foregoing emulsified Dispersion A and the silver bromochloride Emulsion A were mixed and dissolved, whereby a first layer coating solution was prepared so that it was of the following composition.

The coating solutions for the second layer to seventh layer were prepared in a similar manner as that in the first layer coating solution. Sodium 1-oxy-3,5-dichloros-triazine was used as the hardener for the respective layers.

Further, Cpd-14 and Cpd-15 were added to the respective layers so that the entire amounts thereof became 25.0 mg/m$^2$ and 50.0 mg/m$^2$, respectively.

The following spectral sensitizing dyes were used for the silver bromochloride emulsions contained the respective light-sensitive emulsion layers:

Blue-sensitive emulsion layer

Sensitizing dye A

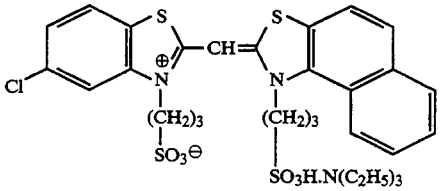

Sensitizing dye B

-continued

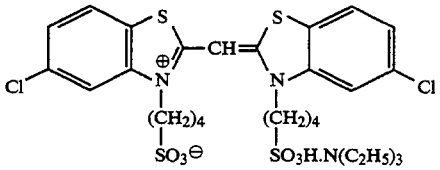

(each $2.0\times10^{-4}$ mole per mole of silver halide to the large size emulsion A and each $2.5\times10^{-4}$ mole per mole of silver halide to the small size emulsion A).

Green-sensitive emulsion layer

Sensitizing dye C

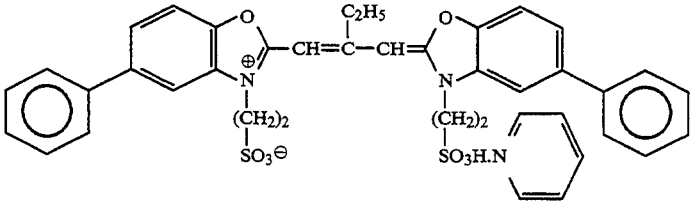

($4.0\times10^{-4}$mole per mole of silver halide to a large size emulsion B and $5.6\times10^{-4}$ mole per mole of silver halide to a small size emulsion B)

Sensitizing dye D

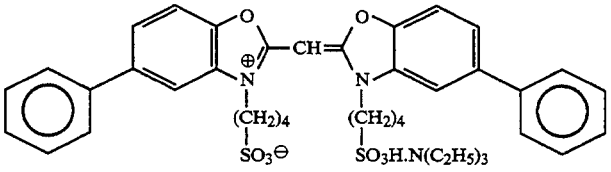

($7.0\times10^{-5}$ mole per mole of silver halide to the large size emulsion B and $1.0\times10^{-4}$ mole per mole of silver halide to the small size emulsion B).

Red-sensitive emulsion layer

Sensitizing dye E

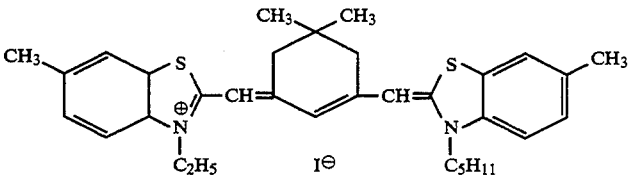

($1.0\times10^{-4}$ mole per mole of silver halide to a large size emulsion C and $1.2\times10^{-4}$ mole per mole of silver halide to a small size emulsion C)

Further, the following compound was added in the amount of $2.6\times10^{-3}$ mole per mole of silver halide:

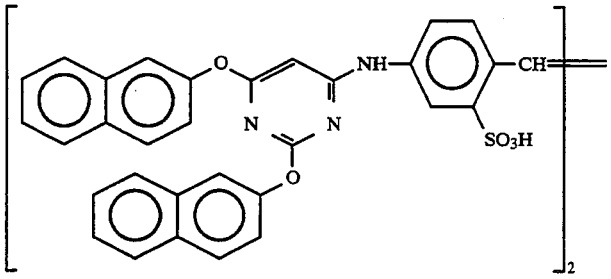

Further, 1-(5-methylureidophenyl)-5-mercaptotetrazole was added to the blue-sensitive emulsion layer, green-sensitive emulsion layer and red-sensitive emulsion layer in the amounts of $8.5\times10^{-5}$ mole, $7.7\times10^{-4}$ mole and $2.5\times10^{-4}$ mole per mole of silver halide, respectively.

Further, 4-hydroxy-6-methyl-1,3,3a,7-tetrazaindene was added to the blue-sensitive emulsion layer and green-sensitive emulsion layer in the amounts of $1\times10^{-4}$ mole and $2\times10^{-4}$ mole per mole of silver halide, respectively.

Layer constitution

The compositions of the respective layers are shown below. The numerals represent the coated amounts ($g/m^2$). The coated amounts of the silver halide emulsions are expressed in terms of the amounts converted to silver.

| | |
|---|---|
| Support: | |
| Polyethylene laminated paper [polyethylene coated on the 1st layer side contains 14 weight % of white pigment (titanium oxide) and a blue dye (ultramarine)]. | |
| First layer (a blue-sensitive emulsion layer): | |
| Above silver bromochloride Emulsion A | 0.27 |
| Gelatin | 1.46 |
| Yellow coupler (ExY-1) | 0.65 |
| Dye image stabilizer (Cpd-1) | 0.16 |
| Dye image stabilizer (Cpd-2) | 0.12 |
| Dye image stabilizer (Cpd-3) | 0.04 |
| Solvent (Solv-1) | 0.20 |
| Solvent (Solv-2) | 0.10 |
| Second layer (an anti-color mixing layer): | |
| Gelatin | 1.10 |
| Anti-color mixing agent (Cpd-4) | 0.10 |
| Solvent (Solv-7) | 0.05 |
| Solvent (Solv-2) | 0.25 |
| Solvent (Solv-3) | 0.25 |
| Third layer (a green-sensitive emulsion layer): | |
| Silver bromochloride emulsion B (cube, 1:3 mixture (Ag mole ratio) of a large size emulsion B having an average grain size of 0.55 μm and a small size emulsion B having an average grain size of 0.39 μm, wherein the variation coefficients in the grain size distributions were 0.10 and 0.08, respectively, and both size emulsions comprised grains in which silver bromide 0.8 mol % was localized on a part of the grain surface and the rest was silver chloride) | 0.13 |
| Gelatin | 1.45 |
| Magenta coupler (ExM) | 0.18 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Fourth layer (an anti-color mixing layer): | |
| Gelatin | 0.80 |
| Anti-color mixing agent (Cpd-4) | 0.08 |
| Solvent (Solv-7) | 0.03 |
| Solvent (Solv-2) | 0.20 |
| Solvent (Solv-3) | 0.20 |
| Fifth layer (a red-sensitive emulsion layer): | |
| Silver bromochloride emulsion C (cube, 1:4 mixture (Ag mole ratio) of a large size emulsion C having an average grain size | 0.20 |

-continued

| | |
|---|---|
| of 0.50 μm and a small size emulsion C having an average grain size of 0.41 μm, wherein the variation coefficients in the grain size distributions were 0.09 and 0.11, respectively, and both size emulsions comprised grains in which silver bromide 0.8 mole % was localized on a part of the grain surface and the rest was silver chloride) | |
| Gelatin | 0.85 |
| Cyan coupler (ExC) | 0.31 |
| UV absorver (UV-2) | 0.18 |
| Dye image stabilizer (Cpd-9) | 0.01 |
| Additive (Cpd-10) | 0.01 |
| Additive (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| Dye image stabilizer (Cpd-1) | 0.31 |
| Sixth layer (a UV absorbing layer): | |
| Gelatin | 0.55 |
| UV absorber (UV-1) | 0.38 |
| Dye image stabilizer (Cpd-12) | 0.15 |
| Dye image stabilizer (Cpd-5) | 0.02 |
| Seventh layer (a protective layer): | |
| Gelatin | 1.13 |
| Acryl-modified copolymer of polyvinyl alcohol (a modification degree: 17%) | 0.05 |
| Liquid paraffin | 0.02 |
| Dye image stabilizer (Cpd-13) | 0.01 |

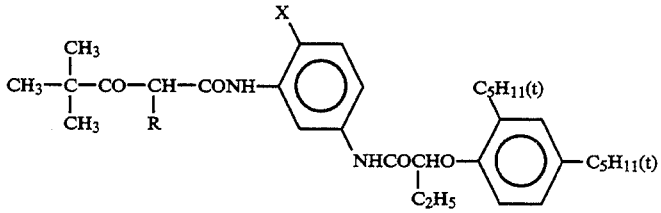

(ExY-1) Yellow coupler

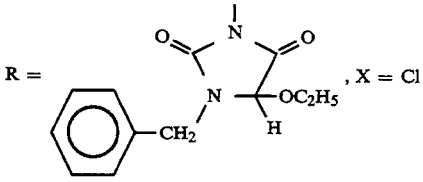

(ExY-2) Yellow coupler

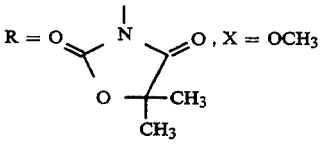

(ExM) Magenta coupler

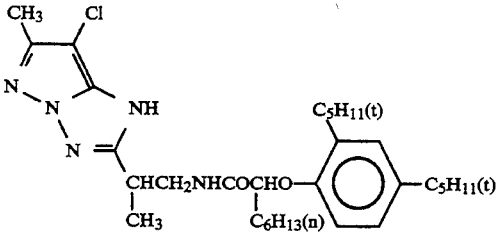

(ExC) Cyan coupler
3:7 mixture (mole ratio) of

-continued
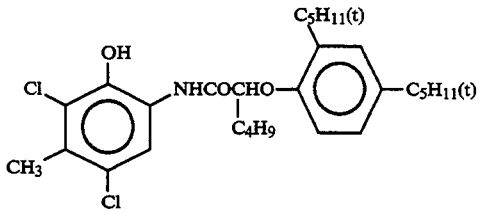
and
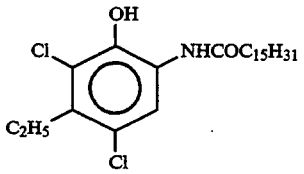
(Cpd-1) Dye image stabilizer
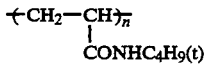
(Average molecular weight: 60,000)
(Cpd-2) Dye image stabilizer
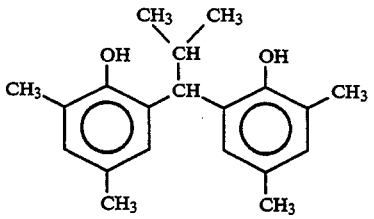
(Cpd-3) Dye image stabilizer
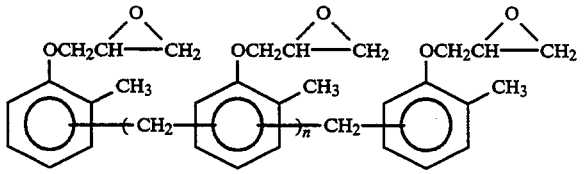
n = 7 to 8 (average value)
(Cpd-4) Anti-color mixing agent
1:1 mixture (weight ratio) of
(1)
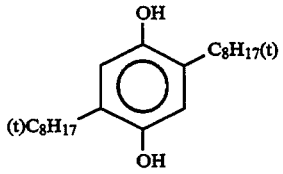
(2)
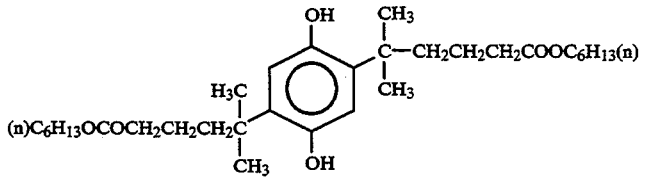
(Cpd-5) Dye image stabilizer -continued
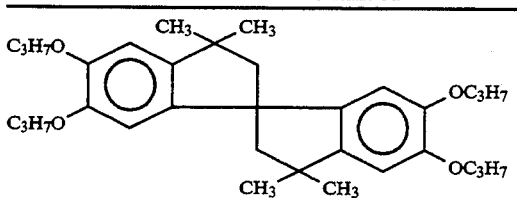
(Cpd-6) Dye image stabilizer
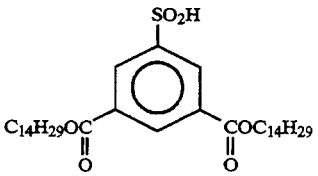
(Cpd-7) Dye image stabilizer
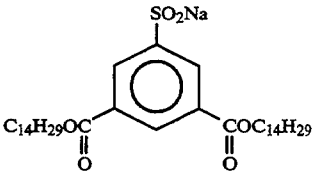
(Cpd-8) Dye image stabilizer
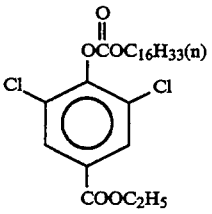
(Cpd-9) Dye image stabilizer
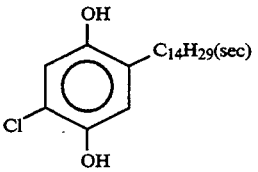
(Cpd-10) Additive
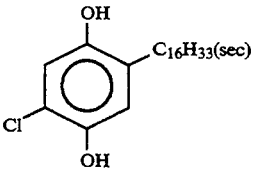
(Cpd-11) Additive
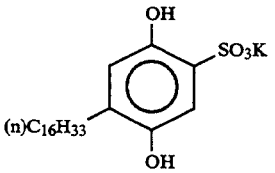
(Cpd-12) Dye image stabilizer -continued
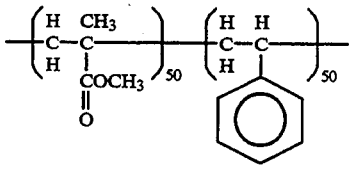
Average molecular weight: about 60,000
(Cpd-13) Dye image stabilizer
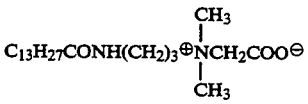
(Cpd-14) Preservative
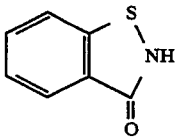
(Cpd-15) Preservative
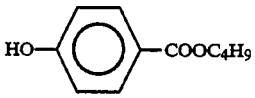
UV absorber (UV-1)
1:5:10:5 mixture (weight ratio) of (1), (2), (3) and (4)
(1)
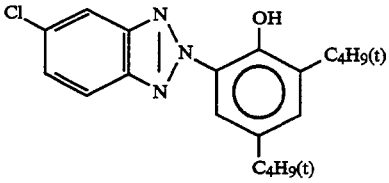
(2)
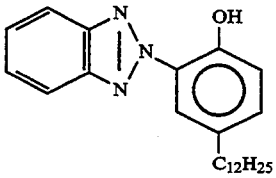
(3)
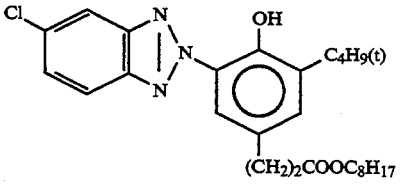
(4)

-continued
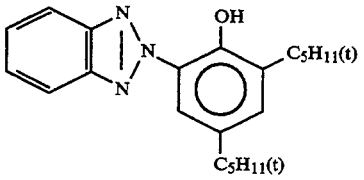
(UV-2) UV absorber
1:2:2 mixture (weight ratio) of (1), (2) and (3)
(1)
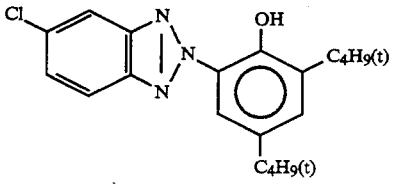
(2)
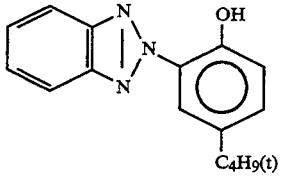
(3)
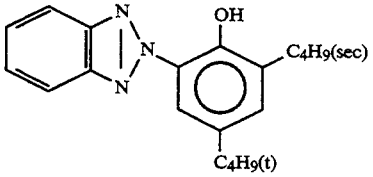
Solvent (Solv-1)
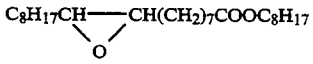
Solvent (Solv-2)
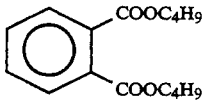
Solvent (Solv-3)
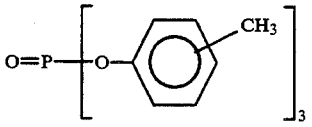
Solvent (Solv-4)
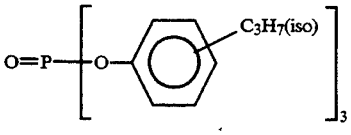
Solvent (Solv-5)

-continued $O{=}P{\leftarrow}OCH_2\overset{C_2H_5}{\overset{|}{C}}HC_4H_9(n))_3$ Solvent (Solv-6)

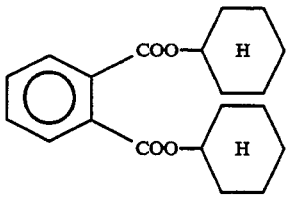

Solvent (Solv-7)

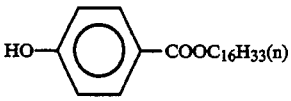

Samples 102 to 104 were prepared in the same manner as that in Sample 101 thus prepared, except that the yellow coupler contained in the first layer (the blue-sensitive layer) was replaced with the couplers shown in Table A-1 in the same mole, and further that the coated amounts were changed to 100 weight % to the comparative coupler, 70 weight % to the coupler of Formula (I) and 80 weight % to the coupler of Formula (II), respectively, without varying the composition ratios of the coating solutions so that the developed color densities became almost the same.

Next, Samples 105 to 131 were prepared in the same manner as that in Sample 101, except that the three layers shown below were provided on the support (polyethylene laminated paper) as a subbing layer (in the order of the first subbing layer, second subbing layer and third subbing layer from the support side) and that the coupler contained in the first layer (the blue-sensitive layer) was replaced similarly to the above with the couplers shown in Tables A-1 and A-2.

First subbing layer (a white pigment layer):

A futile type titanium white pigment (400 g) having an average grain size of 0,23 μm (Titan White R780 manufactured by Ishiwara Sangyo Co., Ltd,) and water (4 liters) were added to a 10% gelatin aqueous solution (1.0 kg) and a 5% sodium dodecylbenzenesulfonate aqueous solution (8 ml) was added thereto as a dispersant, followed by dispersing by irradiating a supersonic wave to thereby prepare a coating solution. This coating solution was applied so that the coated amounts became as shown in Tables A-1 and A-2.

Second subbing layer (a coloring layer):

Sodium carbonate anhydrous (2 g) was added to a 10% gelatin aqueous solution (1 kg) and a 10% silver nitrate aqueous solution (500 ml) was added thereto while maintaining the temperature at 45° C. Then, an aqueous solution (1000 ml) containing sodium sulfite anhydrous (35 g) and hydroquinone (25 g) was added over a period of 10 minutes. After leaving for standing for 10 minutes, 1N sulfuric acid (about 100 ml) was added to adjust pH to 5.0. The colloidal silver sol thus obtained was poured into a cooling dish to sufficiently gelatinize it and then was cut to a noodle shape, followed by washing with cold water for 6 hours. This was heated and dissolved, whereby a colloidal silver coating solution was prepared.

Meanwhile, a dye was dispersed with a BO type vibrating ball mill manufactured by Chuo Kakoki Co., Ltd. Water (21.7 ml), a 5% sodium p-octytphenoxyethoxyethanesulfonate aqueous solution, and a 5% p-octylphenoxypolyoxyethylene ether (polymerization degree: 10) aqueous solution (0.5 g) were put in a 700 ml pot mill, and the dye (Sc-3 shown above) (0.5 g) and beads (diameter: 1 mm) of zirconium oxide (volume: 500 ml) were added thereto, followed by dispersing the content over a period of 2 hours. The content was taken out and added to a 12.5% gelatin aqueous solution (8 g). Then, the beads were filtered to obtain a gelatin dispersion of the dye, whereby the dye coating solution was prepared.

These coloring layer coating solutions were applied so that the coated amounts became as shown in Tables A-1 and A-2.

Third subbing layer:

Water (2 liters) was added to a 10% gelatin aqueous solution (1.0 kg) and a 5% sodium dodecylbenzenesulfonate aqueous solution (8 ml) was added thereto as a dispersant, whereby the third subbing coating solution was prepared.

This coating solution was applied so that the coated amount became 0.7 g/m$^2$.

When the colloidal silver sol was used for the second subbing layer, Cpd-4, Solv-2 and Solv-3 were added to the second subbing layer and third subbing layer in the amounts of 0.02, 0.05 and 0.05 g/m$^2$, respectively.

First, Samples 101 to 104 were subjected to an exposure with a sensitometer (an FWH type, the color temperature of a light source: 3200° K., manufactured by Fuji Photo Film Co., Ltd.) so that about 30% of the coated silver amount was developed and gray was given.

The above samples were subjected to a 250 m$^2$ continuous processing with a paper processing machine at the following processing steps in the processing solutions of the following compositions.

| Processing step | Temperature | Time | Replenishing amount* | Tank capacity |
|---|---|---|---|---|
| Color developing | 35° C. | 45 seconds | 161 ml | 10 l |
| Bleach/fixing | 35° C. | 45 seconds | 218 ml | 10 l |
| Rinsing (1) | 35° C. | 30 seconds | — | 5 l |
| Rinsing (2) | 35° C. | 30 seconds | — | 5 l |
| Rinsing (3) | 35° C. | 30 seconds | 360 ml | 5 l |
| Drying | 80° C. | 60 seconds | | |

*Replenishing amount per $m^2$ of the light-sensitive material. (Rinsing was of a countercurrent system from Rinsing (3) to Rinsing (1))

The compositions of the respective processing solutions are as follows:

| | Tank Solution | Replenishing solution |
|---|---|---|
| Color developing solution | | |
| Water | 800 ml | 800 ml |
| Ethylenediaminetetraacetic acid | 3.0 g | 3.0 g |
| Disodium 4,5-dihydroxybenzene-1,3-disulfonate | 0.5 g | 0.5 g |
| Triethanolamine | 12.0 g | 12.0 g |
| Potassium chloride | 2.5 g | — |
| Potassium bromide | 0.01 g | — |
| Potassium carbonate | 27.0 g | 27.0 g |
| Fluorescent whitening agent (Whitex 4 manufactured by Sumitomo Chem. Ind. Co., Ltd.)) | 1.0 g | 2.5 g |
| Sodium sulfite | 0.1 g | 0.2 g |
| Disodium N,N-bis(sulfonatethyl)hydroxylamine | 5.0 g | 8.0 g |
| N-ethyl-N-(β-methanesulfonamidoethyl)-3-methyl-4-aminoaniline 3/2 sulfate monohydrate | 5.0 g | 7.1 g |
| Water was added to | 1000 ml | 1000 ml |
| pH (25° C.) (adjusted with potassium hydroxide and sulfuric acid) | 10.05 | 10.45 |

Bleach/fixing solution (Same for the tank solution and replenishing solution)

| | |
|---|---|
| Water | 600 ml |
| Ammonium thiosulfate (700 g/liter) | 100 ml |
| Ammonium sulfite | 40 g |
| Iron (III) ammonium ethylenediamine tetracetate | 55 g |
| Iron ethylenediaminetetraacetate | 5 g |
| Ammonium bromide | 40 g |
| Nitric acid (67%) | 30 g |
| Water was added to | 1000 ml |

-continued

| | Tank Solution | Replenishing solution |
|---|---|---|
| pH (25° C.) (adjusted with acetic acid and aqueous ammonia) | 5.8 | |

Rinsing solution (Same for the tank solution and replenishing solution)

| | |
|---|---|
| Sodium chloroisocyanurate | 0.02 g |
| Deionized water (dielectric constant: 5 μS/cm or less) | 1000 ml |
| pH | 6.5 |

Next, the respective samples were exposed to a light passed through a blue filter via a wedge and four sheets for each sample were processed in the above running solutions. The samples thus processed were first subjected to the measurement of a yellow density via a blue filter and then the above four sheets each were stored at the four conditions A, B, C and D shown below to subject them to a fading test.

Condition A: 2 months at 70° C. and 65% RH.

Condition B: 4 weeks under an intermittent xenon light of 80,000 lux (bright for 5 hours and dark for 1 hour).

Condition C: 1 week at 60° C. and 70% RH.

Condition D: after stored at 60° C. and 70% RH for 1 week, 4 weeks at the same condition as the condition B.

The samples after the fading were subjected once again to the measurement of the yellow density to obtain a dye image remaining rate. The results are shown in Tables A-1 and A-2.

Next, the respective samples were exposed to a green light via an optical wedge for measuring a CFT and then processed in order to measure the sharpness thereof.

CTF described herein represents the attenuation behavior of the contrast of an image obtained in carrying out the exposure of a square wave form while varying a spatial frequency. There were used herein the images obtained by giving the contrast of 0.2 in the exposure of the square wave form at the spatial frequency, of 2.5 cycle/mm with a visually sharpest green light to compare the relative values of the contrasts of the respective samples. The CTF values thus obtained are shown in Tables A-1 and A-2 The larger the CTF value is, the less the contrast is deteriorated and the higher the sharpness is.

TABLE A-1

| Sample | Yellow coupler | White pigment layer ($g/m^2$) | Coloring layer ($g/m^2$) | CTF value | Dye image residual rate (%) Condition A | B | C | D |
|---|---|---|---|---|---|---|---|---|
| 101 (Comp.) | ExY-1 | —* | — | 14.8 | 70 | 80 | 99 | 71 |
| 102 (Comp.) | ExY-2 | — | — | 14.9 | 65 | 72 | 98 | 64 |
| 103 (Comp.) | 2 | — | — | 15.3 | 93 | 72 | 100 | 67 |
| 104 (Comp.) | Y-3 | — | — | 15.1 | 88 | 74 | 100 | 69 |
| 105 (Comp.) | ExY-1 | 2.5 | — | 18.3 | 63 | 79 | 99 | 45 |
| 106 (Comp) | ExY-1 | 5.0 | — | 22.7 | 58 | 79 | 98 | 33 |
| 107 (Comp.) | ExY-1 | 2.5 | Colloidal silver 0.8 | 23.0 | 59 | 75 | 98 | 40 |
| 108 (Comp.) | ExY-1 | 2.5 | Dye 0.03 | 23.2 | 59 | 74 | 98 | 31 |
| 109 (Comp.) | ExY-2 | 2.5 | — | 18.5 | 56 | 67 | 100 | 22 |
| 110 (Comp.) | ExY-2 | 5.0 | — | 22.8 | 51 | 65 | 100 | 15 |
| 111 (Comp.) | ExY-2 | 2.5 | Colloidal silver 0.8 | 19.1 | 52 | 64 | 100 | 43 |
| 112 (Comp.) | ExY-2 | 2.5 | Dye 0.03 | 23.2 | 53 | 61 | 100 | 13 |

*No white pigmet layer was provided.

TABLE A-2

| Sample | Yellow coupler | White pigment layer ($g/m^2$) | Coloring layer ($g/m^2$) | CTF value | Dye image residual rate (%) Condition A | B | C | D |
|---|---|---|---|---|---|---|---|---|
| 113 (Inv.) | 2 | 1.5 | — | 16.9 | 93 | 78 | 100 | 78 |
| 114 (Inv.) | 2 | 2.5 | — | 19.3 | 91 | 80 | 100 | 80 |
| 115 (Inv.) | 2 | 5.0 | — | 23.6 | 90 | 81 | 100 | 80 |
| 116 (Inv.) | 2 | 2.5 | Colloidal silver 0.8 | 25.2 | 90 | 78 | 100 | 76 |
| 117 (Inv.) | 2 | 2.5 | Dye 0.03 | 25.7 | 91 | 79 | 100 | 77 |
| 118 (Inv.) | 3 | 2.5 | — | 19.1 | 87 | 81 | 100 | 73 |
| 119 (Inv.) | 3 | 5.0 | — | 23.3 | 85 | 82 | 100 | 75 |
| 120 (Inv.) | 3 | 2.5 | Colloidal silver 0.8 | 24.7 | 85 | 79 | 100 | 74 |
| 121 (Inv.) | 3 | 2.5 | Dye 0.03 | 25.0 | 86 | 78 | 100 | 75 |
| 122 (Inv.) | 3 | 2.5 | — | 19.1 | 90 | 75 | 100 | 74 |
| 123 (Inv.) | 8 | 2.5 | — | 19.0 | 91 | 73 | 100 | 72 |
| 124 (Inv.) | 18 | 2.5 | — | 19.1 | 90 | 70 | 99 | 70 |
| 125 (Inv.) | Y-17 | 2.5 | — | 18.8 | 85 | 79 | 99 | 72 |
| 126 (Inv.) | 3 | 2.5 | Dye 0.03 | 25.5 | 90 | 75 | 100 | 75 |
| 127 (Inv.) | 11 | 2.5 | Dye 0.05 | 27.3 | 91 | 74 | 100 | 73 |
| 128 (Inv.) | 11 | 5.0 | Dye 0.03 | 27.6 | 90 | 74 | 100 | 72 |
| 129 (Inv.) | Y-17 | 2.5 | Dye 0.03 | 24.8 | 84 | 77 | 99 | 70 |
| 130 (Inv.) | Y-20 | 2.5 | — | 19.2 | 92 | 72 | 100 | 70 |
| 131 (Inv.) | Y-20 | 2.5 | Dye 0.03 | 25.9 | 92 | 71 | 100 | 70 |

The colors of the respective samples after the processing were visually observed. It was confirmed that contrary to the samples in which the comparative coupler ExY-1 was used, the samples in which ExY-2 and the yellow couplers of the present invention were used had less red color component and an excellent hue.

Next, a comparison of Samples 101 to 104 in the results of the fading test shows that while the yellow couplers of the present invention are more excellent than the comparative couplers ExY-1 and ExY-2 in Condition A, they are a little inferior to the comparative coupler ExY-1 in Conditions B and D.

Where the white pigment layer is provided, it is observed that the sharpness is improved in any samples. In this case, the fading in Condition D is notably accelerated as can be seen in Samples 105 to 112. On the contrary, in the yellow couplers of the present invention, the fading in Condition B is improved only a little bit, as can be seen in Samples 113 to 131 and the fading in Condition D is scarcely caused. Accordingly, high sharpness and excellent dye image fastness can be achieved at the same time where the coupler of the present invention is used in combination with the white pigment.

Further, also where colloidal silver and a solid dispersion dye are used, similar results are obtained in the fading test. Accordingly, it can be found that the combination of these means enables the obtaining of higher sharpness.

EXAMPLE 2

Samples 201 and 204 to 207 were prepared in the same manner as that in Sample 101 of Example 1, except that the density (weight %) of the titan white pigment contained in the polyethylene laminated on the emulsion layer side of the support was changed as shown in Table B to change the support. Next, Samples 202, 203 and 209 to 223 were prepared in the same manner as Samples 201 and 204 to 208, except that the couplers were replaced with the couplers of the present invention.

These samples were evaluated as well in the same manner as that in Example 1. The results are shown in Table B.

TABLE B

| Sample | Yellow Coupler | White pigment density (wt %) | CTF value | Dye image residual rate (%) A | B | C | D | Remarks |
|---|---|---|---|---|---|---|---|---|
| 201 | ExY-1 | 12 | 13.7 | 72 | 80 | 99 | 73 | Comp. |
| 202 | Y-3 | 12 | 14.0 | 90 | 74 | 100 | 66 | Comp. |
| 203 | 2 | 12 | 13.8 | 95 | 73 | 100 | 68 | Comp. |
| 204 | ExY-1 | 15 | 15.1 | 71 | 79 | 99 | 67 | Comp. |
| 205 | ExY-1 | 17 | 16.4 | 70 | 78 | 99 | 64 | Comp. |
| 206 | ExY-1 | 20 | 17.0 | 70 | 77 | 98 | 61 | Comp. |
| 207 | ExY-1 | 30 | 18.3 | 68 | 75 | 98 | 54 | Comp. |
| 208 | ExY-1 | 55 | 20.7 | 65 | 73 | 98 | 46 | Comp. |
| 209 | Y-3 | 15 | 15.8 | 90 | 75 | 100 | 70 | Inv. |
| 210 | Y-3 | 17 | 16.7 | 89 | 76 | 100 | 74 | Inv. |
| 211 | Y-3 | 20 | 17.2 | 89 | 77 | 100 | 73 | Inv. |
| 212 | Y-3 | 30 | 18.4 | 88 | 78 | 100 | 75 | Inv. |
| 213 | Y-3 | 55 | 20.9 | 88 | 78 | 99 | 76 | Inv. |
| 214 | 2 | 15 | 15.9 | 95 | 74 | 100 | 71 | Inv. |
| 215 | 2 | 17 | 16.8 | 95 | 75 | 100 | 74 | Inv. |
| 216 | 2 | 20 | 17.3 | 95 | 75 | 100 | 75 | Inv. |
| 217 | 2 | 30 | 18.7 | 94 | 77 | 100 | 76 | Inv. |
| 218 | 2 | 55 | 20.9 | 92 | 78 | 100 | 77 | Inv. |
| 219 | Y-20 | 15 | 16.0 | 93 | 71 | 100 | 68 | Inv. |
| 220 | Y-20 | 17 | 17.0 | 93 | 72 | 100 | 70 | Inv. |
| 221 | Y-20 | 20 | 17.4 | 92 | 73 | 100 | 71 | Inv. |
| 222 | Y-20 | 30 | 18.9 | 92 | 73 | 100 | 72 | Inv. |
| 223 | Y-20 | 55 | 21.1 | 91 | 72 | 100 | 72 | Inv. |

As can be seen from the results shown in Table B, almost the same results as those in Example 1 were obtained.

Also where Samples 201 to 223 were provided with a coloring layer as a subbing layer in the same manner as that in Example 1, the sharpness could further be improved similarly to Example 1 without deteriorating the fading in Condition D.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support and provided thereon photographic constitutional layers comprising at least one light-sensitive silver halide emulsion layer containing a yellow dye-forming coupler, at least one light-sensitive silver halide emulsion layer containing a magenta dye-forming coupler, and at least one light-sensitive silver halide emulsion layer containing a cyan dye-forming coupler, and at least one non-light-sensitive hydrophilic colloid layer, wherein the above silver halide emulsion layer containing the yellow dye-forming coupler contains at least one yellow dye-forming coupler represented by the following Formula (IV) or (V) and at least one of the hydrophilic colloid layers is provided between the support and the silver halide emulsion layer closest thereto and contains a white pigment:

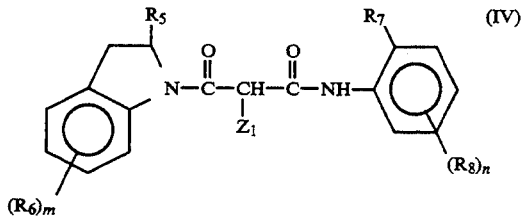

(IV)

wherein $R_5$ represents a hydrogen atom or a substituent;

$R_6$ represents a halogen atom, an alkoxycarbonyl group, an acylamino group, a sulfonamido group, a carbamoyl group, a sulfamoyl group, a sulfonyl group or an acyl group;

$R_7$ represents a halogen atom, an alkoxy group or an aryloxy group;

$R_8$ represents a sulfamoyl group, a carbamoyl group, an N-acylcarbamoyl group, a N-sulfonylcarbamoyl group, a N-sulfamoylcarbamoyl group, a N-sulfonylsulfamoyl group, a N-acylsulfamoyl group, a N-carbamoylsulfamoyl group or a N-(N-sulfonylcarbamoyl)sulfamoyl group;

$Z_1$ represents an oxazolidine-2,4-dione-3-yl group, a 1,2,4-triazolidine-3,5-dione-4-yl or a imidazolidine-2,4-dione-3-yl;

m and n each represents an integer of 0 to 4; and when m and n each represent an integer of two or more, the $R_6$ groups and $R_8$ groups each may be the same or different and may be combined with each other to form a ring;

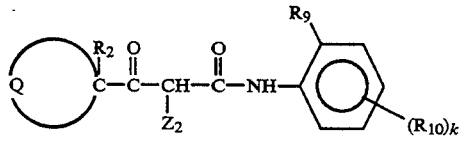

(V)

wherein

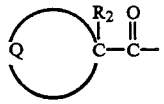

represents (i) 1-alkylcyclopropane-1-carbonyl group, wherein the alkyl group has 2 to 18 carbon atoms, or (ii) an oxygen-containing 3-membered to 6-membered heterocyclic carbonyl group, wherein $R_2$ represents an alkyl group;

$R_9$ represents a hydrogen atom, a halogen atom, an alkoxy group, an aryloxy group, an alkyl group, or an amino group;

$R_{10}$ represents a substituent;

$Z_2$ represents an oxazolidine-2,4-dione-3-yl group, a 1,2,4-triazolidine-3,5-dione-4-yl or a imidazolidine-2,4-dione-3-yl;

k represents an integer of 0 to 4, provided that when k is plural, the plurality of $R_{10}$ groups may be the same or different.

2. The silver halide color photographic light-sensitive material described in claim 1, wherein at least one layer of the above light-sensitive emulsion layers and non-light-sensitive emulsion layer is a coloring layer capable of being decolored during a color development processing step.

3. The silver halide color photographic light-sensitive material described in claim 1, wherein the amount of the white pigment in the hydrophilic colloid layer is 10 weight % or more based on the hydrophilic colloid layer.

4. The silver halide color photographic lights-sensitive material described in claim 1, wherein the coated amount of the white pigment is 2 g/m$^2$ or more of the light-sensitive material.

5. The silver halide color photographic light-sensitive material described in claim 1, wherein the yellow dye-forming coupler is added in the silver halide emulsion layer in an amount of 0.01 to 10 mmole/m$^2$.

6. The silver halide color photographic light-sensitive material described in claim 2, wherein the coloring layer contains a fine powder dye represented by the following Formula (Sa): Formula (Sa)

$$E-(X_2)_y$$

wherein E represents a compound having a chromophore; $X_2$ represents a dissociative proton bonded to E directly or via a divalent linkage group, or a group having a dissociative proton; and y represents the integer of 1 to 7.

7. The silver halide color photographic light-sensitive material described in claim 1, wherein at least one light-sensitive silver halide emulsion layer comprises silver bromochloride emulsion containing 1 mole % or less of silver iodide and 90 mole % or more of silver chloride, or silver chloride emulsion.

8. A silver halide color photographic light-sensitive material comprising a reflection type support covered with a waterproof resin layer and provided thereon photographic constitutional layers comprising at least one light-sensitive silver halide emulsion layer containing a yellow dye-forming coupler, at least one light-sensitive silver halide emulsion layer containing a magenta dye-forming coupler, and at least one light-sensitive silver halide emulsion layer containing a cyan dye-forming coupler, and at least one non-light-sensitive hydrophilic colloid layer, wherein the above silver halide emulsion layer containing the yellow dye-forming coupler contains at least one yellow dye-forming coupler represented by the following Formula (IV) or (V), and the above waterproof resin layer is provided on the emulsion layer side of the support and contains a white pigment in a density of 14 weight % or more:

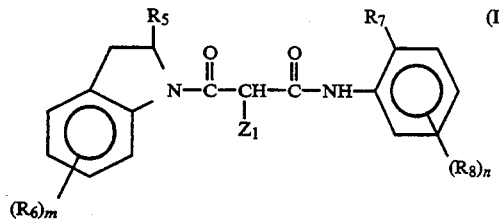

(IV)

wherein $R_5$ represents a hydrogen atom or a substituent;

$R_6$ represents a halogen atom, an alkoxycarbonyl group, an acylamino group, a sulfonamido group, a carbamoyl group, a sulfamoyl group, a sulfonyl group or an acyl group;

$R_7$ represents a halogen atom, an alkoxy group or an aryloxy group;

$R_8$ represents a sulfamoyl group, a carbamoyl group, an N-acylcarbamoyl group, a N-sulfonylcarbamoyl group, a N-sulfamoylcarbamoyl group, a N-sulfonylsulfamoyl group, a N-acylsulfamoyl group, a N-carbamoylsulfamoyl group or a N-(N-sulfonylcarbamoyl)sulfamoyl group;

$Z_1$ represents an oxazolidine-2,4-dione-3-yl group, a 1,2,4-triazolidine-3,5-dione-4-yl or a imidazolidine-2,4-dione-3-yl;

m and n each represent an integer of 0 to 4; and when m and n each represent an integer of two or more, the $R_6$ groups and $R_8$ groups each may be the same or different and may be combined with each other to form a ring;

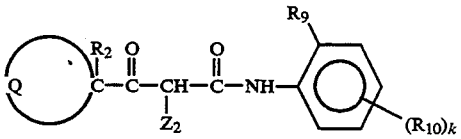

(V)

wherein

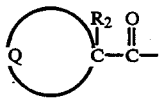

represents (i) 1-alkylcyclopropane-1-carbonyl group, wherein the alkyl group has 2 to 18 carbon atoms, or (ii) an oxygen-containing 3-membered to 6-membered heterocyclic carbonyl group, wherein $R_2$ represents an alkyl group;

$R_9$ represents a hydrogen atom, a halogen atom, an alkoxy group, an aryloxy group, an alkyl group, or an amino group;

$R_{10}$ represents a substituent;

$Z_2$ represents an oxazolidine-2,4-dione-3-yl group, a 1,2,4-triazolidine-3,5-dione-4-yl or a imidazolidine-2,4-dione-3-yl;

k represents an integer of 0 to 4, provided that when k is plural, the plurality of $R_{10}$ groups may be the same or different.

9. The silver halide color photographic light-sensitive material described in claim 8, wherein a density of the white pigment contained in the waterproof resin layer is 17 weight % or more.

10. The silver halide color photographic light-sensitive material described in claim 9, wherein at least one layer of the above light-sensitive emulsion layers and non-light-sensitive emulsion layer is a coloring layer capable of being decolored during a color development processing step.

11. The silver halide color photographic light-sensitive material described in claim 9, wherein the yellow dye-forming coupler is added in the silver halide emulsion layer in an amount of 0.01 to 10 mmol/$m^2$.

12. The silver halide color photographic light-sensitive material described in claim 9, further containing a white pigment in at least one non-light-sensitive hydrophilic colloid layer.

13. The silver halide color photographic light-sensitive material described in claim 10, wherein the coloring layer contains a fine powder dye represented by the following Formula (Sa): Formula (Sa)

$$E-(X_2)_y$$

wherein E represents a compound having a chromophore; $X_2$ represents a dissociative proton bonded to E directly or via a divalent linkage group, or a group having a dissociative proton; and y represents the integer of 1 to 7.

14. The silver halide color photographic light-sensitive material described in claim 9, wherein at least one light-sensitive silver halide emulsion layer comprises silver bromochloride emulsion containing 1 mole % or less of silver iodide and 90 mole % or more of silver chloride, or silver chloride emulsion.

* * * * *